US007234531B2

(12) United States Patent
Kendziora et al.

(10) Patent No.: US 7,234,531 B2
(45) **Date of Patent: *Jun. 26, 2007**

(54) MONO-DIAMETER WELLBORE CASING

(75) Inventors: Larry Kendziora, Needville, TX (US); Robert Lance Cook, Katy, TX (US); Lev Ring, Houston, TX (US); David Paul Brisco, Duncan, OK (US)

(73) Assignee: Enventure Global Technology, LLC, Houston, TX (US)

( * ) Notice: Subject to any disclaimer, the term of this patent is extended or adjusted under 35 U.S.C. 154(b) by 178 days.

This patent is subject to a terminal disclaimer.

(21) Appl. No.: 10/491,709

(22) PCT Filed: Sep. 19, 2002

(86) PCT No.: PCT/US02/29856
§ 371 (c)(1),
(2), (4) Date: Apr. 2, 2004

(87) PCT Pub. No.: WO03/029607
PCT Pub. Date: Apr. 10, 2003

(65) Prior Publication Data

US 2004/0251034 A1 Dec. 16, 2004

Related U.S. Application Data

(60) Continuation-in-part of application No. 10/465,835, filed as application No. PCT/US02/029856 on Sep. 19, 2002, which is a continuation-in-part of application No. 10/418,687, filed on Apr. 18, 2003, now Pat. No. 7,021,390, which is a continuation of application No. 09/852,026, filed on May 9, 2001, now Pat. No. 6,561,227, which is a division of application No. 09/454,139, filed on Dec. 3, 1999, now Pat. No. 6,497,289.

(60) Provisional application No. 60/326,886, filed on Oct. 3, 2001, provisional application No. 60/262,434, filed on Jan. 17, 2001, provisional application No. 60/111,293, filed on Dec. 7, 1998.

(51) Int. Cl.
*E21B 23/02* (2006.01)

(52) U.S. Cl. ..... 166/384; 166/207; 166/380

(58) Field of Classification Search ..... None
See application file for complete search history.

(56) References Cited

U.S. PATENT DOCUMENTS 46,818 A 3/1865 Patterson (Continued)

FOREIGN PATENT DOCUMENTS

AU 767364 2/2004

(Continued)

OTHER PUBLICATIONS

Halliburton Energy Services, "Halliburton Completion Products" 1996, Page Packers 5-37, United States of America.

(Continued)

*Primary Examiner*—Zakiya W. Bates
(74) *Attorney, Agent, or Firm*—Haynes and Boone LLP

(57) ABSTRACT

A mono-diameter wellbore casing. A tubular liner and an expansion cone are positioned within a new section of a wellbore with the tubular liner in an overlapping relationship with a pre-existing casing. A hardenable fluidic material is injected into the new section of the wellbore below the level of the expansion cone and into the annular region between the tubular liner and the new section of the wellbore. The inner and outer regions of the tubular liner are then fluidicly isolated. A non hardenable fluidic material is then injected into a portion of an interior region of the tubular liner to pressurize the portion of the interior region of the tubular liner below the expansion cone. The tubular liner is then extruded off of the expansion cone. The overlapping portion of the pre-existing casing and the tubular liner are then radially expanded using an expansion cone.

72 Claims, 17 Drawing Sheets

U.S. PATENT DOCUMENTS

| | | | |
|---|---|---|---|
| 331,940 | A | 12/1885 | Bole |
| 332,184 | A | 12/1885 | Bole |
| 341,237 | A | 5/1886 | Healey |
| 519,805 | A | 5/1894 | Bavier |
| 802,880 | A | 10/1905 | Phillips, Jr. |
| 806,156 | A | 12/1905 | Marshall |
| 958,517 | A | 5/1910 | Mettler |
| 984,449 | A | 2/1911 | Stewart |
| 1,166,040 | A | 12/1915 | Burlingham |
| 1,233,888 | A | 7/1917 | Leonard |
| 1,494,128 | A | 5/1924 | Primrose |
| 1,589,781 | A | 6/1926 | Anderson |
| 1,590,357 | A | 6/1926 | Feisthamel |
| 1,597,212 | A | 8/1926 | Spengler |
| 1,613,461 | A | 1/1927 | Johnson |
| 1,756,531 | A | 4/1930 | Aldeen et al. |
| 1,880,218 | A | 10/1932 | Simmons |
| 1,981,525 | A | 11/1934 | Price |
| 2,046,870 | A | 7/1936 | Clasen et al. |
| 2,087,185 | A | 7/1937 | Dillom |
| 2,122,757 | A | 7/1938 | Scott |
| 2,145,168 | A | 1/1939 | Flagg |
| 2,160,263 | A | 5/1939 | Fletcher |
| 2,187,275 | A | 1/1940 | McLennan |
| 2,204,586 | A | 6/1940 | Grau |
| 2,214,226 | A | 9/1940 | English |
| 2,226,804 | A | 12/1940 | Carroll |
| 2,246,038 | A | 6/1941 | Graham |
| 2,273,017 | A | 2/1942 | Boynton |
| 2,301,495 | A | 11/1942 | Abegg |
| 2,305,282 | A | 12/1942 | Taylor, Jr. et al. |
| 2,371,840 | A | 3/1945 | Otis |
| 2,383,214 | A | 8/1945 | Prout |
| 2,447,629 | A | 8/1948 | Beissinger et al. |
| 2,500,276 | A | 3/1950 | Church |
| 2,546,295 | A | 3/1951 | Boice |
| 2,583,316 | A | 1/1952 | Bannister |
| 2,609,258 | A | 11/1952 | Taylor, Jr. et al. |
| 2,627,891 | A | 2/1953 | Clark |
| 2,647,847 | A | 8/1953 | Black et al. |
| 2,664,952 | A | 1/1954 | Losey |
| 2,691,418 | A | 10/1954 | Connolly |
| 2,723,721 | A | 11/1955 | Corsette |
| 2,734,580 | A | 2/1956 | Layne |
| 2,796,134 | A | 6/1957 | Binkley |
| 2,812,025 | A | 11/1957 | Teague et al. |
| 2,877,822 | A | 3/1959 | Buck |
| 2,907,589 | A | 10/1959 | Knox |
| 2,919,741 | A | 1/1960 | Strock et al. |
| 2,929,741 | A | 1/1960 | Strock et al. |
| 3,015,362 | A | 1/1962 | Moosman |
| 3,015,500 | A | 1/1962 | Barnett |
| 3,018,547 | A | 1/1962 | Marskell |
| 3,039,530 | A | 6/1962 | Condra |
| 3,067,801 | A | 12/1962 | Sortor |
| 3,067,819 | A | 12/1962 | Gore |
| 3,068,563 | A | 12/1962 | Reverman |
| 3,104,703 | A | 9/1963 | Rike et al. |
| 3,111,991 | A | 11/1963 | O'Neal |
| 3,167,122 | A | 1/1965 | Lang |
| 3,175,618 | A | 3/1965 | Lang et al. |
| 3,179,168 | A | 4/1965 | Vincent |
| 3,188,816 | A | 6/1965 | Koch |
| 3,191,677 | A | 6/1965 | Kinley |
| 3,191,680 | A | 6/1965 | Vincent |
| 3,203,451 | A | 8/1965 | Vincent |
| 3,203,483 | A | 8/1965 | Vincent |
| 3,209,546 | A | 10/1965 | Lawton |
| 3,210,102 | A | 10/1965 | Joslin |
| 3,233,315 | A | 2/1966 | Levake |
| 3,245,471 | A | 4/1966 | Howard |
| 3,270,817 | A | 9/1966 | Papaila |
| 3,297,092 | A | 1/1967 | Jennings |
| 3,326,293 | A | 6/1967 | Skipper |
| 3,343,252 | A | 9/1967 | Reesor |
| 3,353,599 | A | 11/1967 | Swift |
| 3,354,955 | A | 11/1967 | Berry |
| 3,358,760 | A | 12/1967 | Blagg |
| 3,358,769 | A | 12/1967 | Berry |
| 3,364,993 | A | 1/1968 | Skipper |
| 3,371,717 | A | 3/1968 | Chenoweth |
| 3,412,565 | A | 11/1968 | Lindsey et al. |
| 3,419,080 | A | 12/1968 | Lebourg |
| 3,422,902 | A | 1/1969 | Bouchillon |
| 3,424,244 | A | 1/1969 | Kinley |
| 3,427,707 | A | 2/1969 | Nowosadko |
| 3,477,506 | A | 11/1969 | Malone |
| 3,489,220 | A | 1/1970 | Kinley |
| 3,498,376 | A | 3/1970 | Sizer et al. |
| 3,504,515 | A | 4/1970 | Reardon |
| 3,520,049 | A | 7/1970 | Lysenko et al. |
| 3,528,498 | A | 9/1970 | Carothers |
| 3,532,174 | A | 10/1970 | Diamantides et al. |
| 3,568,773 | A | 3/1971 | Chancellor |
| 3,578,081 | A | 5/1971 | Bodine |
| 3,579,805 | A | 5/1971 | Kast |
| 3,605,887 | A | 9/1971 | Lambie |
| 3,631,926 | A | 1/1972 | Young |
| 3,665,591 | A | 5/1972 | Kowal |
| 3,667,547 | A | 6/1972 | Ahlstone |
| 3,669,190 | A | 6/1972 | Sizer et al. |
| 3,682,256 | A | 8/1972 | Stuart |
| 3,687,196 | A | 8/1972 | Mullins |
| 3,691,624 | A | 9/1972 | Kinley |
| 3,693,717 | A | 9/1972 | Wuenschel |
| 3,704,730 | A | 12/1972 | Witzig |
| 3,709,306 | A | 1/1973 | Curington |
| 3,711,123 | A | 1/1973 | Arnold |
| 3,712,376 | A | 1/1973 | Owen et al. |
| 3,746,068 | A | 7/1973 | Deckert et al. |
| 3,746,091 | A | 7/1973 | Owen et al. |
| 3,746,092 | A | 7/1973 | Land |
| 3,764,168 | A | 10/1973 | Kisling, III et al. |
| 3,776,307 | A | 12/1973 | Young |
| 3,779,025 | A | 12/1973 | Godley et al. |
| 3,780,562 | A | 12/1973 | Kinley |
| 3,781,966 | A | 1/1974 | Lieberman |
| 3,785,193 | A | 1/1974 | Kinely et al. |
| 3,797,259 | A | 3/1974 | Kammerer, Jr. |
| 3,805,567 | A | 4/1974 | Agius-Sincero |
| 3,812,912 | A | 5/1974 | Wuenschel |
| 3,818,734 | A | 6/1974 | Bateman |
| 3,834,742 | A | 9/1974 | McPhillips |
| 3,866,954 | A | 2/1975 | Slator et al. |
| 3,885,298 | A | 5/1975 | Pogonowski |
| 3,887,006 | A | 6/1975 | Pitts |
| 3,893,718 | A | 7/1975 | Powell |
| 3,898,163 | A | 8/1975 | Mott |
| 3,915,478 | A | 10/1975 | Al et al. |
| 3,935,910 | A | 2/1976 | Gaudy et al. |
| 3,942,824 | A | 3/1976 | Sable |
| 3,945,444 | A | 3/1976 | Knudson |
| 3,948,321 | A | 4/1976 | Owen et al. |
| 3,970,336 | A | 7/1976 | O'Sickey et al. |
| 3,977,473 | A | 8/1976 | Page, Jr. |
| 3,989,280 | A | 11/1976 | Schwarz |
| 3,997,193 | A | 12/1976 | Tsuda et al. |
| 3,999,605 | A | 12/1976 | Braddick |
| 4,011,652 | A | 3/1977 | Black |
| 4,019,579 | A | 4/1977 | Thuse |
| 4,026,583 | A | 5/1977 | Gottlieb |
| 4,053,247 | A | 10/1977 | Marsh, Jr. |
| 4,069,573 | A | 1/1978 | Rogers, Jr. et al. |
| 4,076,287 | A | 2/1978 | Bill et al. |

4,096,913 A 6/1978 Kenneday et al.
4,098,334 A 7/1978 Crowe
4,099,563 A 7/1978 Hutchison et al.
4,125,937 A 11/1978 Brown et al.
4,152,821 A 5/1979 Scott
4,190,108 A 2/1980 Webber
4,204,312 A 5/1980 Tooker
4,205,422 A 6/1980 Hardwick
4,226,449 A 10/1980 Cole
4,253,687 A 3/1981 Maples
4,257,155 A 3/1981 Hunter
4,274,665 A 6/1981 Marsh, Jr.
RE30,802 E 11/1981 Rogers, Jr.
4,304,428 A 12/1981 Grigorian et al.
4,328,983 A 5/1982 Gibson
4,355,664 A 10/1982 Cook et al.
4,359,889 A 11/1982 Kelly
4,363,358 A 12/1982 Ellis
4,366,971 A 1/1983 Lula
4,368,571 A 1/1983 Cooper, Jr.
4,379,471 A 4/1983 Kuenzel
4,380,347 A 4/1983 Sable
4,384,625 A 5/1983 Roper et al.
4,388,752 A 6/1983 Vinciguerra et al.
4,391,325 A 7/1983 Baker et al.
4,393,931 A 7/1983 Muse et al.
4,396,061 A 8/1983 Tamplen et al.
4,401,325 A 8/1983 Tsuchiya et al.
4,402,372 A 9/1983 Cherrington
4,407,681 A 10/1983 Ina et al.
4,411,435 A 10/1983 McStravick
4,413,395 A 11/1983 Garnier
4,413,682 A 11/1983 Callihan et al.
4,420,866 A 12/1983 Mueller
4,421,169 A 12/1983 Dearth et al.
4,422,317 A 12/1983 Mueller
4,422,507 A 12/1983 Reimert
4,423,889 A 1/1984 Weise
4,423,986 A 1/1984 Skogberg
4,424,865 A 1/1984 Payton, Jr.
4,429,741 A 2/1984 Hyland
4,440,233 A 4/1984 Baugh et al.
4,442,586 A 4/1984 Ridenour
4,444,250 A 4/1984 Keithahn et al.
4,449,713 A 5/1984 Ishido et al.
4,462,471 A 7/1984 Hipp
4,467,630 A 8/1984 Kelly
4,468,309 A 8/1984 White
4,469,356 A 9/1984 Duret et al.
4,473,245 A 9/1984 Raulins et al.
4,483,399 A 11/1984 Colgate
4,485,847 A 12/1984 Wentzell
4,491,001 A 1/1985 Yoshida
4,501,327 A 2/1985 Retz
4,505,017 A 3/1985 Schukei
4,505,987 A 3/1985 Yamada et al.
4,507,019 A 3/1985 Thompson
4,508,129 A 4/1985 Brown
4,511,289 A 4/1985 Herron
4,519,456 A 5/1985 Cochran
4,526,232 A 7/1985 Hughson et al.
4,526,839 A 7/1985 Herman et al.
4,530,231 A 7/1985 Main
4,541,655 A 9/1985 Hunter
4,550,782 A 11/1985 Lawson
4,553,776 A 11/1985 Dodd
4,573,248 A 3/1986 Hackett
4,576,386 A 3/1986 Benson et al.
4,581,817 A 4/1986 Kelly
4,590,227 A 5/1986 Nakamura et al.
4,590,995 A 5/1986 Evans
4,592,577 A 6/1986 Ayres et al.
4,595,063 A 6/1986 Jennings et al.
4,601,343 A 7/1986 Lindsey, Jr. et al.
4,605,063 A 8/1986 Ross
4,611,662 A 9/1986 Harrington
4,614,233 A 9/1986 Menard
4,629,218 A 12/1986 Dubois
4,630,849 A 12/1986 Fukui et al.
4,632,944 A 12/1986 Thompson
4,634,317 A 1/1987 Skogberg et al.
4,635,333 A 1/1987 Finch
4,637,436 A 1/1987 Stewart, Jr. et al.
4,646,787 A 3/1987 Rush et al.
4,649,492 A 3/1987 Sinha et al.
4,651,831 A 3/1987 Baugh et al.
4,651,836 A 3/1987 Richards
4,656,779 A 4/1987 Fedeli
4,660,863 A 4/1987 Bailey et al.
4,662,446 A 5/1987 Brisco et al.
4,669,541 A 6/1987 Bissonnette
4,674,572 A 6/1987 Gallus
4,682,797 A 7/1987 Hildner
4,685,191 A 8/1987 Mueller et al.
4,685,834 A 8/1987 Jordan
4,693,498 A 9/1987 Baugh et al.
4,711,474 A 12/1987 Patrick
4,714,117 A 12/1987 Dech
4,730,851 A 3/1988 Watts
4,735,444 A 4/1988 Skipper
4,739,654 A 4/1988 Pilkington et al.
4,739,916 A 4/1988 Ayres et al.
4,754,781 A 7/1988 Putter
4,758,025 A 7/1988 Frick
4,776,394 A 10/1988 Lynde et al.
4,778,088 A 10/1988 Miller
4,779,445 A 10/1988 Rabe
4,793,382 A 12/1988 Szalvay
4,796,668 A 1/1989 Depret
4,817,710 A 4/1989 Edwards et al.
4,817,712 A 4/1989 Bodine
4,817,716 A 4/1989 Taylor et al.
4,826,347 A 5/1989 Baril et al.
4,827,594 A 5/1989 Cartry et al.
4,828,033 A 5/1989 Frison
4,830,109 A 5/1989 Wedel
4,832,382 A 5/1989 Kapgan
4,836,579 A 6/1989 Wester et al.
4,842,082 A 6/1989 Springer
4,848,459 A 7/1989 Blackwell et al.
4,854,338 A 8/1989 Grantham
4,856,592 A 8/1989 Van Bilderbeek et al.
4,865,127 A 9/1989 Koster
4,871,199 A 10/1989 Ridenour et al.
4,872,253 A 10/1989 Carstensen
4,887,646 A 12/1989 Groves
4,888,975 A 12/1989 Soward et al.
4,892,337 A 1/1990 Gunderson et al.
4,893,658 A 1/1990 Kimura et al.
4,904,136 A 2/1990 Matsumoto
4,907,828 A 3/1990 Change
4,911,237 A 3/1990 Melenyzer
4,913,758 A 4/1990 Koster
4,915,177 A 4/1990 Claycomb
4,915,426 A 4/1990 Skipper
4,917,409 A 4/1990 Reeves
4,919,989 A 4/1990 Colangelo
4,930,573 A 6/1990 Lane et al.
4,934,038 A 6/1990 Caudill
4,934,312 A 6/1990 Koster et al.
4,938,291 A 7/1990 Lynde et al.
4,941,512 A 7/1990 McParland
4,941,532 A 7/1990 Hurt et al.
4,942,925 A 7/1990 Themig
4,942,926 A 7/1990 Lessi
4,958,691 A 9/1990 Hipp 4,968,184 A 11/1990 Reid
4,971,152 A 11/1990 Koster et al.
4,976,322 A 12/1990 Abdrakhmanov et al.
4,981,250 A 1/1991 Persson
4,995,464 A 2/1991 Watkins et al.
5,014,779 A 5/1991 Meling et al.
5,015,017 A 5/1991 Geary
5,026,074 A 6/1991 Hoes et al.
5,031,370 A 7/1991 Jewett
5,031,699 A 7/1991 Artynov et al.
5,040,283 A 8/1991 Pelgrom
5,044,676 A 9/1991 Burton et al.
5,052,483 A 10/1991 Hudson
5,059,043 A 10/1991 Kuhne
5,064,004 A 11/1991 Lundel
5,079,837 A 1/1992 Vanselow
5,083,608 A 1/1992 Abdrakhmanov et al.
5,093,015 A 3/1992 Oldiges
5,095,991 A 3/1992 Milberger
5,101,653 A 4/1992 Hermes et al.
5,105,888 A 4/1992 Pollock et al.
5,107,221 A 4/1992 N'Guyen et al.
5,119,661 A 6/1992 Abdrakhmanov et al.
5,134,891 A 8/1992 Canevet
5,150,755 A 9/1992 Cassel et al.
5,156,043 A 10/1992 Ose
5,156,213 A 10/1992 George et al.
5,156,223 A 10/1992 Hipp
5,174,376 A 12/1992 Singeetham
5,181,571 A 1/1993 Mueller et al.
5,195,583 A 3/1993 Toon et al.
5,197,553 A 3/1993 Leturno
5,209,600 A 5/1993 Koster
5,226,492 A 7/1993 Solaeche P. et al.
5,242,017 A 9/1993 Hailey
5,253,713 A 10/1993 Gregg et al.
5,275,242 A 1/1994 Payne
5,282,508 A 2/1994 Ellingsen et al.
5,286,393 A 2/1994 Oldiges et al.
5,306,101 A 4/1994 Rockower et al.
5,309,621 A 5/1994 O'Donnell et al.
5,314,014 A 5/1994 Tucker
5,314,209 A 5/1994 Kuhne
5,318,122 A 6/1994 Murray et al.
5,318,131 A 6/1994 Baker
5,325,923 A 7/1994 Surjaatmadja et al.
5,326,137 A 7/1994 Lorenz et al.
5,327,964 A 7/1994 O'Donnell et al.
5,330,850 A 7/1994 Suzuki et al.
5,332,038 A 7/1994 Tapp et al.
5,332,049 A 7/1994 Tew
5,333,692 A 8/1994 Baugh et al.
5,335,736 A 8/1994 Windsor
5,337,808 A 8/1994 Graham
5,337,823 A 8/1994 Nobileau
5,337,827 A 8/1994 Hromas et al.
5,339,894 A 8/1994 Stotler
5,343,949 A 9/1994 Ross et al.
5,346,007 A 9/1994 Dillon et al.
5,348,087 A 9/1994 Williamson, Jr.
5,348,093 A 9/1994 Wood et al.
5,348,095 A 9/1994 Worrall et al.
5,348,668 A 9/1994 Oldiges et al.
5,351,752 A 10/1994 Wood et al.
5,360,239 A 11/1994 Klementich
5,360,292 A 11/1994 Allen et al.
5,361,843 A 11/1994 Shy et al.
5,366,010 A 11/1994 Zwart
5,366,012 A 11/1994 Lohbeck
5,368,075 A 11/1994 Bäro et al.
5,370,425 A 12/1994 Dougherty et al.
5,375,661 A 12/1994 Daneshy et al.
5,388,648 A 2/1995 Jordan, Jr.
5,390,735 A 2/1995 Williamson, Jr.
5,390,742 A 2/1995 Dines et al.
5,396,957 A 3/1995 Surjaatmadja et al.
5,400,827 A 3/1995 Baro et al.
5,405,171 A 4/1995 Allen et al.
5,413,180 A 5/1995 Ross et al.
5,425,559 A 6/1995 Nobileau
5,426,130 A 6/1995 Thurder et al.
5,431,831 A 7/1995 Vincent
5,435,395 A 7/1995 Connell
5,439,320 A 8/1995 Abrams
5,443,129 A 8/1995 Bailey et al.
5,447,201 A 9/1995 Mohn
5,454,419 A 10/1995 Vloedman
5,456,319 A 10/1995 Schmidt et al.
5,458,194 A 10/1995 Brooks
5,462,120 A 10/1995 Gondouin
5,467,822 A 11/1995 Zwart
5,472,055 A 12/1995 Simson et al.
5,474,334 A 12/1995 Eppink
5,492,173 A 2/1996 Kilgore et al.
5,494,106 A 2/1996 Gueguen et al.
5,507,343 A 4/1996 Carlton et al.
5,511,620 A 4/1996 Baugh et al.
5,524,937 A 6/1996 Sides, III et al.
5,535,824 A 7/1996 Hudson
5,536,422 A 7/1996 Oldiges et al.
5,540,281 A 7/1996 Round
5,554,244 A 9/1996 Ruggles et al.
5,566,772 A 10/1996 Coone et al.
5,576,485 A 11/1996 Serata
5,584,512 A 12/1996 Carstensen
5,606,792 A 3/1997 Schafer
5,611,399 A 3/1997 Richard et al.
5,613,557 A 3/1997 Blount et al.
5,617,918 A 4/1997 Cooksey et al.
5,642,560 A 7/1997 Tabuchi et al.
5,642,781 A 7/1997 Richard
5,662,180 A 9/1997 Coffman et al.
5,664,327 A 9/1997 Swars
5,667,011 A 9/1997 Gill et al.
5,667,252 A 9/1997 Schafer et al.
5,678,609 A 10/1997 Washburn
5,685,369 A 11/1997 Ellis et al.
5,689,871 A 11/1997 Carstensen
5,695,008 A 12/1997 Bertet et al.
5,695,009 A 12/1997 Hipp
5,697,442 A 12/1997 Baldridge
5,697,449 A 12/1997 Hennig et al.
5,718,288 A 2/1998 Bertet et al.
5,738,146 A 4/1998 Abe
5,743,335 A 4/1998 Bussear
5,749,419 A 5/1998 Coronado et al.
5,749,585 A 5/1998 Lembcke
5,755,895 A 5/1998 Tamehiro et al.
5,775,422 A 7/1998 Wong et al.
5,785,120 A 7/1998 Smalley et al.
5,787,933 A 8/1998 Russ et al.
5,791,419 A 8/1998 Valisalo
5,794,702 A 8/1998 Nobileau
5,797,454 A 8/1998 Hipp
5,829,520 A 11/1998 Johnson
5,829,524 A 11/1998 Flanders et al.
5,833,001 A 11/1998 Song et al.
5,845,945 A 12/1998 Carstensen
5,849,188 A 12/1998 Voll et al.
5,857,524 A 1/1999 Harris
5,862,866 A 1/1999 Springer
5,875,851 A 3/1999 Vick, Jr. et al.
5,885,941 A 3/1999 Sateva et al.
5,895,079 A 4/1999 Carstensen et al.
5,901,789 A 5/1999 Donnelly et al.
5,918,677 A 7/1999 Head 5,924,745 A 7/1999 Campbell
5,931,511 A 8/1999 DeLange et al.
5,944,100 A 8/1999 Hipp
5,944,107 A 8/1999 Ohmer
5,944,108 A 8/1999 Baugh et al.
5,951,207 A 9/1999 Chen
5,957,195 A 9/1999 Bailey et al.
5,971,443 A 10/1999 Noel et al.
5,975,587 A 11/1999 Wood et al.
5,979,560 A 11/1999 Nobileau
5,984,369 A 11/1999 Crook et al.
5,984,568 A 11/1999 Lohbeck
6,012,521 A 1/2000 Zunkel et al.
6,012,522 A 1/2000 Donnelly et al.
6,012,523 A 1/2000 Campbell et al.
6,012,874 A 1/2000 Groneck et al.
6,015,012 A 1/2000 Reddick
6,017,168 A 1/2000 Fraser et al.
6,021,850 A 2/2000 Woo et al.
6,029,748 A 2/2000 Forsyth et al.
6,035,954 A 3/2000 Hipp
6,044,906 A 4/2000 Saltel
6,047,505 A 4/2000 Willow
6,047,774 A 4/2000 Allen
6,050,341 A 4/2000 Metcalf
6,050,346 A 4/2000 Hipp
6,056,059 A 5/2000 Ohmer
6,056,324 A 5/2000 Reimert et al.
6,062,324 A 5/2000 Hipp
6,065,500 A 5/2000 Metcalfe
6,070,671 A 6/2000 Cumming et al.
6,073,692 A 6/2000 Wood et al.
6,073,698 A 6/2000 Schultz et al.
6,074,133 A 6/2000 Kelsey
6,078,031 A 6/2000 Bliault et al.
6,079,495 A 6/2000 Ohmer
6,085,838 A 7/2000 Vercaemer et al.
6,089,320 A 7/2000 LaGrange
6,098,717 A 8/2000 Bailey et al.
6,102,119 A 8/2000 Raines
6,109,355 A 8/2000 Reid
6,112,818 A 9/2000 Campbell
6,131,265 A 10/2000 Bird
6,135,208 A 10/2000 Gano et al.
6,138,761 A 10/2000 Freeman et al.
6,142,230 A 11/2000 Smalley et al.
6,158,963 A 12/2000 Hollis
6,167,970 B1 1/2001 Stout
6,182,775 B1 2/2001 Hipp
6,196,336 B1 3/2001 Fincher et al.
6,226,855 B1 5/2001 Maine
6,231,086 B1 5/2001 Tierling
6,250,385 B1 6/2001 Montaron
6,263,966 B1 7/2001 Haut et al.
6,263,968 B1 7/2001 Freeman et al.
6,263,972 B1 7/2001 Richard et al.
6,267,181 B1 7/2001 Rhein-Knudsen et al.
6,273,634 B1 8/2001 Lohbeck
6,275,556 B1 8/2001 Kinney et al.
6,283,211 B1 9/2001 Vloedman
6,302,211 B1 10/2001 Nelson et al.
6,315,043 B1 11/2001 Farrant et al.
6,318,457 B1 11/2001 Den Boer et al.
6,318,465 B1 11/2001 Coon et al.
6,322,109 B1 11/2001 Campbell et al.
6,325,148 B1 12/2001 Trahan et al.
6,328,113 B1 12/2001 Cook
6,334,351 B1 1/2002 Tsuchiya
6,343,495 B1 2/2002 Cheppe et al.
6,343,657 B1 2/2002 Baugh et al.
6,345,373 B1 2/2002 Chakradhar et al.
6,345,431 B1 2/2002 Greig
6,352,112 B1 3/2002 Mills
6,354,373 B1 3/2002 Vercaemer et al.
6,390,720 B1 5/2002 LeBegue et al.
6,405,761 B1 6/2002 Shimizu et al.
6,406,063 B1 6/2002 Pfeiffer
6,409,175 B1 6/2002 Evans et al.
6,419,025 B1 7/2002 Lohbeck et al.
6,419,026 B1 7/2002 MacKenzie et al.
6,419,033 B1 7/2002 Hahn et al.
6,419,147 B1 7/2002 Daniel
6,425,444 B1 7/2002 Metcalfe et al.
6,431,277 B1 8/2002 Cox et al.
6,446,724 B2 9/2002 Baugh et al.
6,450,261 B1 9/2002 Baugh
6,454,013 B1 9/2002 Metcalfe
6,457,532 B1 10/2002 Simpson
6,457,533 B1 10/2002 Metcalfe
6,457,749 B1 10/2002 Heijnen
6,460,615 B1 10/2002 Heijnen
6,464,008 B1 10/2002 Roddy et al.
6,464,014 B1 10/2002 Bernat
6,470,966 B2 10/2002 Cook et al.
6,470,996 B1 10/2002 Kyle et al.
6,478,092 B2 11/2002 Voll et al.
6,491,108 B1 12/2002 Slup et al.
6,497,289 B1 12/2002 Cook et al.
6,516,887 B2 2/2003 Nguyen et al.
6,517,126 B1 2/2003 Peterson et al.
6,527,049 B2 3/2003 Metcalfe et al.
6,543,545 B1 4/2003 Chatterji et al.
6,543,552 B1 4/2003 Metcalfe et al.
6,550,539 B2 4/2003 Maguire et al.
6,550,821 B2 4/2003 DeLange et al.
6,557,640 B1 5/2003 Cook et al.
6,561,227 B2 5/2003 Cook et al.
6,561,279 B2 5/2003 MacKenzie et al.
6,564,875 B1 5/2003 Bullock
6,568,471 B1 5/2003 Cook et al.
6,568,488 B2 5/2003 Wentworth et al.
6,575,240 B1 6/2003 Cook et al.
6,578,630 B2 6/2003 Simpson et al.
6,585,053 B2 7/2003 Coon
6,591,905 B2 7/2003 Coon
6,598,677 B1 7/2003 Baugh et al.
6,598,678 B1 7/2003 Simpson
6,604,763 B1 8/2003 Cook et al.
6,607,220 B2 8/2003 Sivley, IV
6,619,696 B2 9/2003 Baugh et al.
6,622,797 B2 9/2003 Sivley, IV
6,629,567 B2 10/2003 Lauritzen et al.
6,631,759 B2 10/2003 Cook et al.
6,631,760 B2 10/2003 Cook et al.
6,631,765 B2 10/2003 Baugh et al.
6,631,769 B2 10/2003 Cook et al.
6,634,431 B2 10/2003 Cook et al.
6,640,903 B1 11/2003 Cook et al.
6,648,075 B2 11/2003 Badrak et al.
6,662,876 B2 12/2003 Lauritzen
6,668,937 B1 12/2003 Murray
6,672,759 B2 1/2004 Feger
6,679,328 B2 1/2004 Davis et al.
6,681,862 B2 1/2004 Freeman
6,684,947 B2 2/2004 Cook et al.
6,688,397 B2 2/2004 McClurkin et al.
6,695,012 B1 2/2004 Ring et al.
6,695,065 B2 2/2004 Simpson et al.
6,698,517 B2 3/2004 Simpson
6,701,598 B2 3/2004 Chen et al.
6,702,030 B2 3/2004 Simpson
6,705,395 B2 3/2004 Cook et al.
6,708,767 B2 3/2004 Harrall et al.
6,712,154 B2 3/2004 Cook et al.
6,712,401 B2 3/2004 Coulon et al.
6,719,064 B2 4/2004 Price-Smith et al.

6,722,427 B2 4/2004 Gano et al.
6,722,437 B2 4/2004 Vercaemer et al.
6,722,443 B1 4/2004 Metcalfe
6,725,917 B2 4/2004 Metcalfe
6,725,919 B2 4/2004 Cook et al.
6,725,934 B2 4/2004 Coronado et al.
6,725,939 B2 4/2004 Richard
6,732,806 B2 5/2004 Mauldin et al.
6,739,392 B2 5/2004 Cook et al.
6,745,845 B2 6/2004 Cook et al.
6,758,278 B2 7/2004 Cook et al.
6,772,841 B2 8/2004 Gano
6,796,380 B2 9/2004 Xu
6,814,147 B2 11/2004 Baugh
6,820,690 B2 11/2004 Vercaemer et al.
6,823,937 B1 11/2004 Cook et al.
6,832,649 B2 12/2004 Bode et al.
6,834,725 B2 12/2004 Whanger et al.
6,843,322 B2 1/2005 Burtner et al.
6,857,473 B2 2/2005 Cook et al.
6,880,632 B2 4/2005 Tom et al.
6,892,819 B2 5/2005 Cook et al.
6,902,000 B2 6/2005 Heijnen
6,907,652 B1 6/2005 Martin
6,923,261 B2 8/2005 Metcalfe et al.
6,935,429 B2 8/2005 Badrak
6,935,430 B2 8/2005 Harrell et al.
6,966,370 B2 11/2005 Cook et al.
6,976,539 B2 12/2005 Metcalfe et al.
7,000,953 B2 2/2006 Berghaus
7,007,760 B2 3/2006 Lohbeck
7,021,390 B2 4/2006 Cook et al.
2001/0002626 A1 6/2001 Frank et al.
2001/0020532 A1 9/2001 Baugh et al.
2001/0045284 A1 11/2001 Simpson et al.
2001/0045289 A1 11/2001 Cook et al.
2001/0047870 A1 12/2001 Cook et al.
2002/0011339 A1 1/2002 Murray
2002/0014339 A1 2/2002 Ross
2002/0020524 A1 2/2002 Gano
2002/0020531 A1 2/2002 Ohmer
2002/0033261 A1 3/2002 Metcalfe
2002/0060068 A1 5/2002 Cook et al.
2002/0062956 A1 5/2002 Murray et al.
2002/0066576 A1 6/2002 Cook et al.
2002/0066578 A1 6/2002 Broome
2002/0070023 A1 6/2002 Turner et al.
2002/0070031 A1 6/2002 Voll et al.
2002/0079101 A1 6/2002 Baugh et al.
2002/0084070 A1 7/2002 Voll et al.
2002/0092654 A1 7/2002 Coronado et al.
2002/0108756 A1 8/2002 Harrall et al.
2002/0139540 A1 10/2002 Lauritzen
2002/0144822 A1 10/2002 Hackworth et al.
2002/0148612 A1 10/2002 Cook et al.
2002/0185274 A1 12/2002 Simpson et al.
2002/0189816 A1 12/2002 Cook et al.
2002/0195252 A1 12/2002 Maguire et al.
2002/0195256 A1 12/2002 Metcalfe et al.
2003/0024708 A1 2/2003 Ring et al.
2003/0024711 A1 2/2003 Simpson et al.
2003/0034177 A1 2/2003 Chitwood et al.
2003/0042022 A1 3/2003 Lauritzen et al.
2003/0047322 A1 3/2003 Maguire et al.
2003/0047323 A1 3/2003 Jackson et al.
2003/0056991 A1 3/2003 Hahn et al.
2003/0066655 A1 4/2003 Cook et al.
2003/0067166 A1 4/2003 Maguire
2003/0075337 A1 4/2003 Maguire
2003/0075338 A1 4/2003 Sivley, IV
2003/0075339 A1 4/2003 Gano et al.
2003/0094277 A1 5/2003 Cook et al.
2003/0094278 A1 5/2003 Cook et al.
2003/0094279 A1 5/2003 Ring et al.
2003/0098154 A1 5/2003 Cook et al.
2003/0098162 A1 5/2003 Cook
2003/0107217 A1 6/2003 Daigle et al.
2003/0111234 A1 6/2003 McClurkin et al.
2003/0116318 A1 6/2003 Metcalfe
2003/0116325 A1 6/2003 Cook et al.
2003/0121558 A1 7/2003 Cook et al.
2003/0121655 A1 7/2003 Lauritzen et al.
2003/0121669 A1 7/2003 Cook et al.
2003/0140673 A1 7/2003 Marr et al.
2003/0150608 A1 8/2003 Smith, Jr. et al.
2003/0168222 A1 9/2003 Maguire et al.
2003/0173090 A1 9/2003 Cook et al.
2003/0192705 A1 10/2003 Cook et al.
2003/0221841 A1 12/2003 Burtner et al.
2003/0222455 A1 12/2003 Cook et al.
2004/0019466 A1 1/2004 Zimmerman
2004/0045616 A1 3/2004 Cook et al.
2004/0045718 A1 3/2004 Brisco et al.
2004/0060706 A1 4/2004 Stephenson
2004/0065446 A1 4/2004 Tran et al.
2004/0069499 A1 4/2004 Cook et al.
2004/0112589 A1 6/2004 Cook et al.
2004/0112606 A1 6/2004 Lewis et al.
2004/0118574 A1 6/2004 Cook et al.
2004/0123983 A1 7/2004 Cook et al.
2004/0123988 A1 7/2004 Cook et al.
2004/0129431 A1 7/2004 Jackson
2004/0149431 A1 8/2004 Wylie et al.
2004/0159446 A1 8/2004 Haugen et al.
2004/0188099 A1 9/2004 Cook et al.
2004/0216873 A1 11/2004 Frost, Jr. et al.
2004/0221996 A1 11/2004 Burge
2004/0231839 A1 11/2004 Ellington et al.
2004/0231855 A1 11/2004 Cook et al.
2004/0238181 A1 12/2004 Cook et al.
2004/0244968 A1 12/2004 Cook et al.
2004/0262014 A1 12/2004 Cook et al.
2005/0011641 A1 1/2005 Cook et al.
2005/0015963 A1 1/2005 Costa et al.
2005/0028988 A1 2/2005 Cook et al.
2005/0039910 A1 2/2005 Lohbeck
2005/0039928 A1 2/2005 Cook et al.
2005/0045324 A1 3/2005 Cook et al.
2005/0045341 A1 3/2005 Cook et al.
2005/0045342 A1 3/2005 Luke et al.
2005/0056433 A1 3/2005 Watson et al.
2005/0056434 A1 3/2005 Ring et al.
2005/0077051 A1 4/2005 Cook et al.
2005/0081358 A1 4/2005 Cook et al.
2005/0087337 A1 4/2005 Brisco et al.
2005/0098323 A1 5/2005 Cook et al.
2005/0103502 A1 5/2005 Watson et al.
2005/0123639 A1 6/2005 Ring et al.
2005/0133225 A1 6/2005 Oosterling
2005/0138790 A1 6/2005 Cook et al.
2005/0144771 A1 7/2005 Cook et al.
2005/0144772 A1 7/2005 Cook et al.
2005/0144777 A1 7/2005 Cook et al.
2005/0150098 A1 7/2005 Cook et al.
2005/0150660 A1 7/2005 Cook et al.
2005/0161228 A1 7/2005 Cook et al.
2005/0166387 A1 8/2005 Cook et al.
2005/0166388 A1 8/2005 Cook et al.
2005/0173108 A1 8/2005 Cook et al.
2005/0175473 A1 8/2005 Cook et al.
2005/0183863 A1 8/2005 Cook et al.
2005/0205253 A1 9/2005 Cook et al.
2005/0217768 A1 10/2005 Asahi et al.
2005/0217865 A1 10/2005 Ring et al.
2005/0217866 A1 10/2005 Watson et al.
2005/0223535 A1 10/2005 Cook et al.

| | | | |
|---|---|---|---|
| 2005/0224225 | A1 | 10/2005 | Cook et al. |
| 2005/0230102 | A1 | 10/2005 | Cook et al. |
| 2005/0230103 | A1 | 10/2005 | Cook et al. |
| 2005/0230104 | A1 | 10/2005 | Cook et al. |
| 2005/0230123 | A1 | 10/2005 | Cook et al. |
| 2005/0236159 | A1 | 10/2005 | Cook et al. |
| 2005/0236163 | A1 | 10/2005 | Cook et al. |
| 2005/0244578 | A1 | 11/2005 | Van Egmond et al. |
| 2005/0246883 | A1 | 11/2005 | Alliot et al. |
| 2005/0247453 | A1 | 11/2005 | Shuster et al. |
| 2005/0265788 | A1 | 12/2005 | Renkema |
| 2005/0269107 | A1 | 12/2005 | Cook et al. |
| 2006/0032640 | A1 | 2/2006 | Costa et al. |
| 2006/0048948 | A1 | 3/2006 | Noel |
| 2006/0054330 | A1 | 3/2006 | Metcalfe et al. |
| 2006/0065403 | A1 | 3/2006 | Watson et al. |
| 2006/0065406 | A1 | 3/2006 | Shuster et al. |

FOREIGN PATENT DOCUMENTS

| | | | |
|---|---|---|---|
| AU | 770008 | | 7/2004 |
| AU | 770359 | | 7/2004 |
| AU | 771884 | | 8/2004 |
| AU | 776580 | | 1/2005 |
| AU | 780123 | | 3/2005 |
| AU | 2001269810 | | 8/2005 |
| AU | 782901 | | 9/2005 |
| AU | 783245 | | 10/2005 |
| AU | 2001294802 | | 10/2005 |
| CA | 736288 | | 6/1966 |
| CA | 771462 | | 11/1967 |
| CA | 1171310 | | 7/1984 |
| CA | 2292171 | | 6/2000 |
| CA | 2298139 | | 8/2000 |
| CA | 2234386 | | 3/2003 |
| DE | 174521 | | 4/1953 |
| DE | 2458188 | | 6/1975 |
| DE | 203767 | | 11/1983 |
| DE | 233607 | A1 | 3/1986 |
| DE | 278517 | A1 | 5/1990 |
| EP | 0084940 | A1 | 8/1983 |
| EP | 0272511 | | 12/1987 |
| EP | 0294264 | | 5/1988 |
| EP | 0553566 | A1 | 12/1992 |
| EP | 0633391 | A2 | 1/1995 |
| EP | 0713953 | B1 | 11/1995 |
| EP | 0823534 | | 2/1998 |
| EP | 0881354 | | 12/1998 |
| EP | 0881359 | | 12/1998 |
| EP | 0899420 | | 3/1999 |
| EP | 0937861 | | 8/1999 |
| EP | 0952305 | | 10/1999 |
| EP | 0952306 | | 10/1999 |
| EP | 1141515 | A | 10/2001 |
| EP | 1152120 | A2 | 11/2001 |
| EP | 1152120 | A3 | 11/2001 |
| EP | 1235972 | A | 9/2002 |
| EP | 1555386 | A1 | 7/2005 |
| FR | 1325596 | | 6/1962 |
| FR | 2583398 | A1 | 12/1986 |
| FR | 2717855 | A1 | 9/1995 |
| FR | 2741907 | A1 | 6/1997 |
| FR | 2771133 | A | 5/1999 |
| FR | 2780751 | | 1/2000 |
| FR | 2841626 | A1 | 1/2004 |
| GB | 557823 | | 12/1943 |
| GB | 851096 | | 10/1960 |
| GB | 961750 | | 6/1964 |
| GB | 1062610 | | 3/1967 |
| GB | 1111536 | | 5/1968 |
| GB | 1448304 | | 9/1976 |
| GB | 1460864 | | 1/1977 |
| GB | 1542847 | | 3/1979 |
| GB | 1563740 | | 3/1980 |
| GB | 2058877 | A | 4/1981 |
| GB | 2108228 | A | 5/1983 |
| GB | 2115860 | A | 9/1983 |
| GB | 2125876 | A | 3/1984 |
| GB | 2211573 | A | 7/1989 |
| GB | 2216926 | A | 10/1989 |
| GB | 2243191 | A | 10/1991 |
| GB | 2256910 | A | 12/1992 |
| GB | 2257184 | A | 6/1993 |
| GB | 2305682 | A | 4/1997 |
| GB | 2325949 | A | 5/1998 |
| GB | 2322655 | A | 9/1998 |
| GB | 2326896 | A | 1/1999 |
| GB | 2329916 | A | 4/1999 |
| GB | 2329918 | A | 4/1999 |
| GB | 2336383 | A | 10/1999 |
| GB | 2355738 | A | 4/2000 |
| GB | 2343691 | A | 5/2000 |
| GB | 2344606 | A | 6/2000 |
| GB | 2368865 | A | 7/2000 |
| GB | 2346165 | A | 8/2000 |
| GB | 2346632 | A | 8/2000 |
| GB | 2347445 | A | 9/2000 |
| GB | 2347446 | A | 9/2000 |
| GB | 2347950 | A | 9/2000 |
| GB | 2347952 | A | 9/2000 |
| GB | 2348223 | A | 9/2000 |
| GB | 2348657 | A | 10/2000 |
| GB | 2357099 | A | 12/2000 |
| GB | 2356651 | A | 5/2001 |
| GB | 2350137 | B | 8/2001 |
| GB | 2361724 | | 10/2001 |
| GB | 2365898 | A | 2/2002 |
| GB | 2359837 | B | 4/2002 |
| GB | 2370301 | A | 6/2002 |
| GB | 2371064 | A | 7/2002 |
| GB | 2371574 | A | 7/2002 |
| GB | 2373524 | | 9/2002 |
| GB | 2367842 | A | 10/2002 |
| GB | 2374098 | A | 10/2002 |
| GB | 2374622 | A | 10/2002 |
| GB | 2375560 | A | 11/2002 |
| GB | 2380213 | A | 4/2003 |
| GB | 2380503 | A | 4/2003 |
| GB | 2381019 | A | 4/2003 |
| GB | 2343691 | B | 5/2003 |
| GB | 2382364 | A | 5/2003 |
| GB | 2382828 | A | 6/2003 |
| GB | 2344606 | B | 8/2003 |
| GB | 2347950 | B | 8/2003 |
| GB | 2380213 | B | 8/2003 |
| GB | 2380214 | B | 8/2003 |
| GB | 2380215 | B | 8/2003 |
| GB | 2348223 | B | 9/2003 |
| GB | 2347952 | B | 10/2003 |
| GB | 2348657 | B | 10/2003 |
| GB | 2384800 | B | 10/2003 |
| GB | 2384801 | B | 10/2003 |
| GB | 2384802 | B | 10/2003 |
| GB | 2384803 | B | 10/2003 |
| GB | 2384804 | B | 10/2003 |
| GB | 2384805 | B | 10/2003 |
| GB | 2384806 | B | 10/2003 |
| GB | 2384807 | B | 10/2003 |
| GB | 2384808 | B | 10/2003 |
| GB | 2385353 | B | 10/2003 |
| GB | 2387405 | A | 10/2003 |
| GB | 2388134 | A | 11/2003 |
| GB | 2388860 | A | 11/2003 |
| GB | 2355738 | B | 12/2003 |
| GB | 2388393 | B | 12/2003 |
| GB | 2388394 | B | 12/2003 |

| | | | |
|---|---|---|---|
| GB | 2388395 | B | 12/2003 |
| GB | 2356651 | B | 2/2004 |
| GB | 2368865 | B | 2/2004 |
| GB | 2388860 | B | 2/2004 |
| GB | 2388861 | B | 2/2004 |
| GB | 2388862 | B | 2/2004 |
| GB | 2391886 | A | 2/2004 |
| GB | 2390628 | B | 3/2004 |
| GB | 2391033 | B | 3/2004 |
| GB | 2392686 | A | 3/2004 |
| GB | 2393199 | A | 3/2004 |
| GB | 2373524 | B | 4/2004 |
| GB | 2390387 | B | 4/2004 |
| GB | 2392686 | B | 4/2004 |
| GB | 2392691 | B | 4/2004 |
| GB | 2391575 | B | 5/2004 |
| GB | 2394979 | A | 5/2004 |
| GB | 2395506 | A | 5/2004 |
| GB | 2392932 | B | 6/2004 |
| GB | 2395734 | A | 6/2004 |
| GB | 2396635 | A | 6/2004 |
| GB | 2396640 | A | 6/2004 |
| GB | 2396641 | A | 6/2004 |
| GB | 2396642 | A | 6/2004 |
| GB | 2396643 | A | 6/2004 |
| GB | 2396644 | A | 6/2004 |
| GB | 2396646 | A | 6/2004 |
| GB | 2373468 | B | 7/2004 |
| GB | 2396869 | A | 7/2004 |
| GB | 2397261 | A | 7/2004 |
| GB | 2397262 | A | 7/2004 |
| GB | 2397263 | A | 7/2004 |
| GB | 2397264 | A | 7/2004 |
| GB | 2397265 | A | 7/2004 |
| GB | 2390622 | B | 8/2004 |
| GB | 2398317 | A | 8/2004 |
| GB | 2398318 | A | 8/2004 |
| GB | 2398319 | A | 8/2004 |
| GB | 2398320 | A | 8/2004 |
| GB | 2398321 | A | 8/2004 |
| GB | 2398322 | A | 8/2004 |
| GB | 2398323 | A | 8/2004 |
| GB | 2398326 | A | 8/2004 |
| GB | 2382367 | B | 9/2004 |
| GB | 2396641 | B | 9/2004 |
| GB | 2396643 | B | 9/2004 |
| GB | 2397261 | B | 9/2004 |
| GB | 2397262 | B | 9/2004 |
| GB | 2397263 | B | 9/2004 |
| GB | 2397264 | B | 9/2004 |
| GB | 2397265 | B | 9/2004 |
| GB | 2399120 | A | 9/2004 |
| GB | 2399579 | A | 9/2004 |
| GB | 2399580 | A | 9/2004 |
| GB | 2399848 | A | 9/2004 |
| GB | 2399849 | A | 9/2004 |
| GB | 2399850 | A | 9/2004 |
| GB | 2384502 | B | 10/2004 |
| GB | 2396644 | B | 10/2004 |
| GB | 2400126 | A | 10/2004 |
| GB | 2400393 | A | 10/2004 |
| GB | 2400624 | A | 10/2004 |
| GB | 2396640 | B | 11/2004 |
| GB | 2396642 | B | 11/2004 |
| GB | 2401136 | A | 11/2004 |
| GB | 2401137 | A | 11/2004 |
| GB | 2401138 | A | 11/2004 |
| GB | 2401630 | A | 11/2004 |
| GB | 2401631 | A | 11/2004 |
| GB | 2401632 | A | 11/2004 |
| GB | 2401633 | A | 11/2004 |
| GB | 2401634 | A | 11/2004 |
| GB | 2401635 | A | 11/2004 |
| GB | 2401636 | A | 11/2004 |
| GB | 2401637 | A | 11/2004 |
| GB | 2401638 | A | 11/2004 |
| GB | 2401639 | A | 11/2004 |
| GB | 2381019 | B | 12/2004 |
| GB | 2382368 | B | 12/2004 |
| GB | 2394979 | B | 12/2004 |
| GB | 2401136 | B | 12/2004 |
| GB | 2401137 | B | 12/2004 |
| GB | 2401138 | B | 12/2004 |
| GB | 2403970 | A | 1/2005 |
| GB | 2403971 | A | 1/2005 |
| GB | 2403972 | A | 1/2005 |
| GB | 2400624 | B | 2/2005 |
| GB | 2404676 | A | 2/2005 |
| GB | 2404680 | A | 2/2005 |
| GB | 2384807 | C | 3/2005 |
| GB | 2398320 | B | 3/2005 |
| GB | 2398323 | B | 3/2005 |
| GB | 2399120 | B | 3/2005 |
| GB | 2399848 | B | 3/2005 |
| GB | 2399849 | B | 3/2005 |
| GB | 2405893 | A | 3/2005 |
| GB | 2406117 | A | 3/2005 |
| GB | 2406118 | A | 3/2005 |
| GB | 2406119 | A | 3/2005 |
| GB | 2406120 | A | 3/2005 |
| GB | 2406125 | A | 3/2005 |
| GB | 2406126 | A | 3/2005 |
| GB | 2410518 | A | 3/2005 |
| GB | 2389597 | B | 5/2005 |
| GB | 2399119 | B | 5/2005 |
| GB | 2399580 | B | 5/2005 |
| GB | 2401630 | B | 5/2005 |
| GB | 2401631 | B | 5/2005 |
| GB | 2401632 | B | 5/2005 |
| GB | 2401633 | B | 5/2005 |
| GB | 2401634 | B | 5/2005 |
| GB | 2401635 | B | 5/2005 |
| GB | 2401636 | B | 5/2005 |
| GB | 2401637 | B | 5/2005 |
| GB | 2401638 | B | 5/2005 |
| GB | 2401639 | B | 5/2005 |
| GB | 2408277 | A | 5/2005 |
| GB | 2408278 | A | 5/2005 |
| GB | 2399579 | B | 6/2005 |
| GB | 2409216 | A | 6/2005 |
| GB | 2409218 | A | 6/2005 |
| GB | 2401893 | B | 7/2005 |
| GB | 2414749 | A | 7/2005 |
| GB | 2414750 | A | 7/2005 |
| GB | 2414751 | A | 7/2005 |
| GB | 2398326 | B | 8/2005 |
| GB | 2403970 | B | 8/2005 |
| GB | 2403971 | B | 8/2005 |
| GB | 2403972 | B | 8/2005 |
| GB | 2380503 | B | 10/2005 |
| GB | 2382828 | B | 10/2005 |
| GB | 2398317 | B | 10/2005 |
| GB | 2398318 | B | 10/2005 |
| GB | 2398319 | B | 10/2005 |
| GB | 2398321 | B | 10/2005 |
| GB | 2398322 | B | 10/2005 |
| GB | 2412681 | A | 10/2005 |
| GB | 2412682 | A | 10/2005 |
| GB | 2413136 | A | 10/2005 |
| GB | 2414493 | A | 11/2005 |
| GB | 2409217 | B | 12/2005 |
| GB | 2410518 | B | 12/2005 |
| GB | 2415003 | A | 12/2005 |
| GB | 2415219 | A | 12/2005 |
| GB | 2412681 | B | 1/2006 |
| GB | 2412682 | B | 1/2006 |

| | | | |
|---|---|---|---|
| GB | 2415979 | A | 1/2006 |
| GB | 2415983 | A | 1/2006 |
| GB | 2415987 | A | 1/2006 |
| GB | 2415988 | A | 1/2006 |
| GB | 2416177 | A | 1/2006 |
| GB | 2416361 | A | 1/2006 |
| GB | 2416556 | A | 2/2006 |
| GB | 2416794 | A | 2/2006 |
| GB | 2416795 | A | 2/2006 |
| GB | 2417273 | A | 2/2006 |
| GB | 2418216 | A | 3/2006 |
| GB | 2418217 | A | 3/2006 |
| ID | 044.392/2005 | | 9/2005 |
| JP | 208458 | | 10/1985 |
| JP | 6475715 | | 3/1989 |
| JP | 102875 | | 4/1995 |
| JP | 11-169975 | | 6/1999 |
| JP | 94068 | A | 4/2000 |
| JP | 107870 | A | 4/2000 |
| JP | 162192 | | 6/2000 |
| JP | 2001-47161 | | 2/2001 |
| NL | 9001081 | | 12/1991 |
| RO | 113267 | B1 | 5/1998 |
| RU | 1786241 | A1 | 1/1993 |
| RU | 1804543 | A3 | 3/1993 |
| RU | 1810482 | A1 | 4/1993 |
| RU | 1818459 | A1 | 5/1993 |
| RU | 2016345 | C1 | 7/1994 |
| RU | 2039214 | C1 | 7/1995 |
| RU | 2056201 | C1 | 3/1996 |
| RU | 2064357 | C1 | 7/1996 |
| RU | 2068940 | C1 | 11/1996 |
| RU | 2068943 | C1 | 11/1996 |
| RU | 2079633 | C1 | 5/1997 |
| RU | 2083798 | C1 | 7/1997 |
| RU | 2091655 | C1 | 9/1997 |
| RU | 2095179 | C1 | 11/1997 |
| RU | 2105128 | C1 | 2/1998 |
| RU | 2108445 | C1 | 4/1998 |
| RU | 2144128 | C1 | 1/2000 |
| SU | 350833 | | 9/1972 |
| SU | 511468 | | 9/1976 |
| SU | 607950 | | 5/1978 |
| SU | 612004 | | 5/1978 |
| SU | 620582 | | 7/1978 |
| SU | 641070 | | 1/1979 |
| SU | 909114 | | 5/1979 |
| SU | 832049 | | 5/1981 |
| SU | 853089 | | 8/1981 |
| SU | 874952 | | 10/1981 |
| SU | 894169 | | 1/1982 |
| SU | 899850 | | 1/1982 |
| SU | 907220 | | 2/1982 |
| SU | 953172 | | 8/1982 |
| SU | 959878 | | 9/1982 |
| SU | 976019 | | 11/1982 |
| SU | 976020 | | 11/1982 |
| SU | 989038 | | 1/1983 |
| SU | 1002514 | | 3/1983 |
| SU | 1041671 | A | 9/1983 |
| SU | 1051222 | A | 10/1983 |
| SU | 1086118 | A | 4/1984 |
| SU | 1077803 | A | 7/1984 |
| SU | 1158400 | A | 5/1985 |
| SU | 1212575 | A | 2/1986 |
| SU | 1250637 | A1 | 8/1986 |
| SU | 1324722 | A1 | 7/1987 |
| SU | 1411434 | | 7/1988 |
| SU | 1430498 | A1 | 10/1988 |
| SU | 1432190 | A1 | 10/1988 |
| SU | 1601330 | A1 | 10/1990 |
| SU | 1627663 | A2 | 2/1991 |
| SU | 1659621 | A1 | 6/1991 |
| SU | 1663179 | A2 | 7/1991 |
| SU | 1663180 | A1 | 7/1991 |
| SU | 1677225 | A1 | 9/1991 |
| SU | 1677248 | A1 | 9/1991 |
| SU | 1686123 | A1 | 10/1991 |
| SU | 1686124 | A1 | 10/1991 |
| SU | 1686125 | A1 | 10/1991 |
| SU | 1698413 | A1 | 12/1991 |
| SU | 1710694 | A | 2/1992 |
| SU | 1730429 | A1 | 4/1992 |
| SU | 1745873 | A1 | 7/1992 |
| SU | 1747673 | A1 | 7/1992 |
| SU | 1749267 | A1 | 7/1992 |
| SU | 1295799 | A1 | 2/1995 |
| WO | WO81/00132 | | 1/1981 |
| WO | WO90/05598 | | 3/1990 |
| WO | WO92/01859 | | 2/1992 |
| WO | WO92/08875 | | 5/1992 |
| WO | WO93/25799 | | 12/1993 |
| WO | WO93/25800 | | 12/1993 |
| WO | WO94/21887 | | 9/1994 |
| WO | WO94/25655 | | 11/1994 |
| WO | WO95/03476 | | 2/1995 |
| WO | WO96/01937 | | 1/1996 |
| WO | WO96/21083 | | 7/1996 |
| WO | WO96/26350 | | 8/1996 |
| WO | WO96/37681 | | 11/1996 |
| WO | WO97/06346 | | 2/1997 |
| WO | WO97/11306 | | 3/1997 |
| WO | WO97/17524 | | 5/1997 |
| WO | WO97/17526 | | 5/1997 |
| WO | WO97/17527 | | 5/1997 |
| WO | WO97/20130 | | 6/1997 |
| WO | WO97/21901 | | 6/1997 |
| WO | WO97/35084 | | 9/1997 |
| WO | WO98/00626 | | 1/1998 |
| WO | WO98/07957 | | 2/1998 |
| WO | WO98/09053 | | 3/1998 |
| WO | WO98/22690 | | 5/1998 |
| WO | WO98/26152 | | 6/1998 |
| WO | WO98/42947 | | 10/1998 |
| WO | WO98/49423 | | 11/1998 |
| WO | WO99/02818 | | 1/1999 |
| WO | WO99/04135 | | 1/1999 |
| WO | WO99/06670 | | 2/1999 |
| WO | WO99/08827 | | 2/1999 |
| WO | WO99/08828 | | 2/1999 |
| WO | WO99/18328 | | 4/1999 |
| WO | WO99/23354 | | 5/1999 |
| WO | WO99/25524 | | 5/1999 |
| WO | WO99/25951 | | 5/1999 |
| WO | WO99/35368 | | 7/1999 |
| WO | WO99/43923 | | 9/1999 |
| WO | WO00/01926 | | 1/2000 |
| WO | WO00/04271 | | 1/2000 |
| WO | WO00/08301 | | 2/2000 |
| WO | WO00/26500 | | 5/2000 |
| WO | WO00/26501 | | 5/2000 |
| WO | WO00/26502 | | 5/2000 |
| WO | WO00/31375 | | 6/2000 |
| WO | WO00/37766 | | 6/2000 |
| WO | WO00/37767 | | 6/2000 |
| WO | WO00/37768 | | 6/2000 |
| WO | WO00/37771 | | 6/2000 |
| WO | WO00/37772 | | 6/2000 |
| WO | WO00/39432 | | 7/2000 |
| WO | WO00/46484 | | 8/2000 |
| WO | WO00/50727 | | 8/2000 |
| WO | WO00/50732 | | 8/2000 |
| WO | WO00/50733 | | 8/2000 |
| WO | WO00/77431 | A2 | 12/2000 |
| WO | WO01/04520 | A1 | 1/2001 |
| WO | WO01/04535 | A1 | 1/2001 |

| | | | |
|---|---|---|---|
| WO | WO01/18354 | A1 | 3/2001 |
| WO | WO01/21929 | A1 | 3/2001 |
| WO | WO01/26860 | A1 | 4/2001 |
| WO | WO01/33037 | A1 | 5/2001 |
| WO | WO01/38693 | A1 | 5/2001 |
| WO | WO01/60545 | A1 | 8/2001 |
| WO | WO01/83943 | A1 | 11/2001 |
| WO | WO01/98623 | A1 | 12/2001 |
| WO | WO02/01102 | A1 | 1/2002 |
| WO | WO02/10550 | A1 | 2/2002 |
| WO | WO02/10551 | A1 | 2/2002 |
| WO | WO 02/20941 | A1 | 3/2002 |
| WO | WO02/23007 | A1 | 3/2002 |
| WO | WO02/25059 | A1 | 3/2002 |
| WO | WO02/29199 | A1 | 4/2002 |
| WO | WO02/40825 | A1 | 5/2002 |
| WO | WO02/095181 | A1 | 5/2002 |
| WO | WO02/053867 | A2 | 7/2002 |
| WO | WO02/053867 | A3 | 7/2002 |
| WO | WO02/059456 | A1 | 8/2002 |
| WO | WO02/066783 | A1 | 8/2002 |
| WO | WO02/068792 | A1 | 9/2002 |
| WO | WO02/073000 | A1 | 9/2002 |
| WO | WO02/075107 | A1 | 9/2002 |
| WO | WO02/077411 | A1 | 10/2002 |
| WO | WO02/081863 | A1 | 10/2002 |
| WO | WO02/081864 | A2 | 10/2002 |
| WO | WO02/086285 | A1 | 10/2002 |
| WO | WO02/086286 | A2 | 10/2002 |
| WO | WO02/090713 | | 11/2002 |
| WO | WO02/103150 | A2 | 12/2002 |
| WO | WO03/004819 | A2 | 1/2003 |
| WO | WO03/004819 | A3 | 1/2003 |
| WO | WO03/004820 | A2 | 1/2003 |
| WO | WO03/04820 | A3 | 1/2003 |
| WO | WO03/008756 | A1 | 1/2003 |
| WO | WO03/012255 | A1 | 2/2003 |
| WO | WO03/016669 | A2 | 2/2003 |
| WO | WO03/016669 | A3 | 2/2003 |
| WO | WO03/023178 | A2 | 3/2003 |
| WO | WO03/023178 | A3 | 3/2003 |
| WO | WO03/023179 | A2 | 3/2003 |
| WO | WO03/023179 | A3 | 3/2003 |
| WO | WO03/029607 | A1 | 4/2003 |
| WO | WO03/029608 | A1 | 4/2003 |
| WO | WO03/036018 | A2 | 5/2003 |
| WO | WO03/042486 | A2 | 5/2003 |
| WO | WO03/042486 | A3 | 5/2003 |
| WO | WO03/042487 | A2 | 5/2003 |
| WO | WO03/042489 | A2 | 5/2003 |
| WO | WO03/048520 | A1 | 6/2003 |
| WO | WO03/048521 | A2 | 6/2003 |
| WO | WO03/055616 | A2 | 7/2003 |
| WO | WO03/058022 | A2 | 7/2003 |
| WO | WO03/058022 | A3 | 7/2003 |
| WO | WO03/059549 | A1 | 7/2003 |
| WO | WO03/064813 | A1 | 8/2003 |
| WO | WO03/069115 | A3 | 8/2003 |
| WO | WO03/071086 | A2 | 8/2003 |
| WO | WO03/071086 | A3 | 8/2003 |
| WO | WO03/078785 | A2 | 9/2003 |
| WO | WO03/078785 | A3 | 9/2003 |
| WO | WO03/086675 | A2 | 10/2003 |
| WO | WO03/086675 | A3 | 10/2003 |
| WO | WO03/089161 | A2 | 10/2003 |
| WO | WO03/089161 | A3 | 10/2003 |
| WO | WO03/093623 | A2 | 11/2003 |
| WO | WO03/093623 | A3 | 11/2003 |
| WO | WO03/102365 | A1 | 12/2003 |
| WO | WO03/104601 | A2 | 12/2003 |
| WO | WO03/104601 | A3 | 12/2003 |
| WO | WO03/106130 | A2 | 12/2003 |
| WO | WO03/106130 | A3 | 12/2003 |
| WO | WO2004/003337 | A1 | 1/2004 |
| WO | WO2004/009950 | A1 | 1/2004 |
| WO | WO2004/010039 | A2 | 1/2004 |
| WO | WO2004/010039 | A3 | 1/2004 |
| WO | WO2004/011776 | A2 | 2/2004 |
| WO | WO2004/011776 | A3 | 2/2004 |
| WO | WO2004/018823 | A2 | 3/2004 |
| WO | WO2004/018823 | A3 | 3/2004 |
| WO | WO2004/018824 | A2 | 3/2004 |
| WO | WO2004/018824 | A3 | 3/2004 |
| WO | WO2004/020895 | A2 | 3/2004 |
| WO | WO2004/020895 | A3 | 3/2004 |
| WO | WO2004/023014 | A2 | 3/2004 |
| WO | WO2004/023014 | A3 | 3/2004 |
| WO | WO2004/026017 | A2 | 4/2004 |
| WO | WO2004/026017 | A3 | 4/2004 |
| WO | WO2004/026073 | A2 | 4/2004 |
| WO | WO2004/026073 | A3 | 4/2004 |
| WO | WO2004/026500 | A2 | 4/2004 |
| WO | WO2004/026500 | A3 | 4/2004 |
| WO | WO2004/027200 | A2 | 4/2004 |
| WO | WO2004/027200 | A3 | 4/2004 |
| WO | WO2004/027204 | A2 | 4/2004 |
| WO | WO2004/027204 | A3 | 4/2004 |
| WO | WO2004/027205 | A2 | 4/2004 |
| WO | WO2004/027205 | A3 | 4/2004 |
| WO | WO2004/027392 | A1 | 4/2004 |
| WO | WO2004/027786 | A2 | 4/2004 |
| WO | WO2004/027786 | A3 | 4/2004 |
| WO | WO2004/053434 | A2 | 6/2004 |
| WO | WO2004/053434 | A3 | 6/2004 |
| WO | WO2004/057715 | A2 | 7/2004 |
| WO | WO2004/057715 | A3 | 7/2004 |
| WO | WO2004/067961 | A2 | 8/2004 |
| WO | WO2004/067961 | A3 | 8/2004 |
| WO | WO2004/072436 | A1 | 8/2004 |
| WO | WO2004/074622 | A2 | 9/2004 |
| WO | WO2004/074622 | A3 | 9/2004 |
| WO | WO2004/076798 | A2 | 9/2004 |
| WO | WO2004/076798 | A3 | 9/2004 |
| WO | WO2004/081346 | A2 | 9/2004 |
| WO | WO2004/083591 | A2 | 9/2004 |
| WO | WO2004/083591 | A3 | 9/2004 |
| WO | WO2004/083592 | A2 | 9/2004 |
| WO | WO2004/083592 | A3 | 9/2004 |
| WO | WO2004/083593 | A2 | 9/2004 |
| WO | WO2004/083594 | A2 | 9/2004 |
| WO | WO2004/083594 | A3 | 9/2004 |
| WO | WO2004/085790 | A2 | 10/2004 |
| WO | WO2004/089608 | A2 | 10/2004 |
| WO | WO2004/092527 | A2 | 10/2004 |
| WO | WO2004/092528 | A2 | 10/2004 |
| WO | WO2004/092528 | A3 | 10/2004 |
| WO | WO2004/092530 | A2 | 10/2004 |
| WO | WO2004/092530 | A3 | 10/2004 |
| WO | WO2004/094766 | A2 | 11/2004 |
| WO | WO2004/094766 | A3 | 11/2004 |
| WO | WO2005/017303 | A2 | 2/2005 |
| WO | WO2005/021921 | A2 | 3/2005 |
| WO | WO2005/021921 | A3 | 3/2005 |
| WO | WO2005/021922 | A2 | 3/2005 |
| WO | WO2005/021922 | A3 | 3/2005 |
| WO | WO2005/024170 | A2 | 3/2005 |
| WO | WO2005/024170 | A3 | 3/2005 |
| WO | WO2005/024171 | A2 | 3/2005 |
| WO | WO2005/028803 | A2 | 3/2005 |
| WO | WO2005/071212 | A1 | 4/2005 |
| WO | WO2005/079186 | A2 | 9/2005 |
| WO | WO2005/079186 | A3 | 9/2005 |
| WO | WO2005/081803 | A2 | 9/2005 |
| WO | WO2005/086614 | A2 | 9/2005 |
| WO | WO2006/014333 | A2 | 2/2006 |
| WO | WO2006/020723 | A2 | 2/2006 |

| | | | |
|---|---|---|---|
| WO | WO2006/020726 | A2 | 2/2006 |
| WO | WO2006/020734 | A2 | 2/2006 |
| WO | WO2006/020809 | A2 | 2/2006 |
| WO | WO2006/020810 | A2 | 2/2006 |
| WO | WO2006/020827 | A2 | 2/2006 |
| WO | WO2006/020913 | A2 | 2/2006 |
| WO | WO2006/020960 | A2 | 2/2006 |
| WO | WO2006/033720 | A2 | 3/2006 |

OTHER PUBLICATIONS

Turcotte and Schubert, Geodynamics (1982) John Wiley & Sons, Inc., pp. 9,432.
Baker Hughes Incorporated, "EXPatch Expandable Cladding System" (2002).
Baker Hughes Incorporated, "EXPress Expandable Screen System".
High-Tech Wells, "World's First Completion Set Inside Expandable Screen" (2003) Gilmer, J.M., Emerson, A.B.
Baker Hughes Incorporated, "Technical Overview Production Enhancement Technology" (Mar. 10, 2003) Geir Owe Egge.
Baker Hughes Incorporated, "FORMlock Expandable Liner Hangers".
Weatherford Completion Systems, "Expandable Sand Screens" (2002).
Expandable Tubular Technology, "EIS Expandable Isolation Sleeve" (Feb. 2003).
Oilfield Catalog; "Jet-Lok Product Application Description" (Aug. 8, 2003).
Power Ultrasonics, "Design and Optimisation of an Ultrasonic Die System For Form" Chris Cheers (1999, 2000).
Research Area—Sheet Metal Forming—Superposition of Vibra; Fraunhofer IWU (2001).
Research Projects;"Analysis of Metal Sheet Formability and It's Factors of Influence" Prof. Dorel Banabic (2003).
www.materialsresources.com, "Low Temperature Bonding of Dissimilar and Hard-to-Bond Materials and Metal-Including."(2004).
www.tribtech.com. "Trib-gel A Chemical Cold Welding Agnet" G R Linzell (Sep. 14, 1999).
www.spurind.com, "Galvanic Protection, Metallurgical Bonds, Custom Fabrication—Spur Industries" (2000).
Lubrication Engineering, "Effect of Micro-Surface Texturing on Breakaway Torque and Blister Formation on Carbon-Graphite Faces in a Mechanical Seal" Philip Guichelaar, Karalyn Folkert, Izhak Etsion, Steven Pride (Aug. 2002).
Surface Technologies Inc., "Imporving Tribological Performance of Mechanical Seals by Laser Surface Texturing" Izhak Etsion.
Tribology Transactions "Experimental Investigation of Laser Surface Texturing for Reciprocating Automotive Components" G Ryk, Y Klingerman and I Etsion (2002).
Proceeding of the International Tribology Conference, "Microtexturing of Functional Surfaces for Improving Their Tribological Performance" Henry Haefke, Yvonne Gerbig, Gabriel Dumitru and Valerio Romano (2002).
Sealing Technology, "A laser surface textured hydrostatic mechanical seal" Izhak Etsion and Gregory Halperin (Mar. 2003).
Metalforming Online, "Advanced Laser Texturing Tames Tough Tasks" Harvey Arbuckle.
Tribology Transactions, "A Laser Surface Textured Parallel Thrust Bearing" V. Brizmer, Y. Klingerman and I. Etsion (Mar. 2003).
PT Design, "Scratching the Surface" Todd E. Lizotte (Jun. 1999).
Tribology Transactions, "Friction-Reducing Surface-Texturing in Reciprocating Automotive Components" Aviram Ronen, and Izhak Etsion (2001).
Michigan Metrology "3D Surface Finish Roughness Texutre Wear WYKO Veeco" C.A. Brown, PHD; Charles, W.A. Johnsen, S. Chester.
International Search Report, Application PCT/US01/04753, Jul. 3, 2001.
International Search Report, Application PCT/IL00/00245, Sep. 18, 2000.
International Search Report, Application PCT/US00/18635, Nov. 24, 2000.
International Search Report, Application PCT/US00/30022, Mar. 27, 2001.
International Search Report, Application PCT/US00/27645, Dec. 29, 2000.
International Search Report, Application PCT/US01/19014, Nov. 23, 2001.
International Search Report, Application PCT/US01/41446, Oct. 30, 2001.
International Search Report, Application PCT/US01/23815, Nov. 16, 2001.
International Search Report, Application PCT/US01/28960, Jan. 22, 2002.
International Search Report, Application PCT/US01/30256, Jan. 3, 2002.
International Search Report, Application PCT/US02/04353, Jun. 24, 2002.
International Search Report, Application PCT/US02/00677, Jul. 17, 2002.
International Search Report, Application PCT/US02/00093, Aug. 6, 2002.
International Search Report, Application PCT/US02/29856, Dec. 16, 2002.
International Search Report, Application PCT/US02/20256, Jan. 3, 2003.
International Search Report, Application PCT/US02/39418, Mar. 24, 2003.
International Search Report, Application PCT/US03/15020; Jul. 30, 2003.
International Search Report, Application PCT/US02/36157; Sep. 29, 2003.
International Search Report, Application PCT/US02/20477; Oct. 31, 2003.
International Search Report, Application PCT/US03/10144; Oct. 31, 2003.
International Search Report, Application PCT/US03/20694; Nov. 12, 2003.
International Search Report, Application PCT/US03/11765; Nov. 13, 2003.
International Search Report, Application PCT/US02/25727; Feb. 19, 2004.
International Search Report, Application PCT/US03/25667; Feb. 26, 2004.
International Search Report, Application PCT/US02/24399; Feb. 27, 2004.
International Search Report, Application PCT/US03/24779; Mar. 3, 2004.
Search Report to Application No. GB 9926450.9, Feb. 28, 2000.
Search Report to Application No. GB 9926449.1, Mar. 27, 2000.
Search Report to Application No. GB 9930398.4, Jun. 27, 2000.
Search Report to Application No. GB 0004285.3, Jul. 12, 2000.
Search Report to Application No. GB 0003251.6, Jul. 13, 2000.
Examination Report to Application No. GB 0005399.1; Jul. 24, 2000.
Search Report to Application No. GB 0004282.0, Jul. 31, 2000.
Search Report to Application No. GB 0013661.4, Oct. 20, 2000.
Search Report to Application No. GB 0004282.0 Jan. 15, 2001.
Search Report to Application No. GB 0004285.3, Jan. 17, 2001.
Search Report to Application No. GB 0005399.1, Feb. 15, 2001.
Search Report to Application No. GB 0013661.4, Apr. 17, 2001.
Examination Report to Application No. GB 9926450.9, May 15, 2002.
Search Report to Application No. GB 9926449.1, Jul. 4, 2001.
Search Report to Application No. GB 9926449.1, Sep. 5, 2001.
Search Report to Application No. 1999 5593, Aug. 20, 2002.
Search Report to Application No. GB 0004285.3, Aug. 28, 2002.
Examination Report to Application No. GB 0005399.1; Oct. 14, 2002.
Examination Report to Application No. GB 9926450.9, Nov. 22, 2002.
Search Report to Application No. GB 0219757.2, Nov. 25, 2002.
Search Report to Application No. GB 0220872.6, Dec. 5, 2002.
Search Report to Application No. GB 0219757.2, Jan. 20, 2003.
Search Report to Application No. GB 0013661.4, Feb. 19, 2003.

Search Report to Application No. GB 0225505.7, Mar. 5, 2003.
Search Report to Application No. GB 0220872.6, Mar. 13, 2003.
Examination Report to Application No. 0004285.3, Mar. 28, 2003.
Examination Report to Application No. GB 0208367.3, Apr. 4, 2003.
Examination Report to Application No. GB 0212443.6, Apr. 10, 2003.
Search and Examination Report to Application No. GB 0308296.3, Jun. 2, 2003.
Search and Examination Report to Application No. GB 0308297.1, Jun. 2, 2003.
Search and Examination Report to Application No. GB 0308295.5, Jun. 2, 2003.
Search and Examination Report to Application No. GB 0308293.0, Jun. 2, 2003.
Search and Examination Report to Application No. GB 0308294.8, Jun. 2, 2003.
Search and Examination Report to Application No. GB 0308303.7, Jun. 2, 2003.
Search and Examination Report to Application No. GB 0308290.6, Jun. 2, 2003.
Search and Examination Report to Application No. GB 0308299.7, Jun. 2, 2003.
Search and Examination Report to Application No. GB 0308302.9, Jun. 2, 2003.
Search and Examination Report to Application No. GB 0004282.0, Jun. 3, 2003.
Search and Examination Report to Application No. GB 0310757.0, Jun. 12, 2003.
Search and Examination Report to Application No. GB 0310836.2, Jun. 12, 2003.
Search and Examination Report to Application No. GB 0310785.1, Jun. 12, 2003.
Search and Examination Report to Application No. GB 0310759.6, Jun. 12, 2003.
Search and Examination Report to Application No. GB 0310801.6, Jun. 12, 2003.
Search and Examination Report to Application No. GB 0310772.9, Jun. 12, 2003.
Search and Examination Report to Application No. GB 0310795.0, Jun. 12, 2003.
Search and Examination Report to Application No. GB 0310833.9, Jun. 12, 2003.
Search and Examination Report to Application No. GB 0310799.2, Jun. 12, 2003.
Search and Examination Report to Application No. GB 0310797.6, Jun. 12, 2003.
Search and Examination Report to Application No. GB 0310770.3, Jun. 12, 2003.
Search and Examination Report to Application No. GB 0310099.7, Jun. 24, 2003.
Search and Examination Report to Application No. GB 0310104.5, Jun. 24, 2003.
Search and Examination Report to Application No. GB 0310101.1, Jun. 24, 2003.
Search and Examination Report to Application No. GB 0310118.5, Jun. 24, 2003.
Search and Examination Report to Application No. GB 0310090.6, Jun. 24, 2003.
Search and Examination Report to Application No. GB 0225505.7, Jul. 1, 2003.
Examination Report to Application No. GB 0310836.2, Aug. 7, 2003.
Search and Examination Report to Application No. GB 0316883.8, Aug. 14, 2003.
Search and Examination Report to Application No. GB 0316886.1, Aug. 14, 2003.
Search and Examination Report to Application No. GB 0316887.9, Aug. 14, 2003.
Search and Examination Report to Application No. GB 0318547.4; Sep. 3, 2003.
Search and Examination Report to Application No. GB 0318549.3; Sep. 3, 2003.
Search and Examination Report to Application No. GB 0318545.1, Sep. 3, 2003.
Search and Examination Report to Application No. GB 0318550.1, Sep. 3, 2003.
Search and Examination Report to Application No. GB 0313406.1, Sep. 3, 2003.
Search and Examination Report to Application No. GB 0324174.2, Nov. 4, 2003.
Search and Examination Report to Application No. GB 0324172.6, Nov. 4, 2003.
Examination Report to Application No. GB 0208367.3, Nov. 4, 2004.
Examination Report to Application No. GB 0208367.3, Nov. 17, 2003.
Search and Examination Report to Application No. GB 0325071.9, Nov. 18, 2003.
Examination Report to Application No. GB 0316886.1, Nov. 25, 2003.
Examination Report to Application No. GB 0316887.9 Nov. 25, 2003.
Examination Report to Application No. GB 0013661.4, Nov. 25, 2003.
Examination Report to Application No. GB 0316883.8, Nov. 25, 2003.
Examination Report to Application No. GB 0300085.8, Nov. 28, 2003.
Examination Report to Application No. GB 030086.6, Dec. 1, 2003.
Search and Examination Report to Application No. GB 0325072.7; Dec. 3, 2003.
Search and Examination Report to Application No. GB 0320579.6, Dec. 16, 2003.
Search and Examination Report to Application No. GB 0320580.4, Dec. 17, 2003.
Search and Examination Report to Application No. GB 0323891.2, Dec. 19, 2003.
Examination Report to Application No. GB 0208367.3, Jan. 30, 2004.
Examination Report to Application No. GB 0325072.7, Feb. 5, 2004.
Examination Report to Application No. GB 0216409.3, Feb. 9, 2004.
International Search Report, Application PCT/US02/00677, Feb. 24, 2004.
International Search Report, Application PCT/US02/36157; Apr. 14, 2004.
International Search Report, Application PCT/US02/36267; May 21, 2004.
International Search Report, Application PCT/US03/00609, May 20, 2004.
International Search Report, Application PCT/US03/04837, May 28, 2004.
International Search Report, Application PCT/US03/06544, Jun. 9, 2004.
Examination Report, Application PCT/US03/10144; Jul. 7, 2004.
International Search Report, Application PCT/US03/13787; May 28, 2004.
International Search Report, Application PCT/US03/14153; May 28, 2004.
International Search Report, Application PCT/US03/18530; Jun. 24, 2004.
International Search Report, Application PCT/US03/19993; May 24, 2004.
International Search Report, Application PCT/US03/20870; May 24, 2004.
International Search Report, Application PCT/US03/25675; May 25, 2004.
International Search Report, Application PCT/US03/25676; May 17, 2004.
International Examination Report, Application PCT/US03/25676, Aug. 17, 2004.
International Search Report, Application PCT/US03/25677; May 21, 2004.

International Examination Report, Application PCT/US03/25677, Aug. 17, 2004.
International Search Report, Application PCT/US03/25707; Jun. 23, 2004.
International Search Report, Application PCT/US03/25715; Apr. 9, 2004.
International Search Report, Application PCT/US03/25742; May 27, 2004.
International Search Report, Application PCT/US03/29460; May 25, 2004.
International Search Report, Application PCT/US03/29858; Jun. 30, 2003.
International Search Report, Application PCT/US03/29859; May 21, 2004.
International Examination Report, Application PCT/US03/29859, Aug. 16, 2004.
International Search Report, Application PCT/US03/38550; Jun. 15, 2004.
Examination Report to Application No. GB 0314846.7, Jul. 15, 2004.
Search and Examination Report to Application No. GB 0308293.0, Jul. 14, 2003.
Search and Examination Report to Application No. GB 0308294.8, Jul. 14, 2003.
Search and Examination Report to Application No. GB 0308295.5, Jul. 14, 2003.
Search and Examination Report to Application No. GB 0308296.3, Jul. 14, 2003.
Search and Examination Report to Application No. GB 0308297.1, Jul. 2003.
Search and Examination Report to Application No. GB 0308299.7, Jun. 14, 2003.
Search and Examination Report to Application No. GB 0308303.7, Jul. 14, 2003.
Examination Report to Application No. GB 0325071.9, Feb. 2, 2004.
Examination Report to Application No. GB 0325072.7; Apr. 13, 2004.
Search and Examination Report to Application No. GB 0403891.5, Jun. 9, 2004.
Search and Examination Report to Application No. GB 0403893.1, Jun. 9, 2004.
Search and Examination Report to Application No. GB 0403894.9, Jun. 9, 2004.
Search and Examination Report to Application No. GB 0403897.2, Jun. 9, 2004.
Search and Examination Report to Application No. GB 0403920.2, Jun. 10, 2004.
Search and Examination Report to Application No. GB 0403921.0, Jun. 10, 2004.
Search and Examination Report to Application No. GB 0403926.9, Jun. 10, 2004.
Examination Report to Application No. GB 0404796.5; May 20, 2004.
Search and Examination Report to Application No. GB 0404826.0, Apr. 21, 2004.
Search and Examination Report to Application No. GB 0404828.6, Apr. 21, 2004.
Search and Examination Report to Application No. GB 0404830.2, Apr. 21, 2004.
Search and Examination Report to Application No. GB 0404832.8, Apr. 21, 2004.
Search and Examination Report to Application No. GB 0404833.6, Apr. 21, 2004.
Search and Examination Report to Application No. GB 0404833.6, Aug. 19, 2004.
Search and Examination Report to Application No. GB 0404837.7, May 17, 2004.
Examination Report to Application No. GB 0404837.7, Jul. 12, 2004.
Search and Examination Report to Application No. GB 0404839.3, May 14, 2004.
Search and Examination Report to Application No. GB 0404842.7, May 14, 2004.
Search and Examination Report to Application No. GB 0404845.0, May 14, 2004.
Search and Examination Report to Application No. GB 0404849.2, May 17, 2004.
Examination Report to Application No. GB 0406257.6, Jun. 28, 2004.
Examination Report to Application No. GB 0406258.4, May 20, 2004.
Examination Report to Application No. GB 0408672.4, Jul. 12, 2004.
Search and Examination Report to Application No. GB 0411698.4, Jun. 30, 2004.
Search and Examination Report to Application No. GB 0411892.3, Jul. 14, 2004.
Search and Examination Report to Application No. GB 0411893.3, Jul. 14, 2004.
Search and Examination Report to Application No. GB 0411894.9, Jun. 30, 2004.
Search and Examination Report to Application No. GB 0412190.1, Jul. 22, 2004.
Search and Examination Report to Application No. GB 0412191.9, Jul. 22, 2004.
Search and Examination Report to Application No. GB 0412192.7, Jul. 22, 2004.
Search and Examination Report to Application No. GB 0416834.0, Aug. 11, 2004.
Search and Examination Report to Application No. GB 0417810.9, Aug. 25, 2004.
Search and Examination Report to Application No. GB 0417811.7, Aug. 25, 2004.
Search and Examination Report to Application No. GB 0418005.5, Aug. 25, 2004.
Search Report to Application No. Norway 1999 5593, Aug. 20, 2002.
Written Opinion to Application No. PCT/US01/19014; Dec. 10, 2002.
Written Opinion to Application No. PCT/US01/23815; Jul. 25, 2002.
Written Opinion to Application No. PCT/US01/28960; Dec. 2, 2002.
Written Opinion to Application No. PCT/US01/30256; Nov. 11, 2002.
Written Opinion to Application No. PCT/US02/00093; Apr. 21, 2003.
Written Opinion to Application No. PCT/US02/00677; Apr. 17, 2003.
Written Opinion to Application No. PCT/US02/04353; Apr. 11, 2003.
Written Opinion to Application No. PCT/US02/20256; May 9, 2003.
Written Opinion to Application No. PCT/US02/24399; Apr. 28, 2004.
Written Opinion to Application No. PCT/US02/25608 Sep. 13, 2004.
Written Opinion to Application No. PCT/US02/25727; May 17, 2004.
Written Opinion to Application No. PCT/US02/39418; Jun. 9, 2004.
Written Opinion to Application No. PCT/US03/11765 May 11, 2004.
Written Opinion to Application No. PCT/US03/14153 Sep. 9, 2004.
Written Opinion to Application No. PCT/US03/18530 Sep. 13, 2004.
International Examination Report, Application PCT/US02/36267, Jan. 4, 2004.
International Examination Report, Application PCT/US02/39418, Feb. 18, 2005.
International Examination Report, Application PCT/US03/04837, Dec. 9, 2004.
International Examination Report, Application PCT/US03/11765; Dec. 10, 2004.

International Examination Report, Application PCT/US03/11765;; Jan. 25, 2005.
International Search Report, Application PCT/US03/25742; Dec. 20, 2004.
International Examination Report, Application PCT/US03/29460; Dec. 8, 2004.
Examination Report to Application GB 0220872.6, Oct. 29, 2004.
Examination Report to Application No. GB 0225505.7, Oct. 27, 2004.
Examination Report to Application No. GB 0225505.7 Feb. 15, 2005.
Examination Report to Application No. GB 0306046.4, Sep. 10, 2004.
Examination Report to Application No. GB 0400018.8; Oct. 29, 2004.
Examination Report to Application No. GB 0400019.6; Oct. 29, 2004.
Examination Report to Application No. GB 0406257.6, Jan. 25, 2005.
Examination Report to Application No. GB 0406258.4; Jan. 12, 2005.
Examination Report to Application No. GB 0411698.4, Jan. 24, 2005.
Search Report to Application No. GB 0415835.8, Dec. 2, 2004.
Examination Report to Application No. 0416625.2 Jan. 20, 2005.
Search and Examination Report to Application No. GB 0416834.0, Nov. 16, 2004.
Search and Examination Report to Application No. GB 0417810.9, Aug. 25, 2004.
Search and Examination Report to Application No. GB 0417811.7, Aug. 25, 2004.
Search and Examination Report to Application No. GB 0418005.5, Aug. 25, 2004.
Search and Examination Report to Application No. GB 0418425.5, Sep. 10, 2004.
Search and Examination Report to Application No. GB 0418426.3 Sep. 10, 2004.
Search and Examination Report to Application No. GB 0418427.1 Sep. 10, 2004.
Search and Examination Report to Application No. GB 0418429.7 Sep. 10, 2004.
Search and Examination Report to Application No. GB 0418430.5 Sep. 10, 2004.
Search and Examination Report to Application No. GB 0418431.3 Sep. 10, 2004.
Search and Examination Report to Application No. GB 0418432.1 Sep. 10, 2004.
Search and Examination Report to Application No. GB 0418433.9 Sep. 10, 2004.
Search and Examination Report to Application No. GB 0418439.6 Sep. 10, 2004.
Search and Examination Report to Application No. GB 0418442.0 Sep. 10, 2004.
Examination Report to Application No. GB 0422419.2 Dec. 8, 2004.
Search and Examination Report to Application No. GB 0422893.8 Nov. 24, 2004.
Search and Examination Report to Application No. GB 0423416.7 Nov. 12, 2004.
Search and Examination Report to Application No. GB 0423417.5 Nov. 12, 2004.
Search and Examination Report to Application No. GB 0423418.3 Nov. 12, 2004.
Written Opinion to Application No. PCT/US02/25608 Feb. 2, 2005.
Written Opinion to Application No. PCT/US02/25675 Nov. 24, 2004.
Written Opinion to Application No. PCT/US02/39425; Nov. 22, 2004.
Written Opinion to Application No. PCT/US03/06544; Feb. 18, 2005.
Written Opinion to Application No. PCT/US03/13787 Nov. 9, 2004.
Written Opinion to Application No. PCT/US03/14153 Nov. 9, 2004.
Written Opinion to Application No. PCT/US03/19993 Oct. 15, 2004.
Written Opinion to Application No. PCT/US03/29858 Jan. 21, 2004.
Written Opinion to Application No. PCT/US03/38550 Dec. 10, 2004.
Combined Search Report and Written Opinion to Application No. PCT/US04/04740 Jan. 19, 2005.
Combined Search Report and Written Opinion to Application No. PCT/US04/06246 Jan. 26, 2005.
Combined Search Report and Written Opinion to Application No. PCT/US04/08030 Jan. 6, 2005.
Combined Search Report and Written Opinion to Application No. PCT/US04/08170 Jan. 13, 2005.
Combined Search Report and Written Opinion to Application No. PCT/US04/08171 Feb. 16, 2005.
Combined Search Report and Written Opinion to Application No. PCT/US04/11172 Feb. 14, 2005.
Blasingame et al., "Solid Expandable Tubular Technology in Mature Basins," *Society of Petroleum Engineers* 2003.
Brass et al., "Water Production Management—PDO's Successful Application of Expandable Technology," *Society of Petroleum Engineers*, 2002.
Brock et al., "An Expanded Horizon," Hart's E&P, Feb. 2000.
Buckler et al., "Expandable Cased-hole Liner Remediates Prolific Gas Well and Minimizes Loss of Production," *Offshore Technology Conference*, 15151.
Bullock, "Advances Grow Expandable Applications," *The American Oil& Gas Reporter*, Sep. 2004.
Cales, "The Development and Applications of Solid Expandable Tubular Technology," *Enventure Global Technology*, Paper 2003-136, 2003.
Cales et al., "Reducing Non-Productive Time Through the Use of Solid Expandable Tubulars: How to Beat the Curve Through Pre-Planning," *Offshore Technology Conference*, 16669, 2004.
Cales et al., "Subsidence Remediation—Extending Well Life Through the Use of Solid Expandable Casing Systems," *AADE Houston Chapter*, Mar. 27, 2001.
Campo et al., "Case Histories—Drilling and Recompletion Applications Using Solid Expandable Tubular Technology," *Society of Petroleum Engineers*, SPE/IADC 72304, 2002.
Carstens et al., "Solid Expandable Tubular Technology: The Value of Planned Installations vs. Contingency,".
Case History, "Eemskanaal -2Groningen," Enventure Global Technology, Feb. 2002.
Case History, "Graham Ranch No. 1 Newark East Barnett Field" Enventure Global Technology, Feb. 2002.
Case History, "K.K. Camel No. 1 Ridge Field Lafayette Parish, Louisiana," Enventure Global Technology, Feb. 2002.
Case History, "Mississippi Canyon 809 URSA TLP, OSC-G 5868, No. A-12," Enventure Global Technology, Mar. 2004.
Case History, "Unocal Sequoia Mississippi Canyon 941 Well No. 2" Enventure Global Technology, 2005.
Case History, "Yibal 381 Oman," Enventure Global Technology, Feb. 2002.
Cook, "Same Internal Casing Diameter From Surface to TD," *Offshore*, Jul. 2002.
Cottrill, "Expandable Tubulars Close in on the Holy Grail of Drilling," *Upstream*, Jul. 26, 2002.
Daigle et al., "Expandable Tubulars: Field Examples of Application in Well Construction and Remediation," *Society of Petroleum Engineers*, SPE 62958, 2000.
Daneshy, "Technology Strategy Breeds Value," E&P, May 2004.
Data Sheet, "Enventure Cased-Hole Liner (CHL) System" Enventure Global Technology, Dec. 2002.
Data Sheet, "Enventure Openhole Liner (OHL) System" Enventure Global Technology, Dec. 2002.
Data Sheet, "Window Exit Applications OHL Window Exit Expansion" Enventure Global Technology, Jun. 2003.
Dean et al., "Monodiameter Drilling Liner—From Concept to Reality," *Society of Petroleum Engineers*, SPE/IADC 79790, 2003.

Demong et al., "Breakthroughs Using Solid Expandable Tubulars to Constuct Extended Reach Wells," *Society of Petroleum Engineers*, IADC/SPE 87209, 2004.
Demong et al., "Casing Design in Complex Wells: The Use of Expandables and Multilateral Technology to Attack the size Reduction Issue".
Demong et al., "Expandable Tubulars Enable Multilaterals Without Compromise on Hole Size," *Offshore*, Jun. 2003.
Demong et al., "Planning the Well Construction Process for the Use of Solid Expandable Casing," *Society of Petroleum Engineers*, SPE 85303, 2003.
Demoulin, "Les Tubes Expansibles Changent La Face Du Forage Petrolier," *L'Usine Nouvelle*, 2878:50-52,3 Juillet 2003.
Dupal et al., "Realization of the MonoDiameter Well: Evolution of a Game-Changing Technology," *Offshore Technology Conference*, OTC 14312, 2002.
Dupal et al., "Solid Expandable Tubular Technology—A Year of Case Histories in the Drilling Environment," *Society of Petroleum Engineers*, SPE/IADC 67770, 2001.
Dupal et al., "Well Design with Expandable Tubulars Reduces Cost and Increases Success in Deepwater Applications," *Deep Offshore Technology*, 2000.
Duphorne, "Letter Re: Enventure Claims of Baker Infringement of Enventure's Expandable Patents," Apr. 1, 2005.
"EIS Expandable Isolation Sleeve" *Expandable Tubular Technology*, Feb. 2003.
Enventure Global Technology, Solid Expandable Tubulars are Enabling Technology, *Drilling Contractor*, Mar.-Apr. 2001.
"Enventure Ready to Rejuvinate the North Sea," *Roustabout*, Sep. 2004.
Escobar et al., "Increasing Solid Expandable Tubular Technology Reliability in a Myriad of Downhole Environments," *Society of Petroleum Engineers*, SPE/IADC 81094, 2003.
"Expandable Casing Accesses Remote Reservoirs," *Petroleum Engineer International*, Apr. 1999.
"Expandable Sand Screens," *Weatherford Completion Systems*, 2002.
Filippov et al., "Expandable Tubular Solutions," *Society of Petroleum Engineers*, SPE 56500, 1999.
"First ever SET Workshop Held in Aberdeen," *Roustabout*, Oct. 2004.
Fischer, "Expandables and the Dream of the Monodiameter Well: A Status Report", *World Oil*, Jul. 2004.
Fontova, "Solid Expandable Tubulars (SET) Provide Value to Operators Worldwide in a Variety of Applications," *EP Journal of Technology*, Apr. 2005.
Furlow, "Casing Expansion, Test Process Fine Tuned on Ultra-deepwater Well," *Offshore*, Dec. 2000.
Furlow, "Expandable Casing Program Helps Operator Hit TD With Larger Tubulars," *Offshore*, Jan. 2000.
Furlow, "Expandable Solid Casing Reduces Telescope Effect," *Offshore*, Aug. 1998.
Furlow, "Agbada Well Solid Tubulars Expanded Bottom Up, Screens Expanded Top Down," *Offshore*, 2002.
Gilmer et al., "World's First Completion Set Inside Expandable Screen," *High-Tech Wells*, 2003.
Grant et al., "Deepwater Expandable Openhole Liner Case Histories: Learnings Through Field Applications," *Offshore Technology Conference*, OCT 14218, 2002.
Guichelaar et al., "Effect of Micro-Surface Texturing on Breakaway Torque and Blister Formation on Carbon-Graphite Faces in a Mechanical Seal," *Lubrication Engineering*, Aug. 2002.
Gusevik et al., "Reaching Deep Reservoir Targets Using Solid Expandable Tubulars" *Society of Petroleum Engineers*, SPE 77612, 2002.
Haut et al., "Meeting Economic Challenges of Deepwater Drilling with Expandable-Tubular Technology," *Deep Offshore Technology Conference*, 1999.
Hull, "Monodiameter Technology Keeps Hole Diameter to TD," *Offshore* Oct. 2002.
"Innovators Chart the Course,".
Langley, "Case Study: Value in Drilling Derived From Application-Specific Technology," Oct. 2004.
Lohoefer et al., "Expandable Liner Hanger Provides Cost-Effective Alternative Solution," *Society of Petroleum Engineers*, IADC/SPE 59151, 2000.
Mack et al., "How in Situ Expansion Affects Casing and Tubing Properties," *World Oil*, Jul. 1999. pp. 69-71.
Mack et al., "In-Situ Expansion of Casing and Tubing—Effect on Mechanical Properties and Resistance to Sulfide Stress Cracking,".
Merritt, "Casing Remediation—Extending Well Life Through The Use of Solid Expandable Casing Systems,".
Merritt et al., "Well Remediation Using Expandable Cased-Hole Liners", *World Oil*., Jul. 2002.
Merritt et al., "Well Remediation Using Expandable Cased-Hole Liners—Summary of Case Histories".
Moore et al., "Expandable Liner Hangers: Case Histories," *Offshore Technology Conference*, OTC 14313, 2002.
Moore et al., "Field Trial Proves Upgrades to Solid Expandable Tubulars," *Offshore Technology Conference*, OTC 14217, 2002.
News Release, "Shell and Halliburton Agree to Form Company to Develop and Market Expandable Casing Technology," Jun. 3, 1998.
Nor, et at., "Transforming Conventional Wells to Bigbore Completions Using Solid Expandable Tubular Technology," *Offshore Technology Conference*, OTC 14315, 2002.
Patin et al., "Overcoming Well Control Challenges with Solid Expandable Tubular Technology," *Offshore Technology Conference*, OTC 15152, 2003.
Power Ultrasonics, "Design and Optimisation of An Ultrasonic Die System For Forming Metal Cans," 1999.
Ratliff, "Changing Safety Paradigms in the Oil and Gas Industry," *Society of Petroleum Engineers*, SPE 90828, 2004.
Rivenbark, "Expandable Tubular Technology—Drill Deeper, Farther, More Economically," Enventure Global Technology.
Rivenbark et al., "Solid Expandable Tubular Technology: The Value of Planned Installation vs. Contingency," *Society of Petroleum Engineers*, SPE 90821, 2004.
Rivenbark et al., "Window Exit Sidetrack Enhancements Through the Use of Solid Expandable Casing," *Society of Petroleum Engineers*, IADC/SPE 88030, 2004.
Roca et al., "Addressing Common Drilling Challenges Using Solid Expandable Tubular Technology," *Society of Petroleum Engineers*, SPE 80446, 2003.
Sanders et al., Practices for Providing Zonal Isolation in Conjunction with Expandable Casing Jobs-Case Histories, 2003.
Sanders et al., "Three Diverse Applications on Three Continents for a Single Major Operator," *Offshore Technology Conference*, OTC 16667, 2004.
"Set Technology: The Facts" 2004.
Siemers et al., "Development and Field Testing of Solid Expandable Corrosion Resistant Cased-hole Liners to Boost Gas Production in Corrosive Environments," *Offshore Technology Conference*, OTC 15149, 2003.
"Slim Well:Stepping Stone to MonoDiameter," *Hart'E&P*, Jun. 2003.
Smith, "Pipe Dream Reality," *New Technology Magazine*, Dec. 2003.
"Solid Expandable Tubulars," *Hart's E&P*, Mar. 2002.
Sparling et al., "Expanding Oil Field Tubulars Through a Window Demonstrates Value and Provides New Well Construction Option," *Offshore Technology Conference*, OTC 16664, 2004.
Sumrow, "Shell Drills World's First Monodiameter Well in South Texas," *Oil and Gas*, Oct. 21, 2002.
Touboul et al., "New Technologies Combine to Reduce Drilling Cost in Ultradeepwater Applications," *Society of Petroleum Engineers*, SPE 90830, 2004.
Van Noort et al., "Using Solid Expandable Tubulars for Openhole Water Shutoff," *Society of Petroleum Engineers*, SPE 78495, 2002.
Van Noort et al., "Water Production Reduced Using Solid Expandable Tubular Technology to "Clad," in Fractured Carbonate Formation" *Offshore Technology Conference*, OTC 15153, 2003.
Von Flatern, "From Exotic to Routine—the Offshore Quick-step," *Offshore Engineer*, Apr. 2004.
Von Flatern, "Oilfield Service Trio Target Jules Verne Territory," *Offshore Engineer*, Aug. 2001.

Waddell et al., "Advances in Single-diameter Well Technology: The Next Step to Cost-Effective Optimization," *Society of Petroleum Engineers*, SPE 90818, 2004.
Waddell et al., "Installation of Solid Expandable Tubular Systems Through Milled Casing Windows," *Society of Petroleum Engineers*, IADC/SPE 87208, 2004.
Williams, "Straightening the Drilling Curve," *Oil and Gas Investor*, Jan. 2003.
www.JETLUBE.com, "Oilfield Catalog—Jet-Lok Product Applicatin Descriptions," 1998.
www.MITCHMET.com, "3d Surface Texture Parameters," 2004.
"Expand Your Opportunities." *Enventure*. CD-ROM. Jun. 1999.
"Expand Your Opportunities." *Enventure*. CD-ROM. May 2001.
International Preliminary Examination Report, Application PCT/US02/25608, Jun. 1, 2005.
International Preliminary Examination Report, Application PCT/US02/39418, Feb. 18, 2005.
International Preliminary Examination Report, Application PCT/US03/06544, May 10, 2005.
International Preliminary Examination Report, Application PCT/US03/11765, Dec. 10, 2004.
International Preliminary Examination Report, Application PCT/US03/11765, Jan. 25, 2005.
International Preliminary Examination Report, Application PCT/US03/11765, Jul. 18, 2005.
International Preliminary Examination Report, Application PCT/US03/13787, Mar. 2, 2005.
International Preliminary Examination Report, Application PCT/US03/13787, Apr. 7, 2005.
International Preliminary Examination Report, Application PCT/US03/14153, May 12, 2005.
International Preliminary Examination Report, Application PCT/US03/15020, May 9, 2005.
International Preliminary Examination Report, Application PCT/US03/25667, May 25, 2005.
International Preliminary Examination Report, Application PCT/US03/29858, May 23, 2005.
International Preliminary Examination Report, Application PCT/US03/38550, May 23, 2005.
International Preliminary Report on Patentability, Application PCT/US04/02122, May 13, 2005.
International Preliminary Report on Patentability, Application PCT/US04/04740, Apr. 27, 2005.
International Preliminary Report on Patentability, Application PCT/US04/06246, May 5, 2005.
International Preliminary Report on Patentability, Application PCT/US04/08030, Apr. 7, 2005.
International Preliminary Report on Patentability, Application PCT/US04/08030, Jun. 10, 2005.
International Preliminary Report on Patentability, Application PCT/US04/08073, May 9, 2005.
International Preliminary Report on Patentability, Application PCT/US04/11177, Jun. 9, 2005.
Written Opinion to Application No. PCT/US02/25608, Feb. 2, 2005.
Written Opinion to Application No. PCT/US02/25727, May 17, 2004.
Written Opinion to Application No. PCT/US02/39425, Apr. 11, 2005.
Written Opinion to Application No. PCT/US03/25675, May 9, 2005.
Written Opinion to Application No. PCT/US04/08171, May 5, 2005.
Combined Search Report and Written Opinion to Application No. PCT/US04/00631, Mar. 28, 2005.
Combined Search Report and Written Opinion to Application No. PCT/US04/02122, Feb. 24, 2005.
Combined Search Report and Written Opinion to Application No. PCT/US04/08073, Mar. 4, 2005.
Combined Search Report and Written Opinion to Application No. PCT/US04/28438, Mar. 14, 2005.
Search Report to Application No. GB 0415835.8, Mar. 10, 2005.
Examination Report to Application No. GB 0225505.7, Feb. 15, 2005.
Examination Report to Application No. GB 0400018.8, May 17, 2005.
Examination Report to Application No. GB 0400019.6, May 19, 2005.
Examination Report to Application No. GB 0403891.5, Feb. 14, 2005.
Examination Report to Application No. GB 0403891.5, Jun. 30, 2005.
Examination Report to Application No. GB 0403893.1, Feb. 14, 2005.
Examination Report to Application No. GB 0403894.9, Feb. 15, 2005.
Examination Report to Application No. GB 0403920.2, Feb. 15, 2005.
Examination Report to Application No. GB 0403921.0, Feb. 15, 2005.
Examination Report to Application No. GB 0404796.5, Apr. 14, 2005.
Examination Report to Application No. GB 0406257.6, Jun. 16, 2005.
Examination Report to Application No. GB 0406258.4, Jan. 12, 2005.
Examination Report to Application No. GB 0408672.4, Mar. 21, 2005.
Examination Report to Application No. GB 0411892.3, Feb. 21, 2005.
Examination Report to Application No. GB 0412533.2, May 20, 2005.
Examination Report to Application No. GB 0416625.2, Jan. 20, 2005.
Examination Report to Application No. GB 0428141.6, Feb. 9, 2005.
Examination Report to Application No. GB 0500184.7, Feb. 9, 2005.
Examination Report to Application No. GB 0501667.0, May 27, 2005.
Examination Report to Application No. GB 0507979.3, Jun. 16, 2005.
Search and Examination Report to Application No. GB 0425948.7, Apr. 14, 2005.
Search and Examination Report to Application No. GB 0425951.1, Apr. 14, 2005.
Search and Examination Report to Application No. GB 0425956.0, Apr. 14, 2005.
Search and Examination Report to Application No. GB 0426155.8, Jan. 12, 2005.
Search and Examination Report to Application No. GB 0426156.6, Jan. 12, 2005.
Search and Examination Report to Application No. GB 0426157.4, Jan. 12, 2005.
Search and Examination Report to Application No. GB 0500600.2, Feb. 15, 2005.
Search and Examination Report to Application No. GB 0503470.7, Mar. 21, 2005.
Search and Examination Report to Application No. GB 0506697.2, May 20, 2005.
Examination Report to Application No. AU 2001278196 ,Apr. 21, 2005.
Examination Report to Application No. AU 2002237757 ,Apr. 28, 2005.
Examination Report to Application No. AU 2002240366 ,Apr. 13, 2005.
Search Report to Application No. EP 02806451.7; Feb. 9, 2005.
Mohawk Energy, :Minimizing Drilling Ecoprints Houston, Dec. 16, 2005.
International Preliminary Report on Patentability, Application PCT/US04/00631, Mar. 2, 2006.
International Preliminary Report on Patentability, Application PCT/US04/008170, Sep. 29, 2005.
International Preliminary Report on Patentability, Application PCT/US04/08171, Sep. 13, 2005.
International Preliminary Report on Patentability, Application PCT/US04/28438, Sep. 20, 2005.

Combined Search Report and Written Opinion to Application No. PCT/US04/10762, Sep. 1, 2005.
Combined Search Report and Written Opinion to Application No. PCT/US04/11973, Sep. 27, 2005.
Combined Search Report and Written Opinion to Application No. PCT/US04/28423, Jul. 13, 2005.
Combined Search Report and Written Opinion to Application No. PCT/US04/28831, Dec. 19, 2005.
Combined Search Report and Written Opinion to Application No. PCT/US04/28889, Nov. 14, 2005.
Examination Report to Application No. GB 0219757.2, Oct. 31, 2004.
Examination Report to Application No. GB 03701281.2, Jan. 31, 2006.
Examination Report to Application No. GB 03723674.2, Feb. 6, 2006.
Examination Report to Application No. GB 0400019.6, Sep. 2, 2005.
Examination Report to Application No. GB 0400019.6, Nov. 4, 2005.
Examination Report to Application No. GB 0406257.6, Mar. 3, 2005.
Examination Report to Application No. GB 0406257.6, Sep. 2, 2005.
Examination Report to Application No. GB 0406257.6, Nov. 9, 2005.
Examination Report to Application No. GB 0406258.4, Jul. 27, 2005.
Examination Report to Application No. GB 0406258.4, Dec. 20, 2005.
Examination Report to Application No. GB 0412876.5, Feb. 13, 2006.
Examination Report to Application No. GB 0415835.8, Dec. 23, 2005.
Examination Report to Application No. GB 0422419.2, Nov. 8, 2005.
Examination Report to Application No. GB 0422893.8, Aug. 8, 2005.
Examination Report to Application No. GB 0422893.8, Dec. 15, 2005.
Examination Report to Application No. GB 0425948.7, Nov. 24, 2005.
Examination Report to Application No. GB 0425956.0, Nov. 24, 2005.
Examination Report to Application No. GB 0428141.6, Sep. 15, 2005.
Examination Report to Application No. GB 0428141.6, Feb. 21, 2006.
Examination Report to Application No. GB 0500184.7, Sep. 12, 2005.
Examination Report to Application No. GB 0500600.2, Sep. 6, 2005.
Examination Report to Application No. GB 0501667.0, Jan. 27, 2006.
Examination Report to Application No. GB 0503250.3, Nov. 15, 2005.
Examination Report to Application No. GB 0503250.3, Mar. 2, 2006.
Examination Report to Application No. GB 0503470.7, Sep. 22, 2005.
Examination Report to Application No. GB 0506699.8, Sep. 21, 2005.
Examination Report to Application No. GB 0507979.3, Jan. 17, 2006.
Examination Report to Application No. GB 0507980.1, Sep. 29, 2005.
Examination Report to Application No. GB 0509618.5, Feb. 3, 2006.
Examination Report to Application No. GB 0509620.1, Feb. 14, 2006.
Examination Report to Application No. GB 0509627.6, Feb. 3, 2006.
Examination Report to Application No. GB 0509629.2, Feb. 3, 2006.
Examination Report to Application No. GB 0509630.0, Feb. 3, 2006.
Examination Report to Application No. GB 0509631.8, Feb. 14, 2006.
Examination Report to Application No. GB 0517448.7, Nov. 9, 2005.
Examination Report to Application No. GB 0518025.2, Oct. 27, 2005.
Examination Report to Application No. GB 0518039.3, Nov. 29, 2005.
Examination Report to Application No. GB 0518252.2, Oct. 28, 2005.
Examination Report to Application No. GB 0518799.2, Nov. 9, 2005.
Examination Report to Application No. GB 0518893.3, Dec. 16, 2005.
Examination Report to Application No. GB 0519989.8, Mar. 8, 2006.
Examination Report to Application No. GB 0521024.0, Dec. 22, 2005.
Examination Report to Application No. GB 0522050.4, Dec. 13, 2005.
Examination Report to Application No. GB 0602877.3, Mar. 20, 2006.
Search and Examination Report to Application No. GB 0412876.5, Sep. 27, 2005.
Search and Examination Report to Application No. GB 0505039.8, Jul. 22, 2005.
Search and Examination Report to Application No. GB 0506700.4, Sep. 20, 2005.
Search and Examination Report to Application No. GB 0509618.5, Sep. 27, 2005.
Search and Examination Report to Application No. GB 0509620.1, Sep. 27, 2005.
Search and Examination Report to Application No. GB 0509626.8, Sep. 27, 2005.
Search and Examination Report to Application No. GB 0509627.6, Sep. 27, 2005.
Search and Examination Report to Application No. GB 0509629.2, Sep. 27, 2005.
Search and Examination Report to Application No. GB 0509630.0, Sep. 27, 2005.
Search and Examination Report to Application No. GB 0509631.8, Sep. 27, 2005.
Search and Examination Report to Application No. GB 0512396.3, Jul. 26, 2005.
Search and Examination Report to Application No. GB 0512398.9, Jul. 27, 2005.
Search and Examination Report to Application No. GB 0516429.8, Nov. 7, 2005.
Search and Examination Report to Application No. GB 0516430.6, Nov. 8, 2005.
Search and Examination Report to Application No. GB 0516431.4, Nov. 8, 2005.
Search and Examination Report to Application No. GB 0522155.1, Mar. 7, 2006.
Search and Examination Report to Application No. GB 0522892.9 Jan. 5, 2006.
Search and Examination Report to Application No. GB 0523075.0, Jan. 12, 2006.
Search and Examination Report to Application No. GB 0523076.8, Dec. 14, 2005.
Search and Examination Report to Application No. GB 0523078.4, Dec. 13, 2005.
Search and Examination Report to Application No. GB 0523132.9, Jan. 12, 2006.
Search and Examination Report to Application No. GB 0524692.1, Dec. 19, 2005.
Search and Examination Report to Application No. GB 0525768.8, Feb. 3, 2006.

Search and Examination Report to Application No. GB 0525770.4, Feb. 3, 2006.
Search and Examination Report to Application No. GB 0525772.0, Feb. 2, 2006.
Search and Examination Report to Application No. GB 0525774.6, Feb. 2, 2006.
Examination Report to Application No. AU 2003257878, Jan. 19, 2006.
Examination Report to Application No. AU 2003257881, Jan. 19, 2006.
Search Report to Application No. EP 03071281.2; Nov. 14, 2005.
Search Report to Application No. EP 03723674.2; Nov. 22, 2005.
Search Report to Application No. EP 03728326.4; Mar. 13, 2006.
Search Report to Application No. EP 03752486.5; Feb. 8, 2006.
Search Report to Application No. EP 03759400.9; Mar. 3, 2006.

MONO-DIAMETER WELLBORE CASING

CROSS REFERENCE TO RELATED APPLICATIONS

The present application is a National Stage filing based upon PCT patent application Ser. No. PCT/US02/29856, filed on Sep. 19, 2002, which claimed the benefit of the filing date of U.S. provisional patent application Ser. No. 60/326,886, filed on Oct. 3, 2001, the disclosure of which is incorporated herein by reference.

This application is a continuation-in-part of: (1) U.S. utility patent application Ser. No. 10/418,687, filed on Apr. 18, 2003 (now U.S. Pat. No. 7,021,390 which issued Apr. 4, 2006), which was a continuation of U.S. utility patent application Ser. No. 09/852,026, filed on May 9, 2001, which issued as U.S. Pat. No. 6,561,227, which was a division of U.S. utility patent application Ser. No. 09/454,139, filed on Dec. 3, 1999 (now U.S. Pat. No. 6,497,289 which issued Dec. 24, 2002), which claimed the benefit of the filing date of U.S. provisional patent application Ser. No. 60/111,293, filed on Dec. 7, 1998; and (2) U.S. utility patent application Ser. No. 10/465,835, filed on Jun. 13, 2003, which claimed the benefit of the filing date of U.S. provisional application Ser. No. 60/262,434, filed on Jan. 17, 2001, the disclosures of which are incorporated herein by reference.

This application is related to the following co-pending applications: (1) U.S. Pat. No. 6,497,289, which was filed as U.S. patent application Ser. No. 09/454,139, filed on Dec. 3, 1999, which claims priority from provisional application 60/111,293, filed on Dec. 7, 1998, (2) U.S. patent application Ser. No. 09/510,913, filed on Feb. 23, 2000, which claims priority from provisional application 60/121,702, filed on Feb. 25, 1999, (3) U.S. patent application Ser. No. 09/502,350, filed on Feb. 10, 2000, which claims priority from provisional application 60/119,611, filed on Feb. 11, 1999, (4) U.S. Pat. No. 6,328,113, which was filed as U.S. patent application Ser. No. 09/440,338, filed on Nov. 15, 1999, which claims priority from provisional application 60/108,558, filed on Dec. 16, 1998, (5) U.S. patent application Ser. No. 10/169,434, filed on Jul. 1, 2002, which claims priority from provisional application 60/183,546, filed on Feb. 18, 2000, (6) U.S. Pat. No. 6,640,903 which was filed as U.S. patent application Ser. No. 09/523,468, filed on Mar. 10, 2000, which claims priority from provisional application 60/124,042, filed on Mar. 11, 1999, (7) U.S. Pat No. 6,568,471, which was filed as patent application Ser. No. 09/512,895, filed on Feb. 24, 2000, which claims priority from provisional application 60/121,841, filed on Feb. 26, 1999, (8) U.S. Pat. No. 6,575,240, which was filed as patent application Ser. No. 09/511,941, filed on Feb. 24, 2000, which claims priority from provisional application 60/121,907, filed on Feb. 26, 1999, (9) U.S. Pat. No. 6,557,640, which was filed as patent application Ser. No. 09/588,946, filed on Jul. 7, 2000, which claims priority from provisional application 60/137,998, filed on Jul. 7, 1999, (10) U.S. patent application Ser. No. 09/981,916, filed on Oct. 18, 2001 as a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (11) U.S. Pat. No. 6,604,763, which was filed as application Ser. No. 09/559,122, filed on Apr. 26, 2000, which claims priority from provisional application 60/131,106, filed on Apr. 26, 1999, (12) U.S. patent application Ser. No. 10/030,593, filed on Jan. 8, 2002, which claims priority from provisional application 60/146,203, filed on Jul. 29, 1999, (13) U.S. provisional patent application Ser. No. 60/143,039, filed on Jul. 9, 1999, (14) U.S. patent application Ser. No. 10/111,982, filed on Apr. 30, 2002, which claims priority from provisional patent application Ser. No. 60/162,671, filed on Nov. 1, 1999, (15) U.S. provisional patent application Ser. No. 60/154,047, filed on Sep. 16, 1999, (16) U.S. provisional patent application Ser. No. 60/438,828, filed on Jan. 9, 2003, (17) U.S. Pat. No. 6,564,875, which was filed as application Ser. No. 09/679,907, on Oct. 5, 2000, which claims priority from provisional patent application Ser. No. 60/159,082, filed on Oct. 12, 1999, (18) U.S. patent application Ser. No. 10/089,419, filed on Mar. 27, 2002, which claims priority from provisional patent application Ser. No. 60/159,039, filed on Oct. 12, 1999, (19) U.S. patent application Ser. No. 09/679,906, filed on Oct. 5, 2000, which claims priority from provisional patent application Ser. No. 60/159,033, filed on Oct. 12, 1999, (20) U.S. patent application Ser. No. 10/303,992, filed on Nov. 22, 2002, which claims priority from provisional patent application Ser. No. 60/212,359, filed on Jun. 19, 2000, (21) U.S. provisional patent application Ser. No. 60/165,228, filed on Nov. 12, 1999, (22) U.S. provisional patent application Ser. No. 60/455,051, filed on Mar. 14, 2003, (23) PCT application US02/2477, filed on Jun. 26, 2002, which claims priority from U.S. provisional patent application Ser. No. 60/303,711, filed on Jul. 6, 2001, (24) U.S. patent application Ser. No. 10/311,412, filed on Dec. 12, 2002, which claims priority from provisional patent application Ser. No. 60/221,443, filed on Jul. 28, 2000, (25) U.S. patent application Ser. No. 10/322,947, filed on Dec. 18, 2002, which claims priority from provisional patent application Ser. No. 60/221,645, filed on Jul. 28, 2000, (26) U.S. patent application Ser. No. 10/322,947, filed on Jan. 22, 2003, which claims priority from provisional patent application Ser. No. 60/233,638, filed on Sep. 18, 2000, (27) U.S. patent application Ser. No. 10/406,648, filed on Mar. 31, 2003, which claims priority from provisional patent application Ser. No. 60/237,334, filed on Oct. 2, 2000, (28) PCT application US02/04353, filed on Feb. 14, 2002, which claims priority from U.S. provisional patent application Ser. No. 60/270,007, filed on Feb. 20, 2001, (29) U.S. patent application Ser. No. 10/465,835, filed on Jun. 13, 2003, which claims priority from provisional patent application Ser. No. 60/262,434, filed on Jan. 17, 2001, (30) U.S. patent application Ser. No. 10/465,831, filed on Jun. 13, 2003, which claims priority from U.S. provisional patent application Ser. No. 60/259,486, filed on Jan. 3, 2001, (31) U.S. provisional patent application Ser. No. 60/452,303, filed on Feb. 5, 2003, (32) U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (33) U.S. Pat. No. 6,561,227, which was filed as patent application Ser. No. 09/852,026, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (34) U.S. patent application Ser. No. 09/852,027, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (35) PCT Application US02/25,608, filed on Aug. 13, 2002, which claims priority from provisional application 60/318,021, filed on Sep. 7, 2001, (36) PCT Application US02/24,399, filed on Aug. 1, 2002, which claims priority from U.S. provisional patent application Ser. No. 60/313,453, filed on Aug. 20, 2001, (37) PCT Application US02/29856, filed on Sep. 19, 2002, which claims priority from U.S. provisional patent application Ser. No. 60/326,886, filed on Oct. 3, 2001, (38) PCT Application US02/20256, filed on Jun. 26, 2002, which claims priority from U.S. provisional patent application Ser. No. 60/303,740, filed on Jul. 6, 2001, (39) U.S. patent application Ser. No. 09/962,469, filed on Sep. 25, 2001, which is a divisional of U.S. patent application Ser. No. 09/523,468, filed on Feb. 10, 2000, (now U.S. Pat. No. 6,640,903 which issued Nov. 4, 2003), which claims priority from provisional application 60/124,042, filed on Mar. 11, 1999, (40) U.S. patent application Ser. No. 09/962,470, filed on Sep. 25, 2001, which is a divisional of U.S. patent application Ser. No. 09/523,468, filed on May 10, 2000, (now U.S. Pat. No. 6,640,903 which issued Nov. 4, 2003), which claims priority from provisional application 60/124,042, filed on Mar. 11, 1999, (41) U.S. patent application Ser. No. 09/962,471, filed on Sep. 25, 2001, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (42) U.S. patent application Ser. No. 09/962,467, filed on Sep. 25, 2001, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (43) U.S. patent application Ser. No. 09/962,468, filed on Sep. 25, 2001, which is a divisional of U.S. patent application Ser. No. 09/523,468, filed on Mar. 10, 2000, (now U.S. Pat. 6,640,903 which issued Nov. 4, 2003), which claims priority from provisional application 60/124,042, filed on Mar. 11, 1999, (44) PCT application US 02/25727, filed on Aug. 14, 2002, which claims priority from U.S. provisional patent application Ser. No. 60/317,985, filed on Sep. 6, 2001, and U.S. provisional patent application Ser. No. 60/318,386, filed on Sep. 10, 2001, (45) PCT application US 02/39425, filed on Dec. 10, 2002, which claims priority from U.S. provisional patent application Ser. No. 60/343,674, filed on Dec. 27 2001, (46) U.S. utility patent application Ser. No. 09/969,922, filed on Oct. 3, 2001, (now U.S. Pat. No. 6,634,431 which issued Oct. 21, 2003), which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (47) U.S. utility patent application Ser. No. 10/516,467, filed on Dec. 10, 2001, which is a continuation application of U.S. utility patent application Ser. No. 09/969,922, filed on Oct. 3, 2001, (now U.S. Patent No. 6,634,431 which issued Oct. 21, 2003), which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (48) PCT application US 03/00609, filed on Jan. 9, 2003, which claims priority from U.S. provisional patent application Ser. No. 60/357,372, filed on Feb. 15, 2002, (49) U.S. patent application Ser. No. 10/074,703, filed on Feb. 12, 2002, which is a divisional of U.S. patent number 6,568,471, which was filed as patent application Ser. No. 09/512,895, filed on Feb. 24, 2000, which claims priority from provisional application 60/121,841, filed on Feb. 26, 1999, (50) U.S. patent application Ser. No. 10/074,244, filed on Feb. 12, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (51) U.S. patent application Ser. No. 10/076,660, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (52) U.S. patent application Ser. No. 10/076,661, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (53) U.S. patent application Ser. No. 10/076,659, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (54) U.S. patent application Ser. No. 10,078,928, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (55) U.S. patent application Ser. No. 10/078,922, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (56) U.S. patent application Ser. No. 10/078,921, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (57) U.S. patent application Ser. No. 10/261,928, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (58) U.S. patent application Ser. No. 10/079,276, filed on Feb. 20, 2002, which is a divisional of U.S. Pat. No. 6,568,471, which was filed as patent application Ser. No. 09/512,895, on Feb. 24, 2000, which claims priority from provisional application 60/121,841, filed on Feb. 26, 1999, (59) U.S. patent application Ser. No. 10/262,009, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (60) U.S. patent application Ser. No. 10/092,481, filed on Mar. 7, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (61) U.S. patent application Ser. No. 10/261,926, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (62) PCT application US 02/36157, filed on Nov. 12, 2002, which claims priority from U.S. provisional patent application Ser. No. 60/338,996, filed on Nov. 12, 2001, (63) PCT application US 02/36267, filed on Nov. 12, 2002, which claims priority from U.S. provisional patent application Ser. No. 60/339,013, filed on Nov. 12, 2001, (64) PCT application US 03/11765, filed on Apr. 16, 2003, which claims priority from U.S. provisional patent application Ser. No. 60/383,917, filed on May 29, 2002, (65) PCT application US 03/15020, filed on May 12, 2003, which claims priority from U.S. provisional patent application Ser. No. 60/391,703, filed on Jun. 26, 2002, (66) PCT application US 02/39418, filed on Dec. 10, 2002, which claims priority from U.S. provisional patent application Ser. No. 60/346,309, filed on Jan. 7, 2002, (67) PCT application US 03/06544, filed on Mar. 4, 2003, which claims priority from U.S. provisional patent application Ser. No. 60/372,048, filed on Apr. 12, 2002, (68) U.S. patent application Ser. No. 10/331,718, filed on Dec. 30, 2002, which is a divisional U.S. patent application Ser. No. 09/679,906, filed on Oct. 5, 2000, which claims priority from provisional patent application Ser. No. 60/159,033, filed on Oct. 12, 1999, (69) PCT application US 03/04837, filed on Feb. 29, 2003, which claims priority from U.S. provisional patent application Ser. No. 60/363,829, filed on Mar. 13, 2002, (70) U.S. patent application Ser. No. 10/261,927, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (71) U.S. patent application Ser. No. 10/262,008, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (72) U.S. patent application Ser. No. 10/261,925, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (73) U.S. patent application Ser. No. 10/199,524, filed on Jul. 19, 2002, which is a continuation of U.S. Pat. No. 6,497,289, which was filed as U.S. patent application Ser. No. 09/454,139, filed on Dec. 3, 1999, which claims priority from provisional application 60/111,293, filed on Dec. 7, 1998, (74) PCT application U.S. 03/10144, filed on Mar. 28, 2003, which claims priority from U.S. provisional patent application Ser. No. 60/372,632, filed on Apr. 15, 2002, (75) U.S. provisional patent application Ser. No. 60/412,542, filed on Sep. 20, 2002, (76) PCT application US 03/14153, filed on May 6, 2003, which claims priority from U.S. provisional patent application Ser. No. 60/380,147, filed on May 6, 2002, (77) PCT application US 03/19993, filed on Jun. 24, 2003, which claims priority from U.S. provisional patent application Ser. No. 60/397,284, filed on Jul. 19, 2002, (78) PCT application US 03/13787, filed on May 5, 2003, which claims priority from U.S. provisional patent application Ser. No. 60/387,486, filed on Jun. 10, 2002, (79) PCT application US 03/18530, filed on Jun. 11, 2003, which claims priority from U.S. provisional patent application Ser. No. 60/387,961, filed on Jun. 12, 2002, (80) PCT application US 03/20694, filed on Jul. 1, 2003, which claims priority from U.S. provisional patent application Ser. No. 60/398,061, filed on Jul. 24, 2002, (81) PCT application US 03/20870, filed on Jul. 2, 2003, which claims priority from U.S. provisional patent application Ser. No. 60/399,240, filed on Jul. 29, 2002, (82) U.S. provisional patent application Ser. No. 60/412,487, filed on Sep. 20, 2002, (83) U.S. provisional patent application Ser. No. 60/412,488, filed on Sep. 20, 2002, (84) U.S. patent application Ser. No. 10/280,356, filed on Oct. 25, 2002, which is a continuation of U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (85) U.S. provisional patent application Ser. No. 60/412,177, filed on Sep. 20, 2002, (86) U.S. provisional patent application Ser. No. 60/412,653, filed on Sep. 20, 2002, (87) U.S. provisional patent application Ser. No. 60/405,610, filed on Aug. 23, 2002, (88) U.S. provisional patent application Ser. No. 60/405,394, filed on Aug. 23, 2002, (89) U.S. provisional patent application Ser. No. 60/412,544, filed on Sep. 20, 2002, (90) PCT application U.S. Pat. No. 03/24779, filed on Aug. 8, 2003, which claims priority from U.S. provisional patent application Ser. No. 60/407,442, filed on Aug. 30, 2002, (91) U.S. provisional patent application Ser. No. 60/423,363, filed on Dec. 10, 2002, (92) U.S. provisional patent application Ser. No. 60/412,196, filed on Sep. 20, 2002, (93) U.S. provisional patent application Ser. No. 60/412,187, filed on Sep. 20, 2002, (94) U.S. provisional patent application Ser. No. 60/412,371, filed on Sep. 20, 2002, (95) U.S. patent application Ser. No. 10,382,325, filed on Mar. 5, 2003, which is a continuation of U.S. Pat. No. 6,557,640, which was filed as patent application Ser. No. 09/588,946, filed on Jun. 7, 2000, which claims priority from provisional application 60/137,998, filed on Jun. 7, 1999, (96) U.S. patent application Ser. No. 10/624,842, filed on Jul. 22, 2003, which is a divisional of U.S. patent application Ser. No. 09/502,350, filed on Feb. 10, 2000, which claims priority from provisional application 60/119,611, filed on Feb. 11, 1999, (97) U.S. provisional patent application Ser. No. 60/431,184, filed on Dec. 5, 2002, (98) U.S. provisional patent application Ser. No. 60/448,526, filed on Feb. 18, 2003, (99) U.S. provisional patent application Ser. No. 60/461,539, filed on Apr. 9, 2003, (100) U.S. provisional patent application Ser. No. 60/462,750, filed on Apr. 14, 2003, (101) U.S. provisional patent application Ser. No. 60/436,106, filed on Dec. 23, 2002, (102) U.S. provisional patent application Ser. No. 60/442,942, filed on Jan. 27, 2003, (103) U.S. provisional patent application Ser. No. 60/442,938, filed on Jan. 27, 2003, (104) U.S. provisional patent application Ser. No. 60/418,687, filed on Apr. 18, 2003, (105) U.S. provisional patent application Ser. No. 60/454,896, filed on Mar. 14, 2003, (106) U.S. provisional patent application Ser. No. 60/450,504, filed on Feb. 26, 2003, (107) U.S. provisional patent application Ser. No. 60/451,152, filed on Mar. 9, 2003, (108) U.S. provisional patent application Ser. No. 60/455,124, filed on Mar. 17, 2003, (109) U.S. provisional patent application Ser. No. 60/453,678, filed on Mar. 11, 2003, (110) U.S. patent application Ser. No. 10/421,682, filed on Apr. 23, 2003, which is a continuation of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (111) U.S. provisional patent application Ser. No. 60/457,965, filed on Mar. 27, 2003, (112) U.S. provisional patent application Ser. No. 60/455,718, filed on Mar. 18, 2003, (113) U.S. Pat. No. 6,550,821, which was filed as patent application Ser. No. 09/811,734, filed on Mar. 19, 2001, (114) U.S. patent application Ser. No. 10/436,467, filed on May 12, 2003, which is a continuation of U.S. Pat. No. 6,604,763, which was filed as application Ser. No. 09/559,122, filed on Apr. 26, 2000, which claims priority from provisional application 60/131,106, filed on Apr. 26, 1999, (115) U.S. provisional patent application Ser. No. 60/459,776, filed on Apr. 2, 2003, (116) U.S. provisional patent application Ser. No. 60/461,094, filed on Apr. 8, 2003, (117) U.S. provisional patent application Ser. No. 60/461,038, filed on Apr. 7, 2003, (118) U.S. provisional patent application Ser. No. 60/463,586, filed on Apr. 17, 2003, (119) U.S. provisional patent application Ser. No. 60/472, 240, filed on May 20, 2003, (120) U.S. patent application Ser. No. 10/619,285, filed on Jul. 14, 2003, which is a continuation-in-part of U.S. utility patent application Ser. No. 09/969,922, filed on Oct. 3, 2001, (now U.S. Pat. No. 6,634,431 which issued Oct. 21, 2003), which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (121) U.S. utility patent application Ser. No. 10/418,688, which was filed on Apr. 18, 2003, as a division of U.S. utility patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999; (122) PCT patent application Ser. No. PCT/US2004/06246, filed on Feb. 26, 2004; (123) PCT patent application Ser. No. PCT/US2004/08170, filed on Mar. 15, 2004; (124) PCT patent application Ser. No. PCT/US2004/08171, filed on Mar. 15, 2004; (125) PCT patent application Ser. No. PCT/US2004/08073, filed on Mar. 18, 2004; (126) PCT patent application Ser. No. PCT/US2004/07711, filed on Mar 11, 2004; (127) PCT patent application Ser. No. PCT/US2004/029025, filed on Mar. 26, 2004; (128) PCT patent application Ser. No. PCT/US2004/010317, filed on Apr. 2, 2004; (129) PCT patent application Ser. No. PCT/US2004/010712, filed on Apr. 6, 2004; (130) PCT patent application Ser. No. PCT/US2004/010762, filed on Apr. 6, 2004(131) PCT patent application Ser. No. PCT/US2004/011973 filed on Apr. 15, 2004; (132) U.S. provisional patent application Ser. No. 60/495056, filed on Aug. 14, 2003; (133) U.S. provisional patent application Ser. No. 60/600,679, filed on Aug. 11, 2004; (134) PCT patent application Ser. No. PCT/US2005/027318, filed on Sep. 29, 2005; (135) PCT patent application Ser No. PCT/US2005/028936, filed on Aug. 12, 2005; (136) PCT patent application Ser. No. PCT/US2005/028669, filed on Aug. 11, 2005; (137) PCT patent application Ser. No. PCT/US2005/028453, filed on Aug. 11, 2005; (138) PCT patent application Ser No. PCT/US2005/028641, filed on Aug. 11, 2005; (139) PCT patent appliction Ser. No. PCT/US2005/028819, filed on Aug. 11, 2005; (140) patent application Ser. No. PCT/US2005/028446, filed on Aug. 11, 2005; (141) PCT patent application Ser. No. PCT/US2005/028642, filed on Aug. 11, 2005; (142) PCT patent application Ser. No. PCT/US2005/028451, filed on Aug. 11, 2005, (143). PCT patent application Ser. No. PCT/US2005/028473, filed on Aug. 11, 2005, (144) U.S. utility patent application Ser. No. 10/546082, filed on Aug. 16, 2005, (145) U.S. utility patent application Ser. No. 10/546,076, filed on Aug. 16, 2005, (146) U.S. utility patent Ser. No. 10/545,936, filed on Aug. 16, 2005, (147) U.S. utility patent application Ser. No. 10/546,079, filed on Aug. 16 2005 (148) U.S. utility patent application Ser. No. 10, 545,941, filed on Aug. 16, 2005, (149) U.S. utility patent application Ser. No. 546,078, filed on Aug. 16, 2005, filed on Aug. 11, 2005., (150) U.S. utility patent application Ser. No. 10/545,941, filed on Aug. 16, 2005, (151) U.S. utility patent application Ser. No. 11/249,967, filed on Oct. 13, 2005, (152) U.S. provisional patent application Ser. No. 60/734,302, filed on Nov. 7, 2005, (153) U.S. provisional patent application Ser. No. 60/725,181, filed on Oct. 11, 2005, (154) PCT patent application Ser. No. PCT/US2005/023391, filed Jun. 29, 2005 which claims priority from U.S. provisional patent application Ser. No. 60/585,370, filed on Jul. 2, 2004, (155) U.S. provisional patent application Ser. No. 60/721,579, filed on Sep. 28, 2005, (156) U.S. provisional patent application Ser. No. 60/717,391, filed on Sep. 15, 2005, (157) U.S. provisional patent application Ser. No. 60/702,935, filed on Jul. 27, 2005, (158) U.S. provisional patent application Ser. No. 60/663,913, filed on Mar. 21, 2005, (159) U.S. provisional patent application Ser. No. 60/652,564, filed on Feb. 14, 2005, (160) U.S. provisional patent application Ser. No. 60/645,840, filed on Jan. 21, 2005, (161) PCT patent application Ser. No. PCT/US2005/043122, filed on Nov. 29, 2005 which claims priority from U.S. provisional patent application Ser. No. 60/631,703, filed on Nov. 30, 2004, (162) U.S. provisional patent application Ser. No. 60/752,787, filed on Dec. 22, 2005, (163) U.S. National Stage application Ser. No. 10/548,934, filed on Sep. 12, 2005; (164) U.S. National Stage application Ser. No. 10/549410, filed on Sep. 13, 2005; (165) U.S. Provisional patent application No. 60/717391, filed on Sep. 15, 2005; (166) U.S. National Stage application Ser. No. 10/550,906, filed on Sep. 27, 2005; (167) U.S. National Stage application Ser. No. 10/551,880, filed on Sep. 30, 2005; (168) U.S. National Stage application Ser. No. 10/552,253, filed on Oct. 4, 2005; (169) U.S. National Stage application Ser. No. 10/552,790, filed on Oct. 11, 2005; (170) U.S. Provisional Patent Application No. 60/725,181, filed on Oct. 11, 2005; (171) U.S. National Stage application Ser. No. 10/553,084, filed on Oct. 13, 2005; (172) National Stage application Ser. No. 10/553,566, filed on Oct. 17, 2005 ; (173) PCT Patent Application No. PCT/US2006/002449, filed on Jan. 20, 2006, and (174) PCT Patent Application No. PCT/US2006/004809, filed on Feb. 9, 2006; (175) U.S. Utility Patent application Ser. No. 11/356,899, filed on Feb. 17, 2006 , (176) U.S. National Stage application Ser. No. 10/568,200, filed on Feb. 13, 2006 , (177) U.S. National Stage application Ser. No. 10/568,719, filed on Feb. 16, 2006 , (178) U.S. National Stage application Ser. No. 10/569,323, (179) U.S. National State patent application Ser. No. 10/571,041, filed on Mar. 3, 2006; (180) U.S. National State patent application Ser. No. 10/571,017, filed on Mar. 3, 2006; (181) U.S. National State patent application Ser. No. 10/571,086, filed on Feb. 6, 2006; (182) U.S. National State patent applocation Ser. No. 10/571,085, filed on Mar. 6, 2006, (183U.S. utility patent application Ser. No. 10/938,788filed on Sep. 10, 2004, (184) U.S. utility patent application Ser. No. 10/938,225, filed on Sep. 10, 2004, (185) U.S. utility patent application Ser. No. 10/952,288filed on Sep. 28, 2004, (186) U.S. utility patent application Ser. No. 10/952,416, filed on Sep. 28, 2004, (187) U.S. utility patent application Ser. No. 10/950,749, filed on Sep. 27, 2004 (188) U.S. utility patent application Ser. No. 10/950,869, filed on Sep. 27, 2004, (189) U.S. provisional patent application Ser. No. 60/761,324, filed on Jan. 23, 2006, (190) U.S. provisional patent application Ser. No. 60/754,556, filed on Dec. 28, 2005, (191) U.S. utility patent application Ser. No. 11/380,051, filed on Apr. 25, 2006, (192) U.S. utility patent application Ser. No. 11/380,055, filed on Apr. 25, 2006, (193) U.S. utility patent application Ser. No. 10/522,039. filed on Mar. 10, 2006; (194) U.S. provisional patent application Ser. No. 60/746,813, filed on May 9, 2006; (195) U.S. utility patent application Ser. No. 11/456,584, filed on Jul. 11, 2006; and (196) U.S. utility patent application Ser. No. 11/456,587, filed on Jul. 11, 2006; (197) PCT Patent Application No. PCT/US2006/009886, filed on Mar. 3, 2006; (198) PCT patent application No. PCT/US2006/010674, filed on Mar. 21, 2006; (199) U.S. Pat. No. 6,409,175 which issued Jun. 25, 2002, (200) U.S. Pat. No. 6,550,821 which issued Apr. 22, 2003, (201) U.S. patent application No. 10/767,953, filed Jan. 29, 2004, now U.S. Pat. No. 7,077,211 which issued Jul. 18, 2006; (202) U.S. patent application No. 10/769,726, filed Jan. 30, 2004, (203) U.S. patent application No. 10/770,363 filed Feb. 2, 2004, (204) U.S. utility patent application Ser. No. 11/068,595, filed on Feb. 28, 2005; (205) U.S. utility patent application Ser. No. 11/070,147, filed on Mar. 2, 2005; (206) U.S. utility patent application Ser. No. 11/071,409, filed on Mar. 2, 2005; (207) U.S. utility patent application Ser. No. 11/071,557, filed on Mar. 3, 2005; (208) U.S. utility patent application Ser. No. 11/072,578, filed on Mar. 4, 2005; (209) U.S. utility patent application Ser. No. 11/072,893, filed on Mar. 4, 2005; (210) U.S. utility patent application Ser. No. 11/072,594, filed on Mar. 4, 2005; (211) U.S. utility patent application Ser. No. 11/074,366, filed on Mar. 7, 2005; (212) U.S. utility patent application Ser. No. 11/074,266, filed on Mar. 7, 2005, (213) U.S. provisional patent application Ser. No. 60/832,909, filed on Jul. 24, 2006. (214) U.S. utility patent application Ser. No. 11/536,302, filed Sep. 28, 2006, and (215) U.S. utility patent application Ser. No. 11/538,228, filed Oct. 3, 2006.

BACKGROUND OF THE INVENTION

This invention relates generally to wellbore casings, and in particular to wellbore casings that are formed using expandable tubing.

Conventionally, when a wellbore is created, a number of casings are installed in the borehole to prevent collapse of the borehole wall and to prevent undesired outflow of drilling fluid into the formation or inflow of fluid from the formation into the borehole. The borehole is drilled in intervals whereby a casing which is to be installed in a lower borehole interval is lowered through a previously installed casing of an upper borehole interval. As a consequence of this procedure the casing of the lower interval is of smaller diameter than the casing of the upper interval. Thus, the casings are in a nested arrangement with casing diameters decreasing in downward direction. Cement annuli are provided between the outer surfaces of the casings and the borehole wall to seal the casings from the borehole wall. As a consequence of this nested arrangement a relatively large borehole diameter is required at the upper part of the wellbore. Such a large borehole diameter involves increased costs due to heavy casing handling equipment, large drill bits and increased volumes of drilling fluid and drill cuttings. Moreover, increased drilling rig time is involved due to required cement pumping, cement hardening, required equipment changes due to large variations in hole diameters drilled in the course of the well, and the large volume of cuttings drilled and removed.

The present invention is directed to overcoming one or more of the limitations of the existing procedures for forming new sections of casing in a wellbore.

SUMMARY OF THE INVENTION

According to one aspect of the present invention, a method of creating a mono-diameter wellbore casing in a borehole located in a subterranean formation including a pre-existing wellbore casing is provided that includes installing a tubular liner and a first expansion cone in the borehole, injecting a fluidic material into the borehole, pressurizing a portion of an interior region of the tubular liner below the first expansion cone, radially expanding at least a portion of the tubular liner in the borehole by extruding at least a portion of the tubular liner off of the first expansion cone, radially expanding an overlap between the preexisting wellbore casing and the tubular liner, and radially expanding the portion of the tubular liner that does not overlap with the preexisting wellbore casing using a second expansion cone.

According to another aspect of the present invention, a system for creating a mono-diameter wellbore casing in a borehole located in a subterranean formation including a preexisting wellbore casing is provided that includes means for installing a tubular liner and a first expansion cone in the borehole, means for injecting a fluidic material into the borehole, means for pressurizing a portion of an interior region of the tubular liner below the first expansion cone, means for radially expanding at least a portion of the tubular liner in the borehole by extruding at least a portion of the tubular liner off of the first expansion cone, means for radially expanding an overlap between the preexisting wellbore casing and the tubular liner, and means for radially expanding the portion of the tubular liner that does not overlap with the preexisting wellbore casing using a second expansion cone.

According to another aspect of the present invention, a method of creating a tubular structure having a substantially constant inside diameter is provided that includes installing a first tubular member and a first expansion cone within a second tubular member, injecting a fluidic material into the second tubular member, pressurizing a portion of an interior region of the first tubular member below the first expansion cone, radially expanding at least a portion of the first tubular member in the second tubular member by extruding at least a portion of the first tubular member off of the first expansion cone, radially expanding an overlap between the first and second tubular members, and radially expanding the portion of the first tubular member that does not overlap with the second tubular member using a second expansion cone.

According to another aspect of the present invention, a system for creating a tubular structure having a substantially constant inside diameter is provided that includes means for installing a first tubular member and a first expansion cone within a second tubular member, means for injecting a fluidic material into the second tubular member, means for pressurizing a portion of an interior region of the first tubular member below the first expansion cone, means for radially expanding at least a portion of the first tubular member in the second tubular member by extruding at least a portion of the first tubular member off of the first expansion cone, means for radially expanding an overlap between the first and second tubular members, and means for radially expanding the portion of the first tubular member that does not overlap with the second tubular member using a second expansion cone.

According to another aspect of the present invention, an apparatus is provided that includes a subterranean formation including a borehole, a wellbore casing coupled to the borehole, and a tubular liner overlappingly coupled to the wellbore casing, wherein the inside diameter of the portion of the wellbore casing that does not overlap with the tubular liner is substantially equal to the inside diameter of the tubular liner, and wherein the tubular liner is coupled to the wellbore casing by a method including installing the tubular liner and a first expansion cone in the borehole, injecting a fluidic material into the borehole, pressurizing a portion of an interior region of the tubular liner below the first expansion cone, radially expanding at least a portion of the tubular liner in the borehole by extruding at least a portion of the tubular liner off of the first expansion cone, radially expanding an overlap between the wellbore casing and the tubular liner, and radially expanding the portion of the tubular liner that does not overlap with the wellbore casing using a second expansion cone.

According to another aspect of the present invention, an apparatus is provided that includes a first tubular member, and a second tubular member overlappingly coupled to the first tubular member, wherein the inside diameter of the portion of the first tubular member that does not overlap with the second tubular member is substantially equal to the inside diameter of the second tubular member, and wherein the second tubular member is coupled to the first tubular member by a method that includes installing the second tubular member and a first expansion cone in the first tubular member, injecting a fluidic material into the first tubular member, pressurizing a portion of an interior region of the second tubular member below the first expansion cone, radially expanding at least a portion of the second tubular member in the first tubular member by extruding at least a portion of the tubular liner off of the first expansion cone, radially expanding an overlap between the first and second tubular members, and radially expanding the portion of the second tubular member that does not overlap with the first tubular member using a second expansion cone.

DETAILED DESCRIPTION OF THE ILLUSTRATIVE EMBODIMENTS

Figure 1:
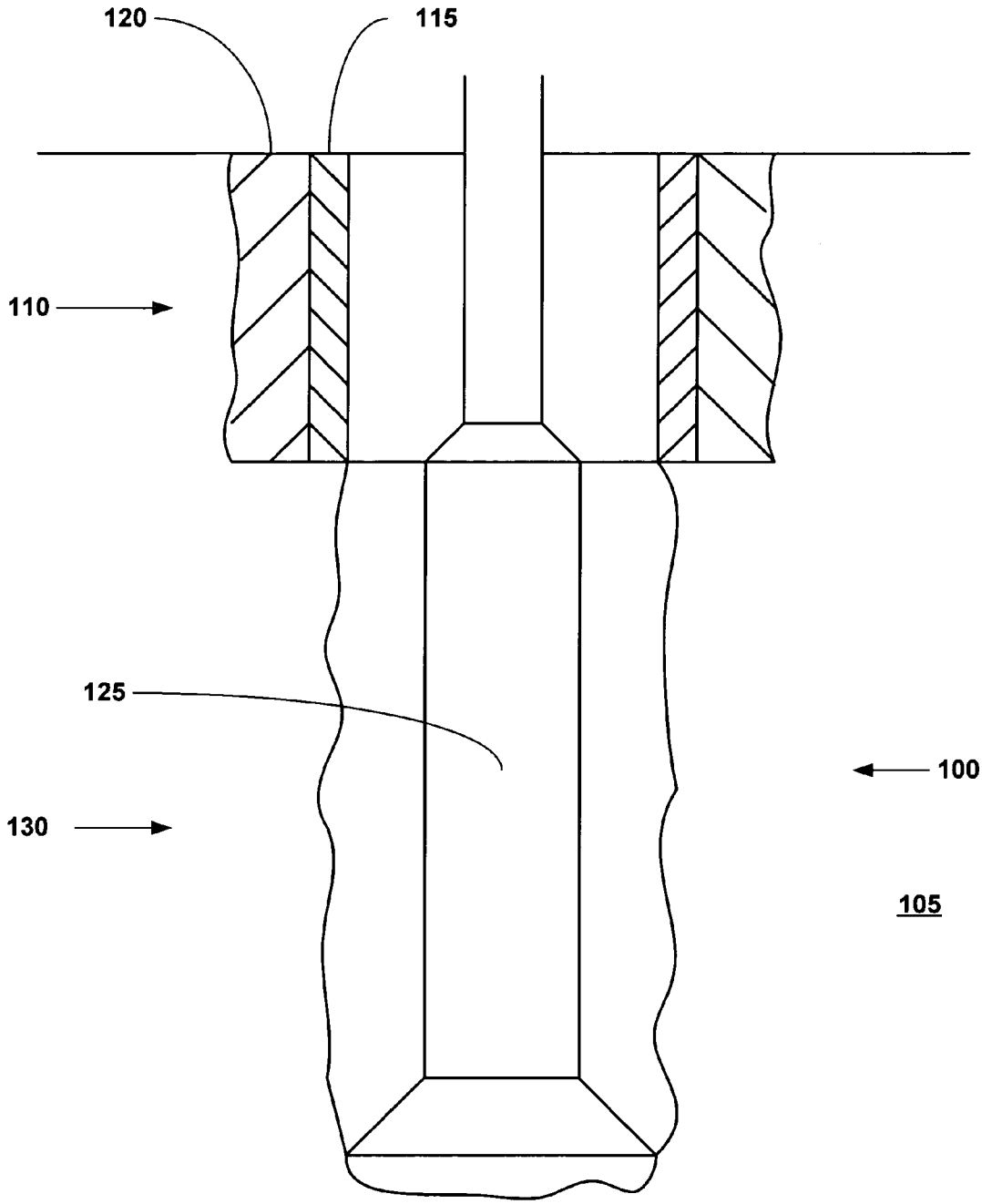
FIG. 1 is a fragmentary cross-sectional view illustrating the drilling of a new section of a well borehole in a borehole including a preexisting section of wellbore casing.

Referring initially to FIGS. 1–10, an embodiment of an apparatus and method for forming a mono-diameter wellbore casing within a subterranean formation will now be described. As illustrated in FIG. 1, a wellbore 100 is positioned in a subterranean formation 105. The wellbore 100 includes a pre-existing cased section 110 having pre-existing wellbore casing 115 and an annular outer layer 120 of a fluidic sealing material such as, for example, cement. The wellbore 100 may be positioned in any orientation from vertical to horizontal. In several alternative embodiments, the pre-existing cased section 110 does not include the annular outer layer 120.

In order to extend the wellbore 100 into the subterranean formation 105, a drill string 125 is used in a well known manner to drill out material from the subterranean formation 105 to form a new wellbore section 130.

Figure 2:
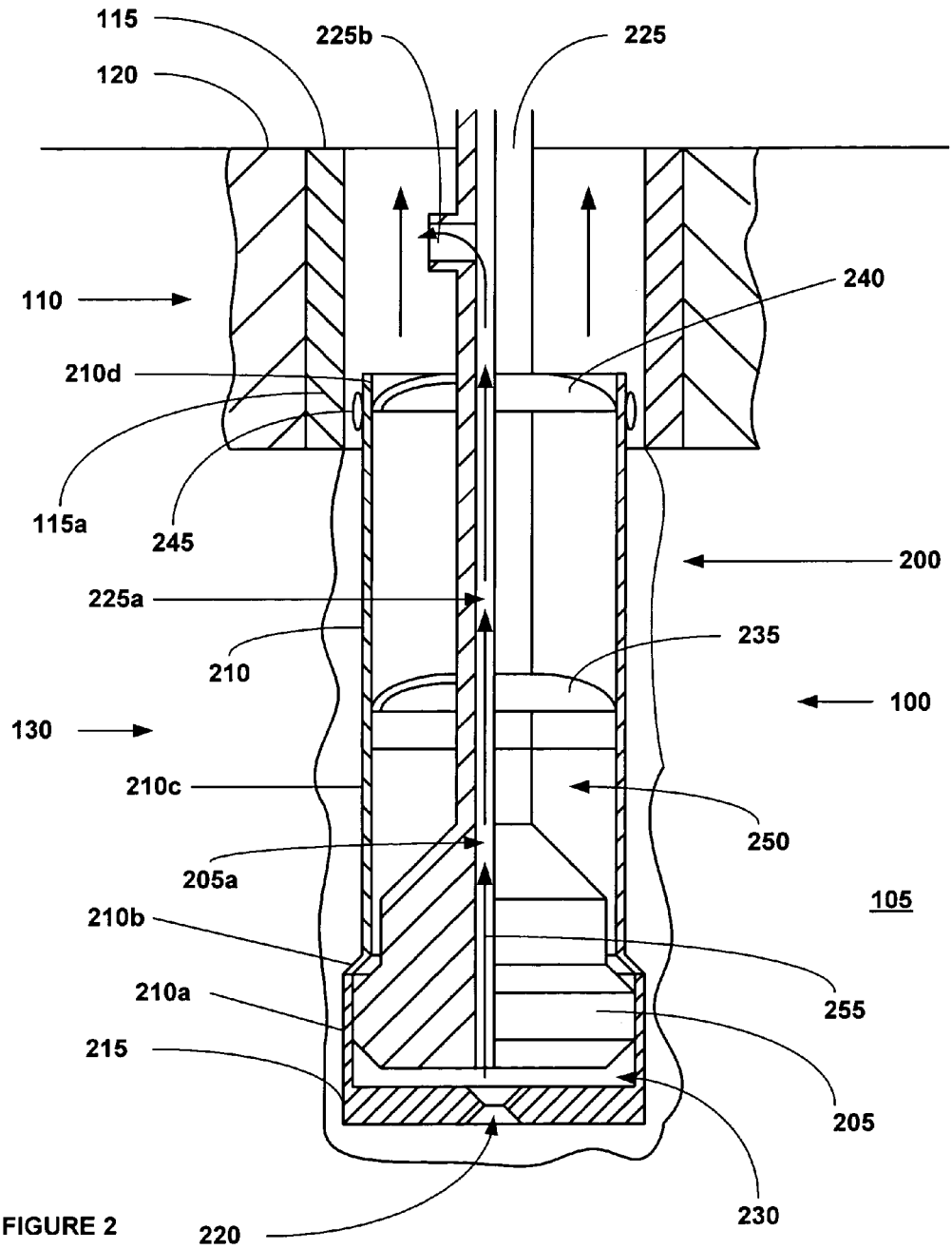
FIG. 2 is a fragmentary cross-sectional view illustrating the placement of an embodiment of an apparatus for creating a casing within the new section of the well borehole of FIG. 1.

As illustrated in FIG. 2, an apparatus 200 for forming a wellbore casing in a subterranean formation is then positioned in the new section 130 of the wellbore 100 that includes tubular expansion cone 205 having a fluid passage 205*a* that supports an expandable tubular member 210 that includes a lower portion 210*a*, an intermediate portion 210*b*, an upper portion 210*c*, and an upper end portion 210*d*.

The tubular expansion cone 205 may be any number of conventional commercially available expansion cones or devices. In several alternative embodiments, the tubular expansion cone 205 may be controllably expandable in the radial direction, for example, as disclosed in U.S. Pat. Nos. 5,348,095, and/or 6,012,523, the disclosures of which are incorporated herein by reference. In an exemplary embodiment, the expansion cone 205 may also be rotable.

The expandable tubular member 210 may be fabricated from any number of conventional commercially available materials such as, for example, Oilfield Country Tubular Goods (OCTG), 13 chromium steel tubing/casing, or plastic tubing/casing. In an exemplary embodiment, the expandable tubular member 210 is fabricated from OCTG in order to maximize strength after expansion. In several alternative embodiments, the expandable tubular member 210 may be solid and/or slotted. In an exemplary embodiment, the length of the expandable tubular member 210 is limited to minimize the possibility of buckling. For typical expandable tubular member 210 materials, the length of the expandable tubular member 210 is preferably limited to between about 40 to 20,000 feet in length.

The lower portion 210*a* of the expandable tubular member 210 preferably has a larger inside diameter than the upper portion 210*c* of the expandable tubular member. In an exemplary embodiment, the wall thickness of the intermediate portion 210*b* of the expandable tubular member 210 is less than the wall thickness of the upper portion 210*c* of the expandable tubular member in order to facilitate the initiation of the radial expansion process. In an exemplary embodiment, the upper end portion 210*d* of the expandable tubular member 210 is slotted, perforated, or otherwise modified to catch or slow down the expansion cone 205 when it completes the extrusion of expandable tubular member 210.

A shoe 215 is coupled to the lower portion 210*a* of the expandable tubular member. The shoe 215 includes a valveable fluid passage 220 that is preferably adapted to receive a plug, dart, or other similar element for controllably sealing the fluid passage 220. In this manner, the fluid passage 220 may be optimally sealed off by introducing a plug, dart and/or ball sealing elements into the fluid passage 240.

The shoe 215 may be any number of conventional commercially available shoes such as, for example, Super Seal II float shoe, Super Seal II Down-Jet float shoe or a guide shoe with a sealing sleeve for a latch down plug modified in accordance with the teachings of the present disclosure. In an exemplary embodiment, the shoe 215 is an aluminum down-jet guide shoe with a sealing sleeve for a latch-down plug available from Halliburton Energy Services in Dallas, Tex., modified in accordance with the teachings of the present disclosure, in order to optimally guide the expandable tubular member 210 in the wellbore, optimally provide an adequate seal between the interior and exterior diameters of the overlapping joint between the tubular members, and to optimally allow the complete drill out of the shoe and plug after the completion of the cementing and expansion operations.

In an exemplary embodiment, the shoe 215 further includes one or more through and side outlet ports in fluidic communication with the fluid passage 220. In this manner, the shoe 215 optimally injects hardenable fluidic sealing material into the region outside the shoe 215 and expandable tubular member 210.

A support member 225 having fluid passages 225*a* and 225*b* is coupled to the expansion cone 205 for supporting the apparatus 200. The fluid passage 225*a* is preferably fluidicly coupled to the fluid passage 205*a*. In this manner, fluidic materials may be conveyed to and from a region 230 below the expansion cone 205 and above the bottom of the shoe 215. The fluid passage 225*b* is preferably fluidicly coupled to the fluid passage 225*a* and includes a conventional control valve. In this manner, during placement of the apparatus 200 within the wellbore 100, surge pressures can be relieved by the fluid passage 225*b*. In an exemplary embodiment, the support member 225 further includes one or more conventional centralizers (not illustrated) to help stabilize the apparatus 200.

During placement of the apparatus 200 within the wellbore 100, the fluid passage 225*a* is preferably selected to transport materials such as, for example, drilling mud or formation fluids at flow rates and pressures ranging from about 0 to 3,000 gallons/minute and 0 to 9,000 psi in order to minimize drag on the tubular member being run and to minimize surge pressures exerted on the wellbore 130 which could cause a loss of wellbore fluids and lead to hole collapse. During placement of the apparatus 200 within the wellbore 100, the fluid passage 225*b* is preferably selected to convey fluidic materials at flow rates and pressures ranging from about 0 to 3,000 gallons/minute and 0 to 9,000 psi in order to reduce the drag on the apparatus 200 during insertion into the new section 130 of the wellbore 100 and to minimize surge pressures on the new wellbore section 130.

A lower cup seal 235 is coupled to and supported by the support member 225. The lower cup seal 235 prevents foreign materials from entering the interior region of the expandable tubular member 210 adjacent to the expansion cone 205. The lower cup seal 235 may be any number of conventional commercially available cup seals such as, for example, TP cups, or Selective Injection Packer (SIP) cups modified in accordance with the teachings of the present disclosure. In an exemplary embodiment, the lower cup seal 235 is a SIP cup seal, available from Halliburton Energy Services in Dallas, Tex. in order to optimally block foreign material and contain a body of lubricant.

The upper cup seal 240 is coupled to and supported by the support member 225. The upper cup seal 240 prevents foreign materials from entering the interior region of the expandable tubular member 210. The upper cup seal 240 may be any number of conventional commercially available cup seals such as, for example, TP cups or SIP cups modified in accordance with the teachings of the present disclosure. In an exemplary embodiment, the upper cup seal 240 is a SIP cup, available from Halliburton Energy Services in Dallas, Tex. in order to optimally block the entry of foreign materials and contain a body of lubricant.

One or more sealing members 245 are coupled to and supported by the exterior surface of the upper end portion 210*d* of the expandable tubular member 210. The seal members 245 preferably provide an overlapping joint between the lower end portion 115*a* of the casing 115 and the portion 260 of the expandable tubular member 210 to be fluidicly sealed. The sealing members 245 may be any number of conventional commercially available seals such as, for example, lead, rubber, Teflon, or epoxy seals modified in accordance with the teachings of the present disclosure. In an exemplary embodiment, the sealing members 245 are molded from Stratalock epoxy available from Halliburton Energy Services in Dallas, Tex. in order to optimally provide a load bearing interference fit between the upper end portion 210*d* of the expandable tubular member 210 and the lower end portion 115*a* of the existing casing 115.

In an exemplary embodiment, the sealing members 245 are selected to optimally provide a sufficient frictional force to support the expanded tubular member 210 from the existing casing 115. In an exemplary embodiment, the frictional force optimally provided by the sealing members 245 ranges from about 1,000 to 1,000,000 lbf in order to optimally support the expanded tubular member 210.

In an exemplary embodiment, a quantity of lubricant 250 is provided in the annular region above the expansion cone 205 within the interior of the expandable tubular member 210. In this manner, the extrusion of the expandable tubular member 210 off of the expansion cone 205 is facilitated. The lubricant 250 may be any number of conventional commercially available lubricants such as, for example, Lubriplate, chlorine based lubricants, oil based lubricants or Climax 1500 Antisieze 3100). In an exemplary embodiment, the lubricant 250 is Climax 1500 Antisieze 3100) available from Climax Lubricants and Equipment Co. in Houston, Tex. in order to optimally provide optimum lubrication to facilitate the expansion process.

In an exemplary embodiment, the support member 225 is thoroughly cleaned prior to assembly to the remaining portions of the apparatus 200. In this manner, the introduction of foreign material into the apparatus 200 is minimized. This minimizes the possibility of foreign material clogging the various flow passages and valves of the apparatus 200.

In an exemplary embodiment, before or after positioning the apparatus 200 within the new section 130 of the wellbore 100, a couple of wellbore volumes are circulated in order to ensure that no foreign materials are located within the wellbore 100 that might clog up the various flow passages and valves of the apparatus 200 and to ensure that no foreign material interferes with the expansion process.

As illustrated in FIG. 2, in an exemplary embodiment, during placement of the apparatus 200 within the wellbore 100, fluidic materials 255 within the wellbore that are displaced by the apparatus are conveyed through the fluid passages 220, 205*a*, 225*a*, and 225*b*. In this manner, surge pressures created by the placement of the apparatus within the wellbore 100 are reduced.

Figure 3:
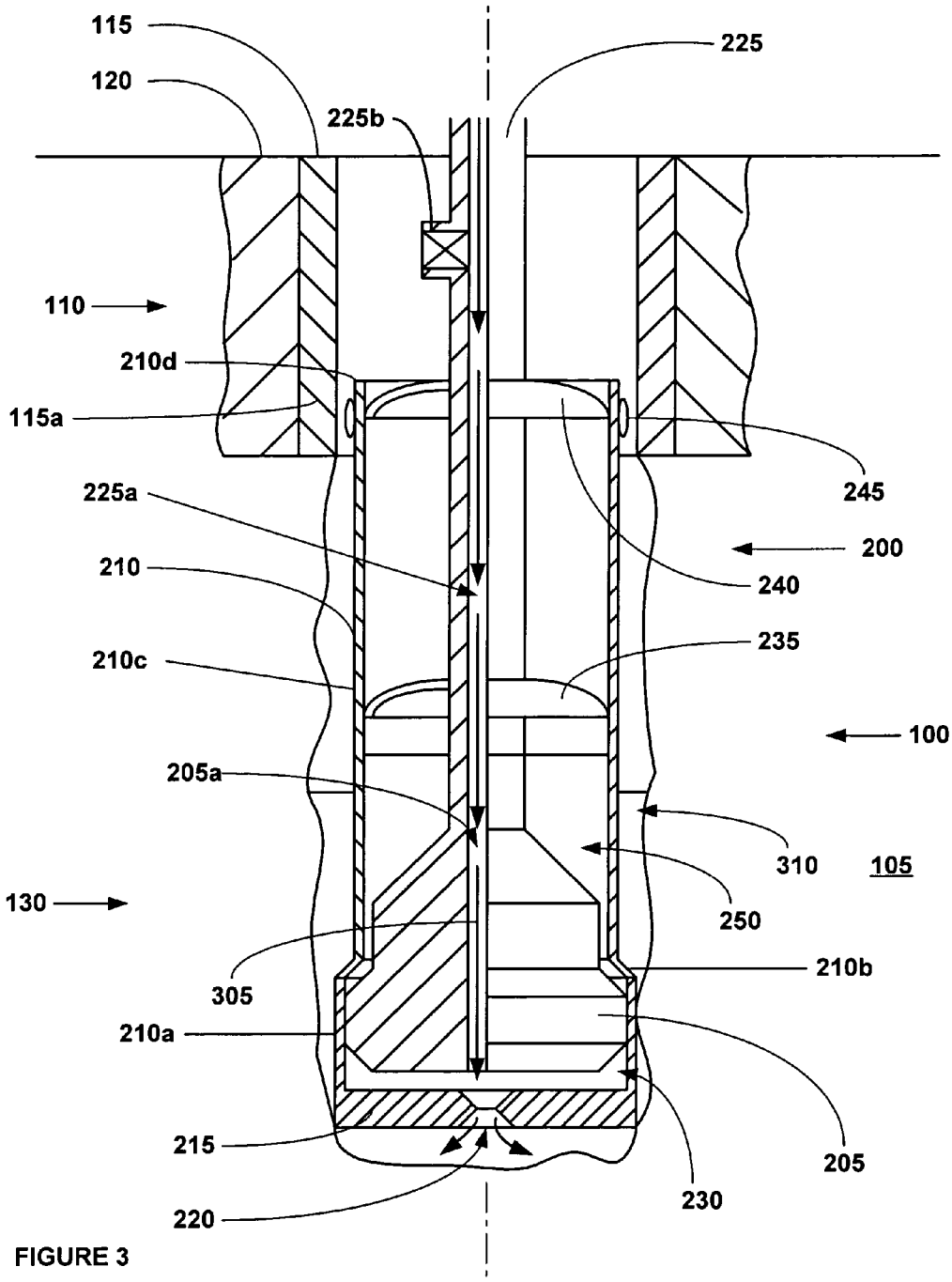
FIG. 3 is a fragmentary cross-sectional view illustrating the injection of a hardenable fluidic sealing material into the new section of the well borehole of FIG. 2.

As illustrated in FIG. 3, the fluid passage 225*b* is then closed and a hardenable fluidic sealing material 305 is then pumped from a surface location into the fluid passages 225*a* and 205*a*. The material 305 then passes from the fluid passage 205*a* into the interior region 230 of the expandable tubular member 210 below the expansion cone 205. The material 305 then passes from the interior region 230 into the fluid passage 220. The material 305 then exits the apparatus 200 and fills an annular region 310 between the exterior of the expandable tubular member 210 and the interior wall of the new section 130 of the wellbore 100. Continued pumping of the material 305 causes the material 305 to fill up at least a portion of the annular region 310.

The material 305 is preferably pumped into the annular region 310 at pressures and flow rates ranging, for example, from about 0 to 5000 psi and 0 to 1,500 gallons/min, respectively. The optimum flow rate and operating pressures vary as a function of the casing and wellbore sizes, wellbore section length, available pumping equipment, and fluid properties of the fluidic material being pumped. The optimum flow rate and operating pressure are preferably determined using conventional empirical methods.

The hardenable fluidic sealing material 305 may be any number of conventional commercially available hardenable fluidic sealing materials such as, for example, slag mix, cement or epoxy. In an exemplary embodiment, the hardenable fluidic sealing material 305 is a blended cement prepared specifically for the particular well section being drilled from Halliburton Energy Services in Dallas, Tex. in order to provide optimal support for expandable tubular member 210 while also maintaining optimum flow characteristics so as to minimize difficulties during the displacement of cement in the annular region 315. The optimum blend of the blended cement is preferably determined using conventional empirical methods. In several alternative embodiments, the hardenable fluidic sealing material 305 is compressible before, during, or after curing.

The annular region 310 preferably is filled with the material 305 in sufficient quantities to ensure that, upon radial expansion of the expandable tubular member 210, the annular region 310 of the new section 130 of the wellbore 100 will be filled with the material 305.

In an alternative embodiment, the injection of the material 305 into the annular region 310 is omitted.

Figure 4:
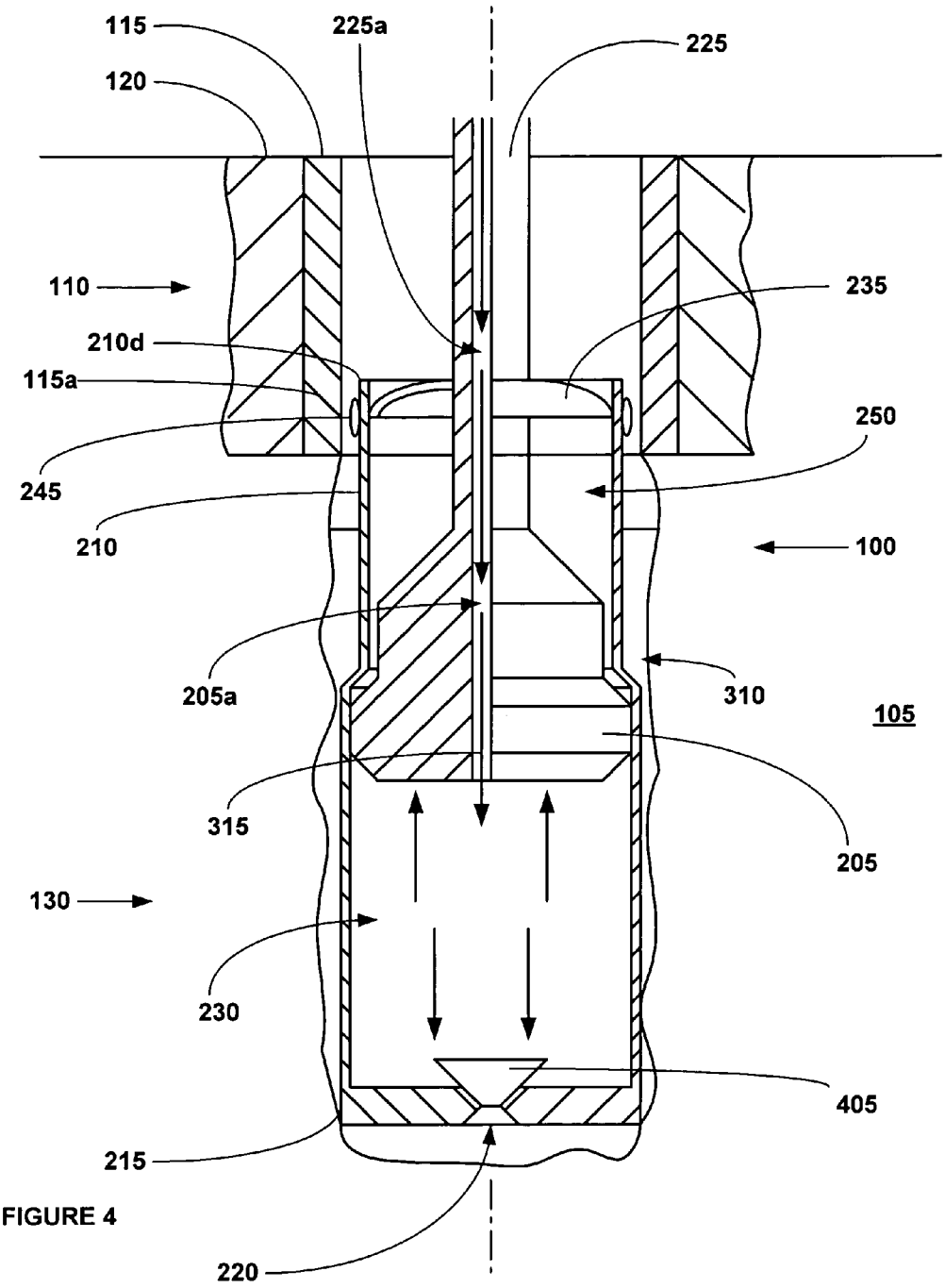
FIG. 4 is a fragmentary cross-sectional view illustrating the injection of a fluidic material into the new section of the well borehole of FIG. 3.

As illustrated in FIG. 4, once the annular region 310 has been adequately filled with the material 305, a plug 405, or other similar device, is introduced into the fluid passage 220, thereby fluidicly isolating the interior region 230 from the annular region 310. In an exemplary embodiment, a non-hardenable fluidic material 315 is then pumped into the interior region 230 causing the interior region to pressurize. In this manner, the interior region 230 of the expanded tubular member 210 will not contain significant amounts of cured material 305. This also reduces and simplifies the cost of the entire process. Alternatively, the material 305 may be used during this phase of the process.

Once the interior region 230 becomes sufficiently pressurized, the expandable tubular member 210 is preferably plastically deformed, radially expanded, and extruded off of the expansion cone 205. During the extrusion process, the expansion cone 205 may be raised out of the expanded portion of the expandable tubular member 210. In an exemplary embodiment, during the extrusion process, the expansion cone 205 is raised at approximately the same rate as the expandable tubular member 210 is expanded in order to keep the expandable tubular member 210 stationary relative to the new wellbore section 130. In an alternative preferred embodiment, the extrusion process is commenced with the expandable tubular member 210 positioned above the bottom of the new wellbore section 130, keeping the expansion cone 205 stationary, and allowing the expandable tubular member 210 to extrude off of the expansion cone 205 and into the new wellbore section 130 under the force of gravity and the operating pressure of the interior region 230.

The plug 405 is preferably placed into the fluid passage 220 by introducing the plug 405 into the fluid passage 225*a* at a surface location in a conventional manner. The plug 405 preferably acts to fluidicly isolate the hardenable fluidic sealing material 305 from the non hardenable fluidic material 315.

The plug 405 may be any number of conventional commercially available devices from plugging a fluid passage such as, for example, Multiple Stage Cementer (MSC) latch-down plug, Omega latch-down plug or three-wiper latch-down plug modified in accordance with the teachings of the present disclosure. In an exemplary embodiment, the plug 405 is a MSC latch-down plug available from Halliburton Energy Services in Dallas, Tex.

After placement of the plug 405 in the fluid passage 220, the non hardenable fluidic material 315 is preferably pumped into the interior region 310 at pressures and flow rates ranging, for example, from approximately 400 to 10,000 psi and 30 to 4,000 gallons/min. In this manner, the amount of hardenable fluidic sealing material within the interior 230 of the expandable tubular member 210 is minimized. In an exemplary embodiment, after placement of the plug 405 in the fluid passage 220, the non hardenable material 315 is preferably pumped into the interior region 230 at pressures and flow rates ranging from approximately 500 to 9,000 psi and 40 to 3,000 gallons/min in order to maximize the extrusion speed.

In an exemplary embodiment, the apparatus 200 is adapted to minimize tensile, burst, and friction effects upon the expandable tubular member 210 during the expansion process. These effects will be depend upon the geometry of the expansion cone 205, the material composition of the expandable tubular member 210 and expansion cone 205, the inner diameter of the expandable tubular member, the wall thickness of the expandable tubular member, the type of lubricant, and the yield strength of the expandable tubular member. In general, the thicker the wall thickness, the smaller the inner diameter, and the greater the yield strength of the expandable tubular member 210, then the greater the operating pressures required to extrude the expandable tubular member 210 off of the expansion cone 205.

In an exemplary embodiment, the extrusion of the expandable tubular member off of the expansion cone 205 will begin when the pressure of the interior region 230 reaches, for example, approximately 500 to 9,000 psi.

During the extrusion process, the expansion cone 205 may be raised out of the expanded portion of the expandable tubular member 210 at rates ranging, for example, from about 0 to 5 ft/sec. In an exemplary embodiment, during the extrusion process, the expansion cone 205 is raised out of the expanded portion of the expandable tubular member 210 at rates ranging from about 0 to 2 ft/sec in order to minimize the time required for the expansion process while also permitting easy control of the expansion process.

When the upper end portion 210*d* of the expandable tubular member 210 is extruded off of the expansion cone 205, the outer surface of the upper end portion 210*d* of the expandable tubular member 210 will preferably contact the interior surface of the lower end portion 115*a* of the wellbore casing 115 to form an fluid tight overlapping joint. The contact pressure of the overlapping joint may range, for example, from approximately 50 to 20,000 psi. In an exemplary embodiment, the contact pressure of the overlapping joint ranges from approximately 400 to 10,000 psi in order to provide optimum pressure to activate the annular sealing members 245 and optimally provide resistance to axial motion to accommodate typical tensile and compressive loads.

The overlapping joint between the pre-existing wellbore casing 115 and the radially expanded expandable tubular member 210 preferably provides a gaseous and fluidic seal. In a particularly preferred embodiment, the sealing members 245 optimally provide a fluidic and gaseous seal in the overlapping joint. In an alternative embodiment, the sealing members 245 are omitted.

In an exemplary embodiment, the operating pressure and flow rate of the non-hardenable fluidic material 315 is controllably ramped down when the expansion cone 205 reaches the upper end portion 210*d* of the expandable tubular member 210. In this manner, the sudden release of pressure caused by the complete extrusion of the expandable tubular member 210 off of the expansion cone 205 can be minimized. In an exemplary embodiment, the operating pressure is reduced in a substantially linear fashion from 100% to about 10% during the end of the extrusion process beginning when the expansion cone 205 is within about 5 feet from completion of the extrusion process.

Alternatively, or in combination, a shock absorber is provided in the support member 225 in order to absorb the shock caused by the sudden release of pressure. The shock absorber may, for example, be any conventional commercially available shock absorber adapted for use in wellbore operations.

Alternatively, or in combination, an expansion cone catching structure is provided in the upper end portion 210*d* of the expandable tubular member 210 in order to catch or at least decelerate the expansion cone 205.

Once the extrusion process is completed, the expansion cone 205 is removed from the wellbore 100. In an exemplary embodiment, either before or after the removal of the expansion cone 205, the integrity of the fluidic seal of the overlapping joint between the upper end portion 210*d* of the expandable tubular member 210 and the lower end portion 115*a* of the pre-existing wellbore casing 115 is tested using conventional methods.

In an exemplary embodiment, if the fluidic seal of the overlapping joint between the upper end portion 210*d* of the expandable tubular member 210 and the lower end portion 115*a* of the casing 115 is satisfactory, then any uncured portion of the material 305 within the expanded expandable tubular member 210 is then removed in a conventional manner such as, for example, circulating the uncured material out of the interior of the expanded tubular member 210. The expansion cone 205 is then pulled out of the wellbore section 130 and a drill bit or mill is used in combination with a conventional drilling assembly 505 to drill out any hardened material 305 within the expandable tubular member 210. In an exemplary embodiment, the material 305 within the annular region 310 is then allowed to fully cure.

Figure 5:
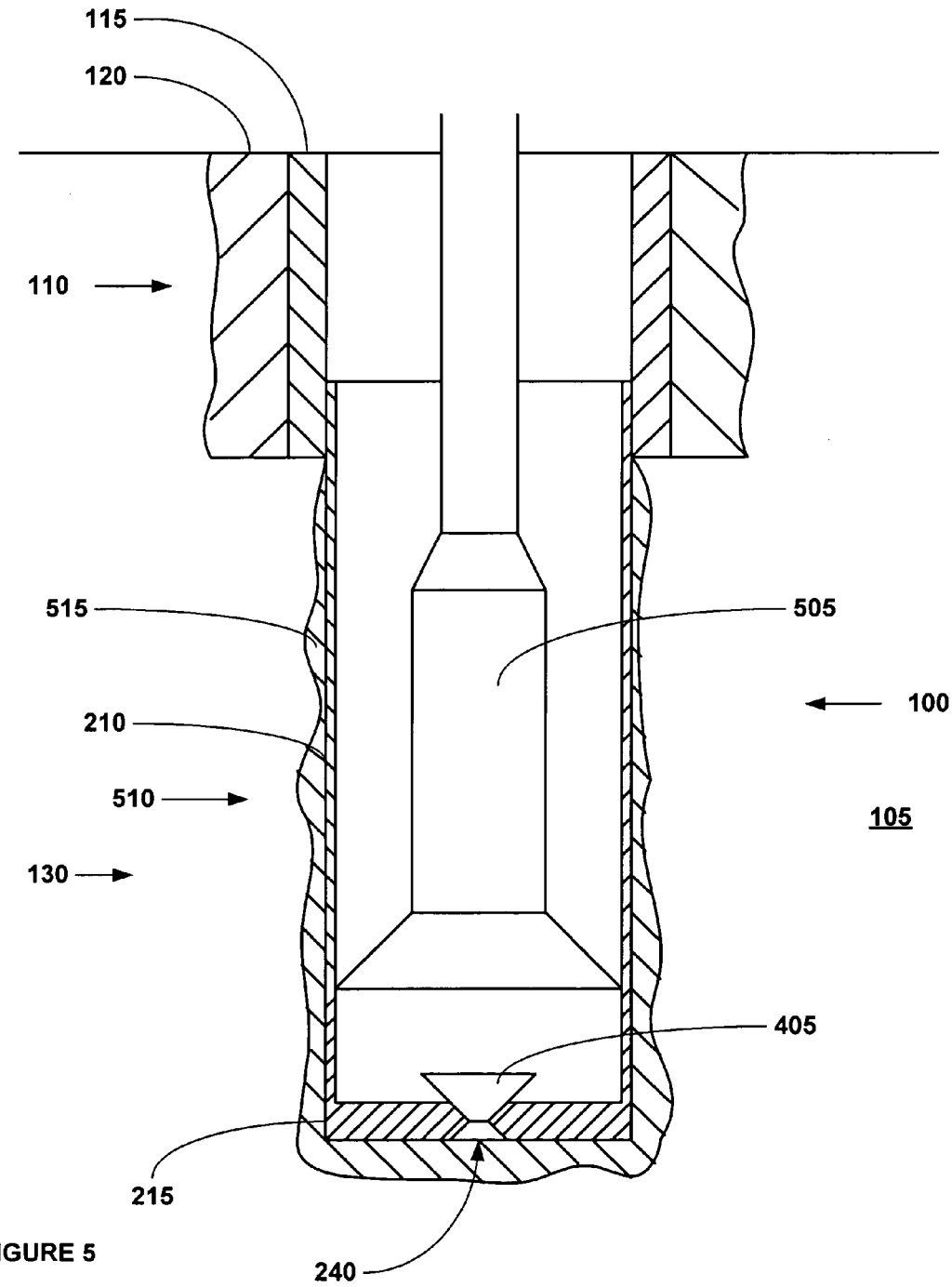
FIG. 5 is a fragmentary cross-sectional view illustrating the drilling out of the cured hardenable fluidic sealing material and the shoe from the new section of the well borehole of FIG. 4.

As illustrated in FIG. 5, preferably any remaining cured material 305 within the interior of the expanded tubular member 210 is then removed in a conventional manner using a conventional drill string 505. The resulting new section of casing 510 preferably includes the expanded tubular member 210 and an outer annular layer 515 of the cured material 305.

Figure 6:
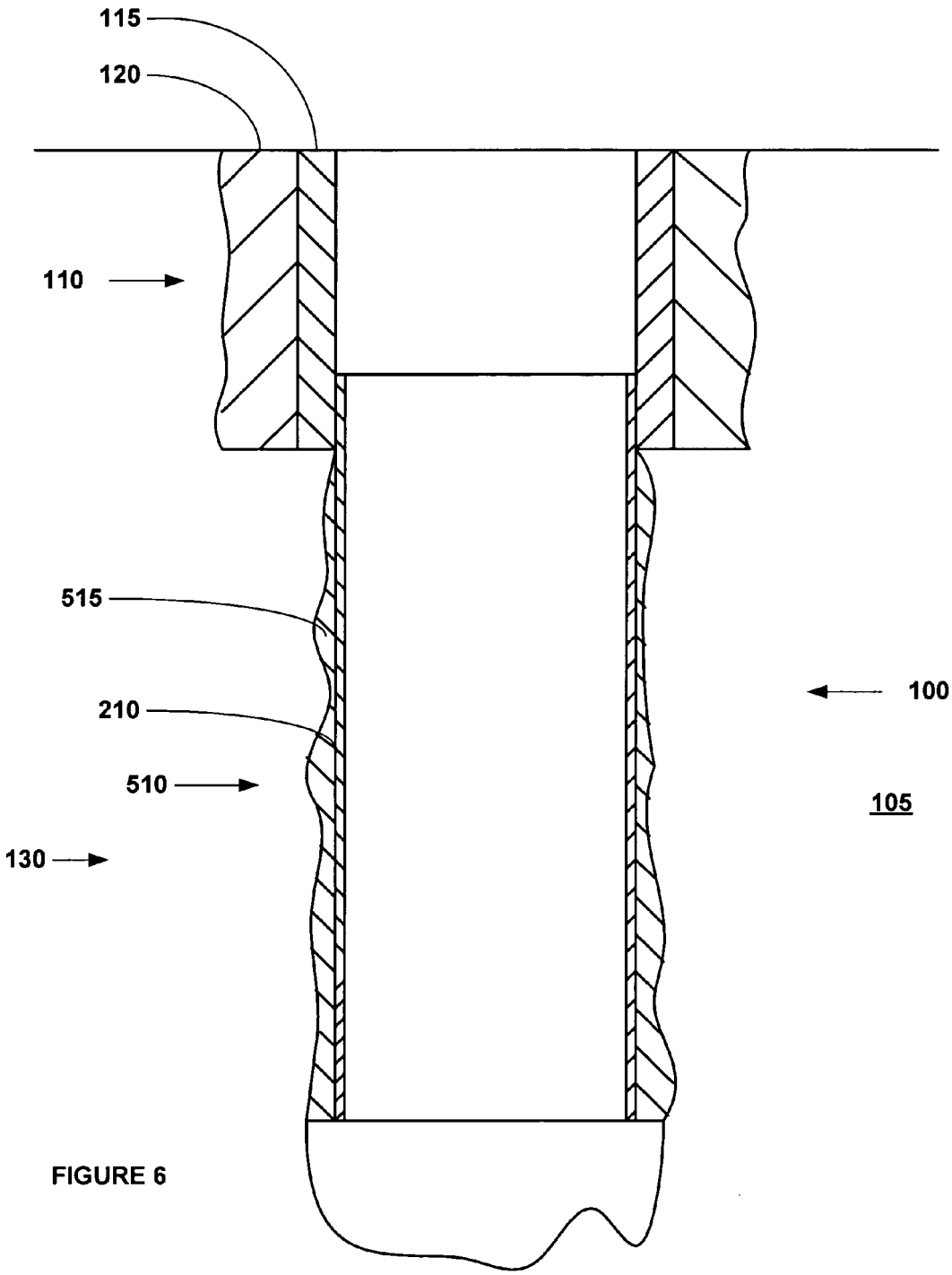
FIG. 6 is a cross-sectional view of the well borehole of FIG. 5 following the drilling out of the shoe.

As illustrated in FIG. 6, the bottom portion of the apparatus 200 including the shoe 215 and dart 405 may then be removed by drilling out the shoe 215 and dart 405 using conventional drilling methods.

Figure 7:
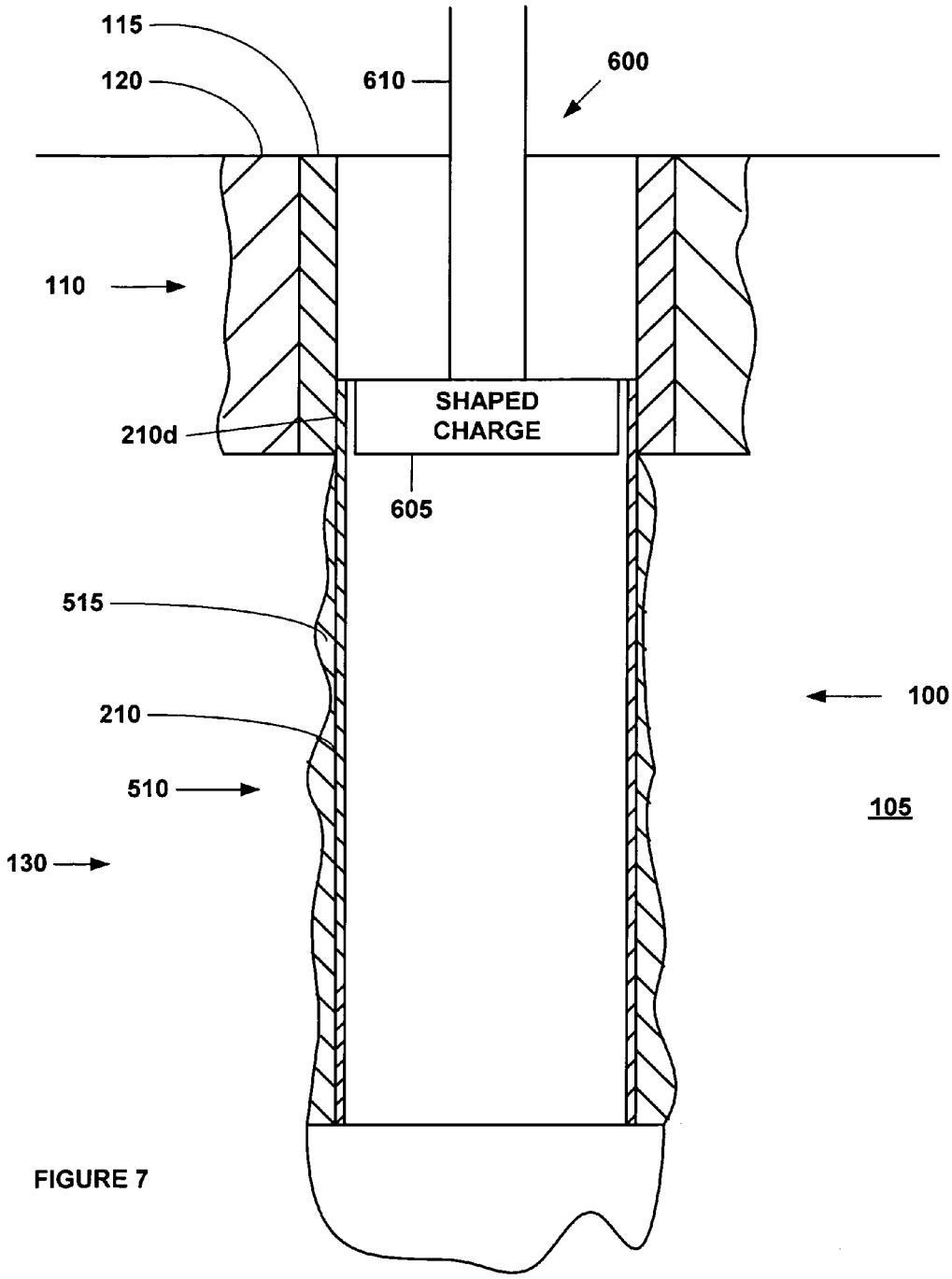
FIG. 7 is fragmentary cross-sectional illustration of the well borehole of FIG. 6 after positioning a shaped charge within the overlap between the expandable tubular member and the preexisting wellbore casing.

As illustrated in FIG. 7, an apparatus 600 for radially expanding and plastically deforming the overlap between the lower portion of the preexisting wellbore casing 115 and the upper portion 210*d* of the expandable tubular member 210 may then be positioned within the borehole 110 that includes a shaped charge 605 that is coupled to an end of a tubular member 610. In an exemplary embodiment, the shaped charge 605 is positioned within the overlap between the lower portion of the preexisting wellbore casing 115 and the upper portion 210*d* of the expandable tubular member 210.

Figure 8:
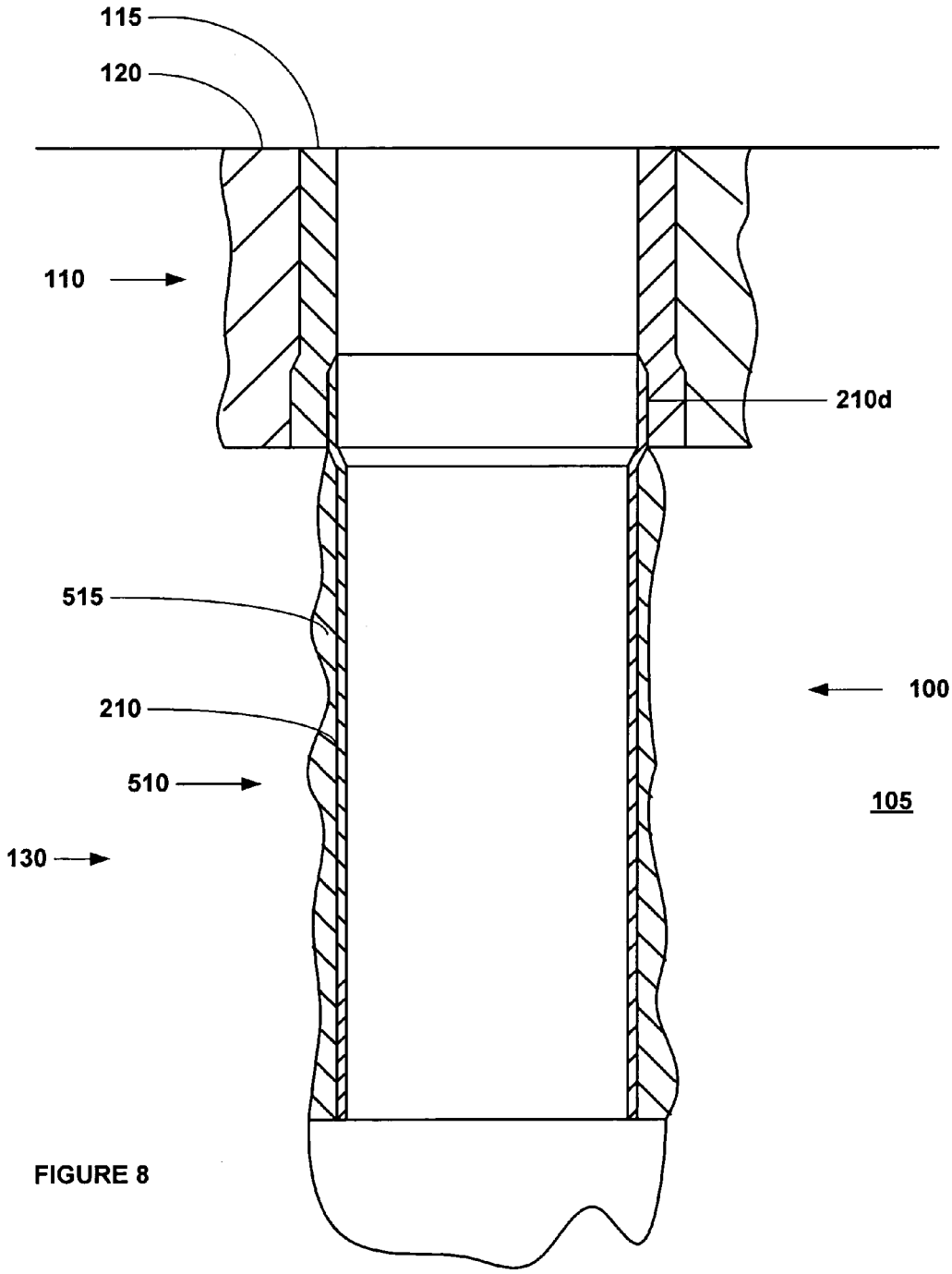
FIG. 8 is a cross-sectional illustration of the well borehole of FIG. 7 after detonating the shaped charge to plastically deform and radially expand the overlap between the expandable tubular member and the preexisting wellbore casing.

As illustrated in FIG. 8, the shaped charge 605 is then detonated in a conventional manner to plastically deform and radially expand the overlap between the lower portion of the preexisting wellbore casing 115 and the upper portion 210*d* of the expanded tubular member 210. As a result, the inside diameter of the upper portion 210*d* of the expanded tubular member 210 is substantially equal to the inside diameter of the portion of the preexisting wellbore casing 115 that does not overlap with the upper portion of the expanded tubular member. In several alternative embodiments, one or more conventional devices for generating impulsive radially directed forces may be substituted for, or used in combination with, the shaped charge 605.

Figure 9:
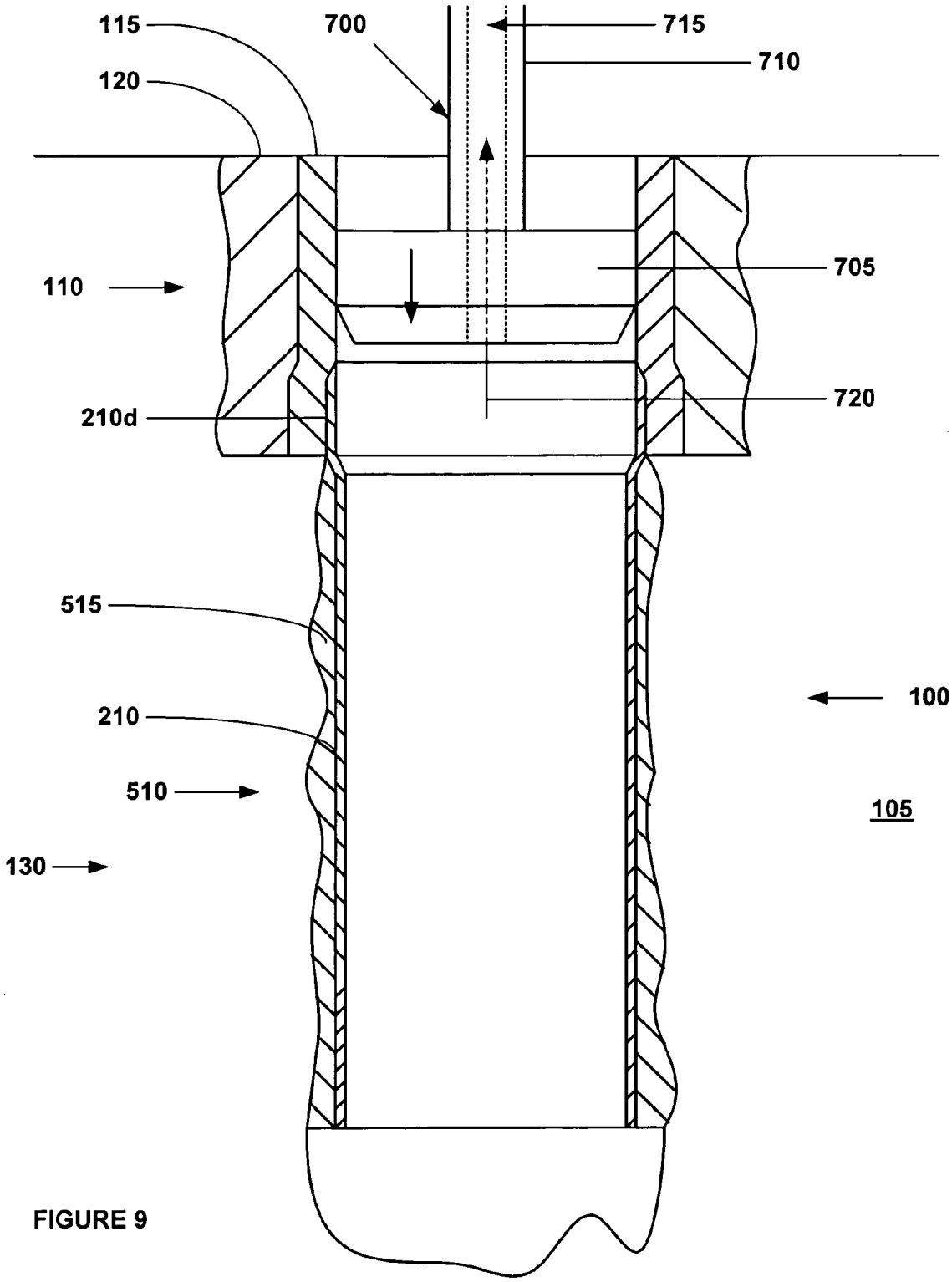
FIG. 9 is a fragmentary cross-sectional view of the placement and actuation of an expansion cone within the well borehole of FIG. 8 to form a mono-diameter wellbore casing.

As illustrated in FIG. 9, an apparatus 700 for forming a mono-diameter wellbore casing is then positioned within the wellbore casing 115 proximate upper end 210*d* of the expandable tubular member 210 that includes a tubular expansion cone 705 coupled to an end of a tubular support member 710. In an exemplary embodiment, the outside diameter of the tubular expansion cone 705 is substantially equal to the inside diameter of the wellbore casing 115. The tubular expansion cone 705 and the tubular support member 710 together define a fluid passage 715 for conveying fluidic materials 720 out of the wellbore 100 that are displaced by the placement and operation of the tubular expansion cone 705.

Figure 10:
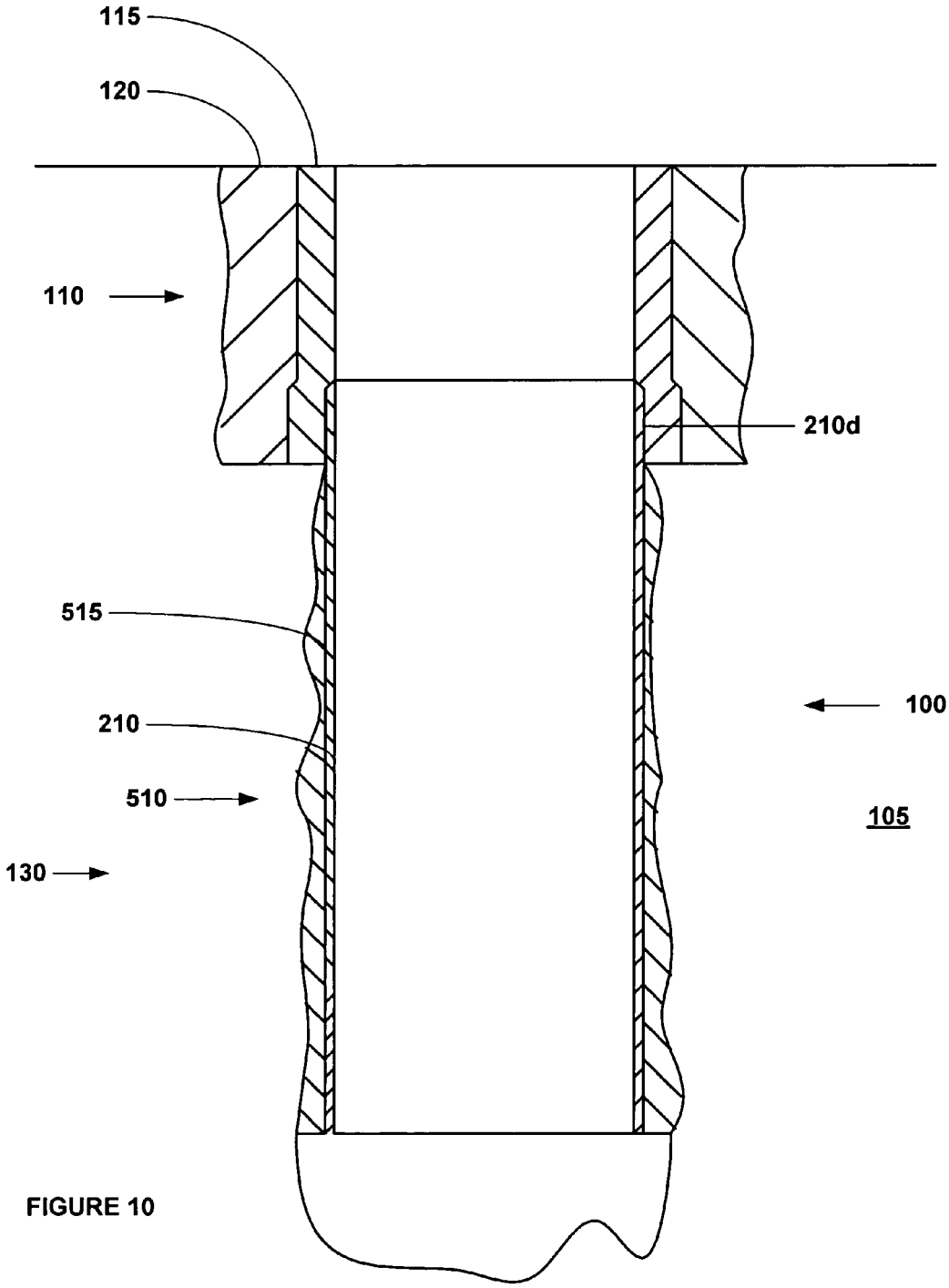
FIG. 10 is a cross-sectional illustration of the well borehole of FIG. 9 following the formation of a mono-diameter wellbore casing.
Figure 11:
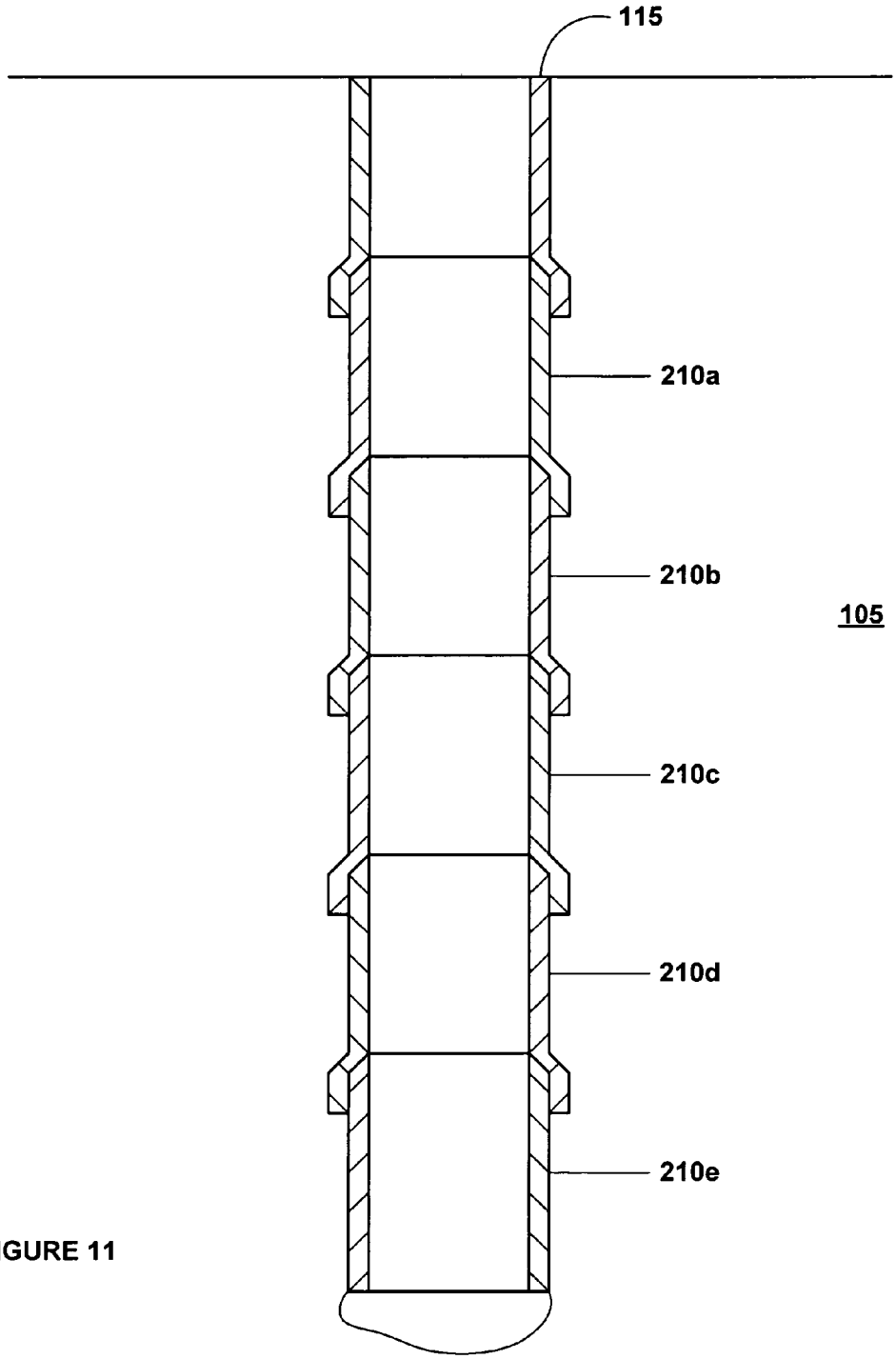
FIG. 11 is a cross-sectional illustration of the well borehole of FIG. 10 following the repeated operation of the methods of FIGS. 1–10 in order to form a mono-diameter wellbore casing including a plurality of overlapping wellbore casings.

The tubular expansion cone 705 is then driven downward using the support member 710 in order to radially expand and plastically deform the portion of the expandable tubular member 210 that does not overlap with the wellbore casing 115. In this manner, as illustrated in FIG. 10, a mono-diameter wellbore casing is formed that includes the overlapping wellbore casings 115 and 210. In several alternative embodiments, the secondary radial expansion process illustrated in FIGS. 9 and 10 is performed before, during, or after the material 515 fully cures. In several alternative embodiments, a conventional expansion device including rollers may be substituted for, or used in combination with, the apparatus 700. In an exemplary embodiment, the downward displacement of the tubular expansion cone 705 also at least partially radially expands and plastically deforms the portions of the pre-existing wellbore casing 115 and the upper portion 210*d* of the expandable tubular member that overlap with one another, More generally, as illustrated in FIG. 11, the method of FIGS. 1–10 is repeatedly performed in order to provide a mono-diameter wellbore casing that includes overlapping wellbore casings 115 and 210*a*–210*e*. The wellbore casings 115, and 210*a*–210*e* preferably include outer annular layers of fluidic sealing material. In this manner, a mono-diameter wellbore casing may be formed within the subterranean formation that extends for tens of thousands of feet. More generally still, the teachings of FIGS. 1–11 may be used to form a mono-diameter wellbore casing, a pipeline, a structural support, or a tunnel within a subterranean formation at any orientation from the vertical to the horizontal.

In an exemplary embodiment, the formation of the mono-diameter wellbore casing, as illustrated in FIGS. 1–11, is further provided as disclosed in one or more of the following: (1) U.S. Pat. No. 6,497,289, which was filed as U.S. patent application Ser. No. 09/454,139, filed on Dec. 3, 1999, which claims priority from provisional application 60/111,293, filed on Dec. 7, 1998, (2) U.S. patent application Ser. No. 09/510,913, filed on Feb. 23, 2000, which claims priority from provisional application 60/121,702, filed on Feb. 25, 1999, (3) U.S. patent application Ser. No. 09/502,350, filed on Feb. 10, 2000, which claims priority from provisional application 60/119,611, filed on Feb. 11, 1999, (4) U.S. Pat. No. 6,328,113, which was filed as U.S. patent application Ser. No. 09/440,338, filed on Nov. 15, 1999, which claims priority from provisional application 60/108,558, filed on Nov. 16, 1998, (5) U.S. patent application Ser. No. 10/169,434, filed on Jul. 1, 2002, which claims priority from provisional application 60/183,546, filed on Feb. 18, 2000, (6) U.S. patent application Ser. No. 09/523,468, filed on Mar. 10, 2000, which claims priority from provisional application 60/124,042, filed on Mar. 11, 1999, (7) U.S. Pat. No. 6,568,471, which was filed as patent application Ser. No. 09/512,895, filed on Feb. 24, 2000, which claims priority from provisional application 60/121,841, filed on Feb. 26, 1999, (8) U.S. Pat. No. 6,575,240, which was filed as patent application Ser. No. 09/511,941, filed on Feb. 24, 2000, which claims priority from provisional application 60/121,907, filed on Feb. 26, 1999, (9) U.S. Pat. No. 6,557,640, which was filed as patent application Ser. No. 09/588,946, filed on Jun. 7, 2000, which claims priority from provisional application 60/137,998, filed on Jun. 7, 1999, (10) U.S. patent application Ser. No. 09/981,916, filed on Oct. 18, 2001 as a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (11) U.S. Pat. No. 6,604,763, which was filed as application Ser. No. 09/559,122, filed on Apr. 26, 2000, which claims priority from provisional application 60/131,106, filed on Apr. 26, 1999, (12) U.S. patent application Ser. No. 10/030,593, filed on Jan. 8, 2002, which claims priority from provisional application 60/146,203, filed on Jul. 29, 1999, (13) U.S. provisional patent application Ser. No. 60/143,039, filed on Jul. 9, 1999, (14) U.S. patent application Ser. No. 10/111,982, filed on Apr. 30, 2002, which claims priority from provisional patent application Ser. No. 60/162,671, filed on Nov. 1, 1999, (15) U.S. provisional patent application Ser. No. 60/154,047, filed on Sep. 16, 1999, (16) U.S. provisional patent application Ser. No. 60/438,828, filed on Jan. 9, 2003, (17) U.S. Pat. No. 6,564,875, which was filed as application Ser. No. 09/679,907, on Oct. 5, 2000, which claims priority from provisional patent application Ser. No. 60/159,082, filed on Oct. 12, 1999, (18) U.S. patent application Ser. No. 10/089,419, filed on Mar. 27, 2002, which claims priority from provisional patent application Ser. No. 60/159,039, filed on Oct. 12, 1999, (19) U.S. patent application Ser. No. 09/679,906, filed on Oct. 5, 2000, which claims priority from provisional patent application Ser. No. 60/159,033, filed on Oct. 12, 1999, (20) U.S. patent application Ser. No. 10/303,992, filed on Nov. 22, 2002, which claims priority from provisional patent application Ser. No. 60/212,359, filed on Jun. 19, 2000, (21) U.S. provisional patent application Ser. No. 60/165,228, filed on Nov. 12, 1999, (22) U.S. provisional patent application Ser. No. 60/455,051, filed on Mar. 14, 2003, (23) PCT application US02/2477, filed on Jun. 26, 2002, which claims priority from U.S. provisional patent application Ser. No. 60/303,711, filed on Jul. 6, 2001, (24) U.S. patent application Ser. No. 10/311,412, filed on Dec. 12, 2002, which claims priority from provisional patent application Ser. No. 60/221,443, filed on Jul. 28, 2000, (25) U.S. patent application Ser. No. 10/322,947, filed on Dec. 18, 2002, which claims priority from provisional patent application Ser. No. 60/221,645, filed on Jul. 28, 2000, (26) U.S. patent application Ser. No. 10/322,947, filed on Jan. 22, 2003, which claims priority from provisional patent application Ser. No. 60/233,638, filed on Sep. 18, 2000, (27) U.S. patent application Ser. No. 10/406,648, filed on Mar. 31, 2003, which claims priority from provisional patent application Ser. No. 60/237,334, filed on Oct. 2, 2000, (28) PCT application US02/04353, filed on Feb. 14, 2002, which claims priority from U.S. provisional patent application Ser. No. 60/270,007, filed on Feb. 20, 2001, (29) U.S. patent application Ser. No. 10/465,835, filed on Jun. 13, 2003, which claims priority from provisional patent application Ser. No. 60/262,434, filed on Jan. 17, 2001, (30) U.S. patent application Ser. No. 10/465,831, filed on Jun. 13, 2003, which claims priority from U.S. provisional patent application Ser. No. 60/259,486, filed on Jan. 3, 2001, (31) U.S. provisional patent application Ser. No. 60/452,303, filed on Mar. 5, 2003, (32) U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (33) U.S. Pat. No. 6,561,227, which was filed as patent application Ser. No. 09/852,026, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (34) U.S. patent application Ser. No. 09/852,027, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (35) PCT Application US02/25608, filed on Aug. 13, 2002, which claims priority from provisional application 60/318,021, filed on Sep. 7, 2001, (36) PCT Application US02/24399, filed on Aug. 1, 2002, which claims priority from U.S. provisional patent application Ser. No. 60/313,453, filed on Aug. 20, 2001, (37) PCT Application US02/29856, filed on Sep. 19, 2002, which claims priority from U.S. provisional patent application Ser. No. 60/326,886, filed on Oct. 3, 2001, (38) PCT Application US02/20256, filed on Jun. 26, 2002, which claims priority from U.S. provisional patent application Ser. No. 60/303,740, filed on Jul. 6, 2001, (39) U.S. patent application Ser. No. 09/962,469, filed on Sep. 25, 2001, which is a divisional of U.S. patent application Ser. No. 09/523,468, filed on Mar. 10, 2000, which claims priority from provisional application 60/124,042, filed on Mar. 11, 1999, (40) U.S. patent application Ser. No. 09/962,470, filed on Sep. 25, 2001, which is a divisional of U.S. patent application Ser. No. 09/523,468, filed on Mar. 10, 2000, which claims priority from provisional application 60/124,042, filed on Mar. 11, 1999, (41) U.S. patent application Ser. No. 09/962,471, filed on Sep. 25, 2001, which is a divisional of U.S. patent application Ser. No. 09/523,468, filed on Mar. 10, 2000, which claims priority from provisional application 60/124,042, filed on Mar. 11, 1999, (42) U.S. patent application Ser. No. 09/962,467, filed on Sep. 25, 2001, which is a divisional of U.S. patent application Ser. No. 09/523,468, filed on Mar. 10, 2000, which claims priority from provisional application 60/124,042, filed on Mar. 11, 1999, (43) U.S. patent application Ser. No. 09/962,468, filed on Sep. 25, 2001, which is a divisional of U.S. patent application Ser. No. 09/523,468, filed on Mar. 10, 2000, which claims priority from provisional application 60/124,042, filed on Mar. 11, 1999, (44) PCT application US 02/25727, filed on Aug. 14, 2002, which claims priority from U.S. provisional patent application Ser. No. 60/317,985, filed on Sep. 6, 2001, and U.S. provisional patent application Ser. No. 60/318,386, filed on Sep. 10, 2001, (45) PCT application US02/39425, filed on Dec. 10, 2002, which claims priority from U.S. provisional patent application Ser. No. 60/343,674, filed on Dec. 27, 2001, (46) U.S. utility patent application Ser. No. 09/969,922, filed on Oct. 3, 2001, which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (47) U.S. utility patent application Ser. No. 10/516,467, filed on Dec. 10, 2001, which is a continuation application of U.S. utility patent application Ser. No. 09/969,922, filed on Oct. 3, 2001, which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (48) PCT application US 03/00609, filed on Jan. 9, 2003, which claims priority from U.S. provisional patent application Ser. No. 60/357,372, filed on Feb. 15, 2002, (49) U.S. patent application Ser. No. 10/074,703, filed on Feb. 12, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (50) U.S. patent application Ser. No. 10/074,244, filed on Feb. 12, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (51) U.S. patent application Ser. No. 10/076,660, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (52) U.S. patent application Ser. No. 10/076,661, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (53) U.S. patent application Ser. No. 10/076,659, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (54) U.S. patent application Ser. No. 10/078,928, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (55) U.S. patent application Ser. No. 10/078,922, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (56) U.S. patent application Ser. No. 10/078,921, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (57) U.S. patent application Ser. No. 10/261,928, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (58) U.S. patent application Ser. No. 10/079,276, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (59) U.S. patent application Ser. No. 10/262,009, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (60) U.S. patent application Ser. No. 10/092,481, filed on Mar. 7, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (61) U.S. patent application Ser. No. 10/261,926, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (62) PCT application US02/36157, filed on Nov. 12, 2002, which claims priority from U.S. provisional patent application Ser. No. 60/338,996, filed on Nov. 12, 2001, (63) PCT application US 02/36267, filed on Nov. 12, 2002, which claims priority from U.S. provisional patent application Ser. No. 60/339,013, filed on Nov. 12, 2001, (64) PCT application US 03/11765, filed on Apr. 16, 2003, which claims priority from U.S. provisional patent application Ser. No. 60/383,917, filed on May 29, 2002, (65) PCT application US 03/15020, filed on May 12, 2003, which claims priority from U.S. provisional patent application Ser. No. 60/391,703, filed on Jun. 26, 2002, (66) PCT application US 02/39418, filed on Dec. 10, 2002, which claims priority from U.S. provisional patent application Ser. No. 60/346,309, filed on Jan. 7, 2002, (67) PCT application US 03/6544, filed on Mar. 4, 2003, which claims priority from U.S. provisional patent application Ser. No. 60/372,048, filed on Apr. 12, 2002, (68) U.S. patent application Ser. No. 10/331,718, filed on Dec. 30, 2002, which is a divisional U.S. patent application Ser. No. 09/679,906, filed on Oct. 5, 2000, which claims priority from provisional patent application Ser. No. 60/159,033, filed on Oct. 12, 1999, (69) PCT application US 03/04837, filed on Feb. 29, 2003, which claims priority from U.S. provisional patent application Ser. No. 60/363,829, filed on Mar. 13, 2002, (70) U.S. patent application Ser. No. 10/261, 927, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (71) U.S. patent application Ser. No. 10/262,008, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (72) U.S. patent application Ser. No. 10/261,925, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (73) U.S. patent application Ser. No. 10/199,524, filed on Jul. 19, 2002, which is a continuation of U.S. Pat. No. 6,497,289, which was filed as U.S. patent application Ser. No. 09/454,139, filed on Dec. 3, 1999, which claims priority from provisional application 60/111,293, filed on Dec. 7, 1998, (74) PCT application US 03/10144, filed on Mar. 28, 2003, which claims priority from U.S. provisional patent application Ser. No. 60/372,632, filed on Apr. 15, 2002, (75) U.S. provisional patent application Ser. No. 60/412,542, filed on Sep. 20, 2002, (76) PCT application US 03/14153, filed on May 6, 2003, which claims priority from U.S. provisional patent application Ser. No. 60/380,147, filed on May 6, 2002, (77) PCT application US 03/19993, filed on Jun. 24, 2003, which claims priority from U.S. provisional patent application Ser. No. 60/397,284, filed on Jul. 19, 2002, (78) PCT application US 03/13787, filed on May 5, 2003, which claims priority from U.S. provisional patent application Ser. No. 60/387,486, filed on Jun. 10, 2002, (79) PCT application US 03/18530, filed on Jun. 11, 2003, which claims priority from U.S. provisional patent application Ser. No. 60/387,961, filed on Jun. 12, 2002, (80) PCT application US 03/20694, filed on Jul. 1, 2003, which claims priority from U.S. provisional patent application Ser. No. 60/398,061, filed on Jul. 24, 2002, (81) PCT application US 03/20870, filed on Jul. 2, 2003, which claims priority from U.S. provisional patent application Ser. No. 60/399,240, filed on Jul. 29, 2002, (82) U.S. provisional patent application Ser. No. 60/412,487, filed on Sep. 20, 2002, (83) U.S. provisional patent application Ser. No. 60/412,488, filed on Sep. 20, 2002, (84) U.S. patent application Ser. No. Oct. 280,356, filed on Oct. 25, 2002, which is a continuation of U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (85) U.S. provisional patent application Ser. No. 60/412,177, filed on Sep. 20, 2002, (86) U.S. provisional patent application Ser. No. 60/412,653, filed on Sep. 20, 2002, (87) U.S. provisional patent application Ser. No. 60/405,610, filed on Aug. 23, 2002, (88) U.S. provisional patent application Ser. No. 60/405,394, filed on Aug. 23, 2002, (89) U.S. provisional patent application Ser. No. 60/412,544, filed on Sep. 20, 2002, (90) PCT application PCT/US03/24779, filed on Aug. 8, 2003, which claims priority from U.S. provisional patent application Ser. No. 60/407,442, filed on Aug. 30, 2002, (91) U.S. provisional patent application Ser. No. 60/423,363, filed on Dec. 10, 2002, (92) U.S. provisional patent application Ser. No. 60/412,196, filed on Sep. 20, 2002, (93) U.S. provisional patent application Ser. No. 60/412,187, filed on Sep. 20, 2002, (94) U.S. provisional patent application Ser. No. 60/412,371, filed on Sep. 20, 2002, (95) U.S. patent application Ser. No. 10/382,325, filed on Mar. 5, 2003, which is a continuation of U.S. Pat. No. 6,557,640, which was filed as patent application Ser. No. 09/588,946, filed on Jun. 7, 2000, which claims priority from provisional application 60/137,998, filed on Jun. 7, 1999, (96) U.S. patent application Ser. No. 10/624,842, filed on Jul. 22, 2003, which is a divisional of U.S. patent application Ser. No. 09/502,350, filed on Feb. 10, 2000, which claims priority from provisional application 60/119,611, filed on Feb. 11, 1999, (97) U.S. provisional patent application Ser. No. 60/431,184, filed on Dec. 5, 2002, (98) U.S. provisional patent application Ser. No. 60/448,526, filed on Feb. 18, 2003, (99) U.S. provisional patent application Ser. No. 60/461,539, filed on Apr. 9, 2003, (100) U.S. provisional patent application Ser. No. 60/462,750, filed on Apr. 14, 2003, (101) U.S. provisional patent application Ser. No. 60/436,106, filed on Dec. 23, 2002, (102) U.S. provisional patent application Ser. No. 60/442,942, filed on Jan. 27, 2003, (103) U.S. provisional patent application Ser. No. 60/442,938, filed on Jan. 27, 2003, (104) U.S. provisional patent application Ser. No. 60/418,687, filed on Apr. 18, 2003, (105) U.S. provisional patent application Ser. No. 60/454,896, filed on Mar. 14, 2003, (106) U.S. provisional patent application Ser. No. 60/450,504, filed on Feb. 26, 2003, (107) U.S. provisional patent application Ser. No. 60/451,152, filed on Mar. 9, 2003, (108) U.S. provisional patent application Ser. No. 60/455,124, filed on Mar. 17, 2003, (109) U.S. provisional patent application Ser. No. 60/453,678, filed on Mar. 11, 2003, (110) U.S. patent application Ser. No. 10/421,682, filed on Apr. 23, 2003, which is a continuation of U.S. patent application Ser. No. 09/523,468, filed on Mar. 10, 2000, which claims priority from provisional application 60/124,042, filed on Mar. 11, 1999, (111) U.S. provisional patent application Ser. No. 60/457,965, filed on Mar. 27, 2003, (112) U.S. provisional patent application Ser. No. 60/455,718, filed on Mar. 18, 2003, (113) U.S. Pat. No. 6,550,821, which was filed as patent application Ser. No. 09/811,734, filed on Mar. 19, 2001, (114) U.S. patent application Ser. No. 10/436,467, filed on May 12, 2003, which is a continuation of U.S. Pat. No. 6,604,763, which was filed as application Ser. No. 09/559,122, filed on Apr. 26, 2000, which claims priority from provisional application 60/131,106, filed on Apr. 26, 1999, (115) U.S. provisional patent application Ser. No. 60/459,776, filed on Apr. 2, 2003, (116) U.S. provisional patent application Ser. No. 60/461,094, filed on Apr. 8, 2003, (117) U.S. provisional patent application Ser. No. 60/461,038, filed on Apr. 7, 2003, (118) U.S. provisional patent application Ser. No. 60/463,586, filed on Apr. 17, 2003, (119) U.S. provisional patent application Ser. No. 60/472,240, filed on May 20, 2003, (120) U.S. patent application Ser. No. 10/619,285, filed on Jul. 14, 2003, which is a continuation-in-part of U.S. utility patent application Ser. No. 09/969,922, filed on Oct. 3, 2001, which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, and (121) U.S. utility patent application Ser. No. 10/418,688, which was filed on Apr. 18, 2003, as a division of U.S. utility patent application Ser. No. 09/523,468, filed on Mar. 10, 2000, which claims priority from provisional application 60/124,042, filed on Mar. 11, 1999, the disclosures of which are incorporated herein by reference.

In an alternative embodiment, the fluid passage 220 in the shoe 215 is omitted. In this manner, the pressurization of the region 230 is simplified. In an alternative embodiment, the annular body 515 of the fluidic sealing material is formed using conventional methods of injecting a hardenable fluidic sealing material into the annular region 310.

In an alternative embodiment of the apparatus 700, the fluid passage 715 is omitted. In this manner, in an exemplary embodiment, the region of the wellbore 100 below the expansion cone 705 is pressurized and one or more regions of the subterranean formation 105 are fractured to enhance the oil and/or gas recovery process.

Figure 12:
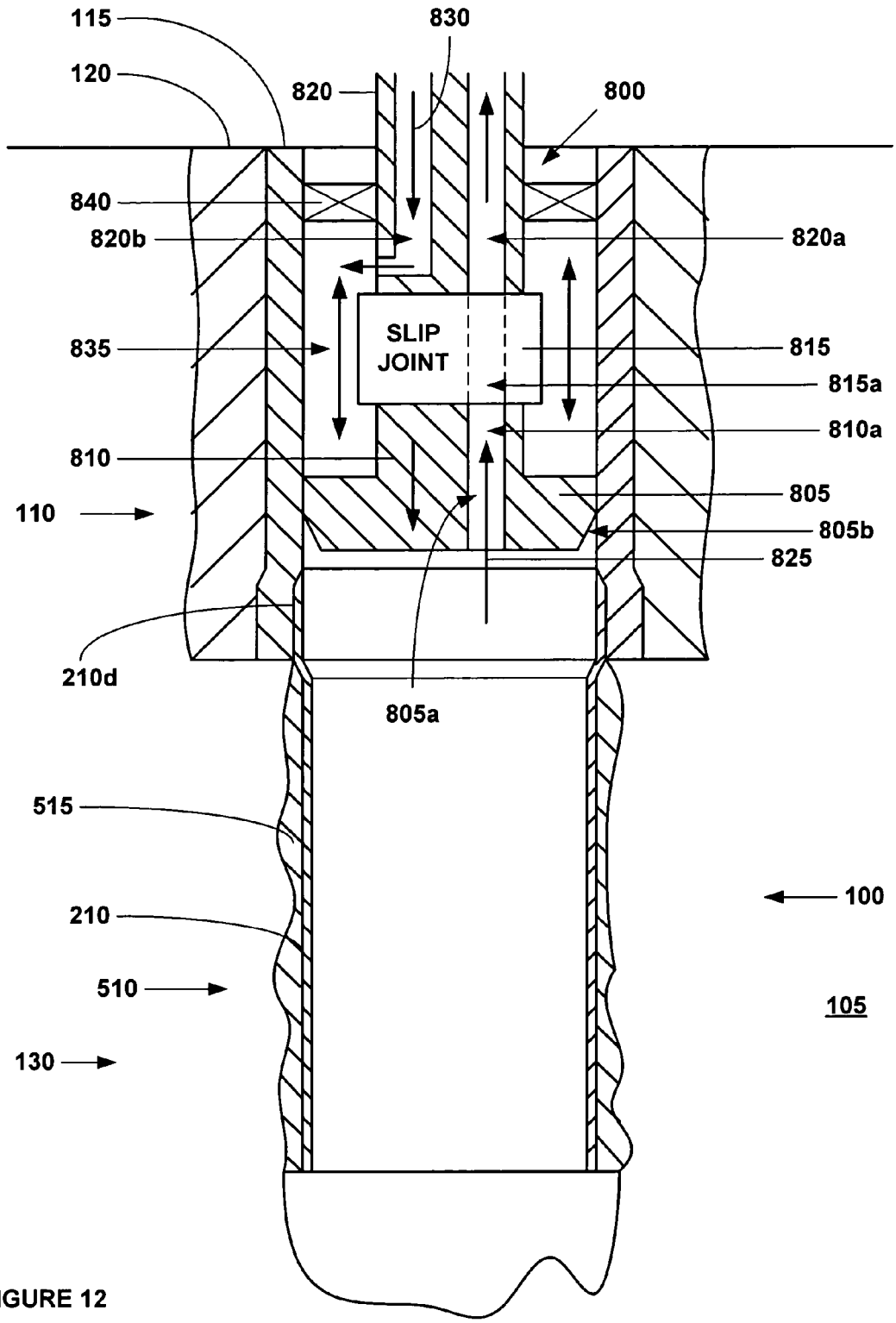
FIG. 12 is a fragmentary cross-sectional illustration of the placement of an alternative embodiment of an apparatus for forming a mono-diameter wellbore casing into the well borehole of FIG. 8.
Figure 13:
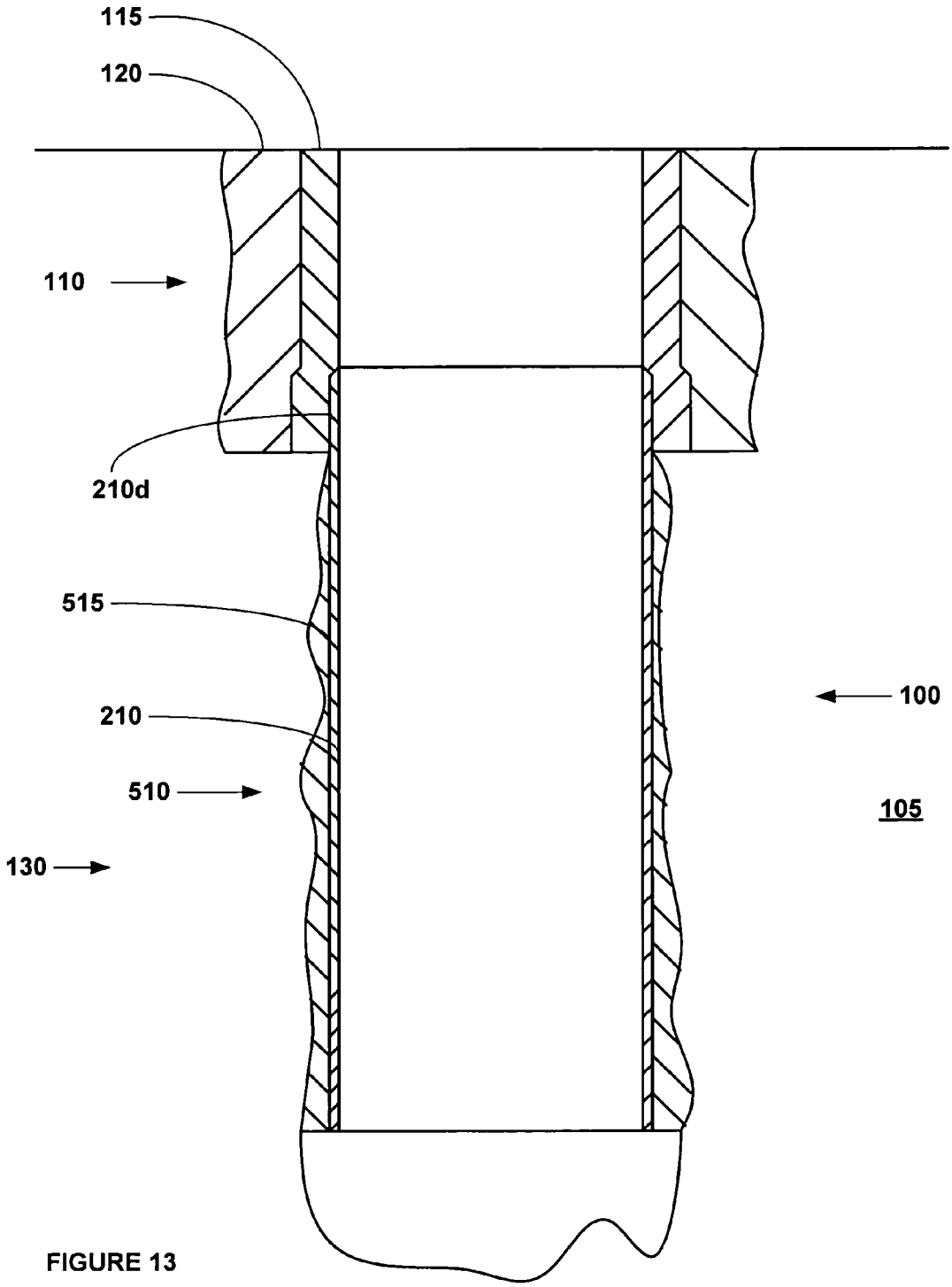
FIG. 13 is a cross-sectional illustration of the well borehole of FIG. 12 following the formation of a mono-diameter wellbore casing.

Referring to FIGS. 12–13, in an alternative embodiment, an apparatus 800 for forming a mono-diameter wellbore casing is positioned within the wellbore casing 115 that includes a tubular expansion cone 805 that defines a fluid passage 805*a* that is coupled to a support member 810.

The tubular expansion cone 805 preferably further includes a conical outer surface 805*b* for radially expanding and plastically deforming the portion of the expandable tubular member 210 that does not overlap with the wellbore casing 115. In an exemplary embodiment, the outside diameter of the tubular expansion cone 805 is substantially equal to the inside diameter of the portion of the pre-existing wellbore casing 115 that does not overlap with the expandable tubular member 210.

The support member 810 is coupled to a slip joint 815, and the slip joint is coupled to a support member 820. As will be recognized by persons having ordinary skill in the art, a slip joint permits relative movement between objects. Thus, in this manner, the expansion cone 805 and support member 810 may be displaced in the longitudinal direction relative to the support member 820. In an exemplary embodiment, the slip joint 810 permits the expansion cone 805 and support member 810 to be displaced in the longitudinal direction relative to the support member 820 for a distance greater than or equal to the axial length of the expandable tubular member 210. In this manner, the expansion cone 805 may be used to plastically deform and radially expand the portion of the expandable tubular member 210 that does not overlap with the pre-existing wellbore casing 115 without having to reposition the support member 820.

The slip joint 815 may be any number of conventional commercially available slip joints that include a fluid passage for conveying fluidic materials through the slip joint. In an exemplary embodiment, the slip joint 815 is a pumper sub commercially available from Bowen Oil Tools in order to optimally provide elongation of the drill string.

The support member 810, slip joint 815, and support member 820 further include fluid passages 810*a*, 815*a*, and 820*a*, respectively, that are fluidicly coupled to the fluid passage 805*a*. During operation, the fluid passages 805*a*, 810*a*, 815*a*, and 820*a* preferably permit fluidic materials 825 displaced by the expansion cone 805 to be conveyed to a location above the apparatus 800. In this manner, operating pressures within the subterranean formation 105 below the expansion cone are minimized.

The support member 820 further preferably includes a fluid passage 820*b* that permits fluidic materials 830 to be conveyed into an annular region 835 surrounding the support member 810, the slip joint 815, and the support member 820 and bounded by the expansion cone 805 and a conventional packer 840 that is coupled to the support member 820. In this manner, the annular region 835 may be pressurized by the injection of the fluids 830 thereby causing the expansion cone 805 to be displaced in the longitudinal direction relative to the support member 820 to thereby plastically deform and radially expand the portion of the expandable tubular member 210 that does not overlap with the pre-existing wellbore casing 115.

During operation, as illustrated in FIG. 10, in an exemplary embodiment, the apparatus 800 is positioned within the preexisting casing 115 with the bottom surface of the expansion cone 805 proximate the top of the expandable tubular member 210. During placement of the apparatus 800 within the preexisting casing 115, fluidic materials 825 within the casing are conveyed out of the casing through the fluid passages 805*a*, 810*a*, 815*a*, and 820*a*. In this manner, surge pressures within the wellbore 100 are minimized.

The packer 840 is then operated in a well-known manner to fluidicly isolate the annular region 835 from the annular region above the packer. The fluidic material 830 is then injected into the annular region 835 using the fluid passage 820*b*. Continued injection of the fluidic material 830 into the annular region 835 preferably pressurizes the annular region and thereby causes the expansion cone 805 and support member 810 to be displaced in the longitudinal direction relative to the support member 820.

As illustrated in FIG. 13, in an exemplary embodiment, the longitudinal displacement of the expansion cone 805 in turn plastically deforms and radially expands the portion of the expandable tubular member 210 that does not overlap the pre-existing wellbore casing 115. In this manner, a mono-diameter wellbore casing is formed that includes the overlapping wellbore casings 115 and 210. The apparatus 800 may then be removed from the wellbore 100 by releasing the packer 840 from engagement with the wellbore casing 115, and lifting the apparatus 800 out of the wellbore 100. In an exemplary embodiment, the downward longitudinal displacement of the expansion cone 805 also at least partially radially expands and plastically deforms the portions of the pre-existing wellbore casing 115 and the upper portion 210*d* of the expandable tubular member 210 that overlap with one another.

In an alternative embodiment of the apparatus 800, the fluid passage 820*b* is provided within the packer 840 in order to enhance the operation of the apparatus 800.

In an alternative embodiment of the apparatus 800, the fluid passages 805*a*, 810*a*, 815*a*, and 820*a* are omitted. In this manner, in an exemplary embodiment, the region of the wellbore 100 below the expansion cone 805 is pressurized and one or more regions of the subterranean formation 105 are fractured to enhance the oil and/or gas recovery process.

Referring to FIGS. 14–17, in an alternative embodiment, an apparatus 900 is positioned within the wellbore casing 115 that includes an expansion cone 905 having a fluid passage 905*a* that is releasably coupled to a releasable coupling 910 having fluid passage 910*a*.

The fluid passage 905*a* is preferably adapted to receive a conventional ball, plug, or other similar device for sealing off the fluid passage. The expansion cone 905 further includes a conical outer surface 905*b* for radially expanding and plastically deforming the portion of the expandable tubular member 210 that does not overlap the pre-existing wellbore casing 115. In an exemplary embodiment, the outside diameter of the expansion cone 905 is substantially equal to the inside diameter of the portion of the pre-existing wellbore casing 115 that does not overlap with the upper end 210*d* of the expandable tubular member 210.

The releasable coupling 910 may be any number of conventional commercially available releasable couplings that include a fluid passage for conveying fluidic materials through the releasable coupling. In an exemplary embodiment, the releasable coupling 910 is a safety joint commercially available from Halliburton in order to optimally release the expansion cone 905 from the support member 915 at a predetermined location.

A support member 915 is coupled to the releasable coupling 910 that includes a fluid passage 915*a*. The fluid passages 905*a*, 910*a* and 915*a* are fluidicly coupled. In this manner, fluidic materials may be conveyed into and out of the wellbore 100.

A packer 920 is movably and sealingly coupled to the support member 915. The packer may be any number of conventional packers. In an exemplary embodiment, the packer 920 is a commercially available burst preventer (BOP) in order to optimally provide a sealing member.

Figure 14:
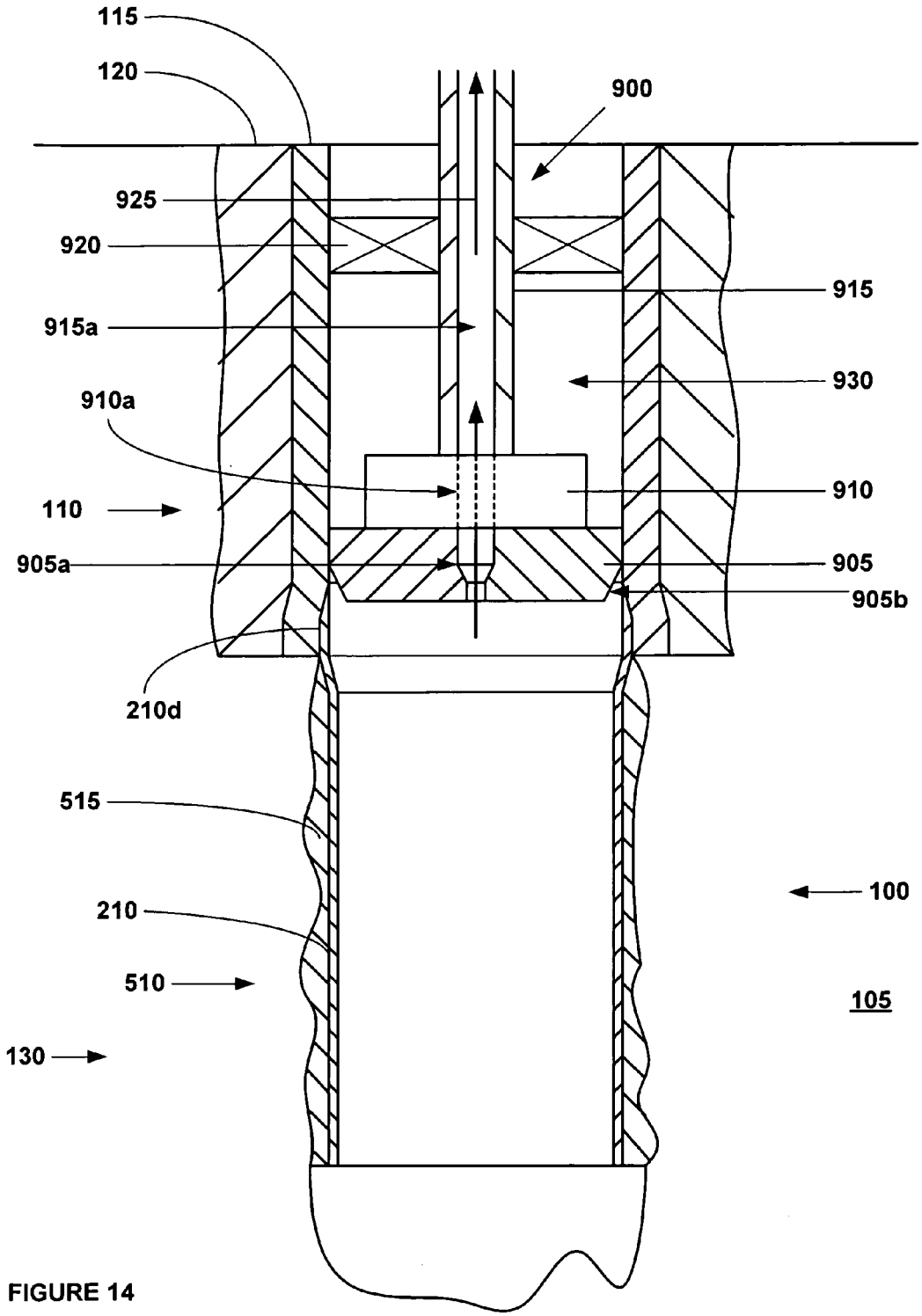
FIG. 14 is a fragmentary cross-sectional illustration of the placement of an alternative embodiment of an apparatus for forming a mono-diameter wellbore casing into the well borehole of FIG. 8.

During operation, as illustrated in FIG. 14, in an exemplary embodiment, the apparatus 900 is positioned within the preexisting casing 115 with the bottom surface of the expansion cone 905 proximate the top of the expandable tubular member 210. During placement of the apparatus 900 within the preexisting casing 115, fluidic materials 925 within the casing are conveyed out of the casing through the fluid passages 905*a*, 910*a*, and 915*a*. In this manner, surge pressures within the wellbore 100 are minimized. The packer 920 is then operated in a well-known manner to fluidicly isolate a region 930 within the casing 115 between the expansion cone 905 and the packer 920 from the region above the packer.

Figure 15:
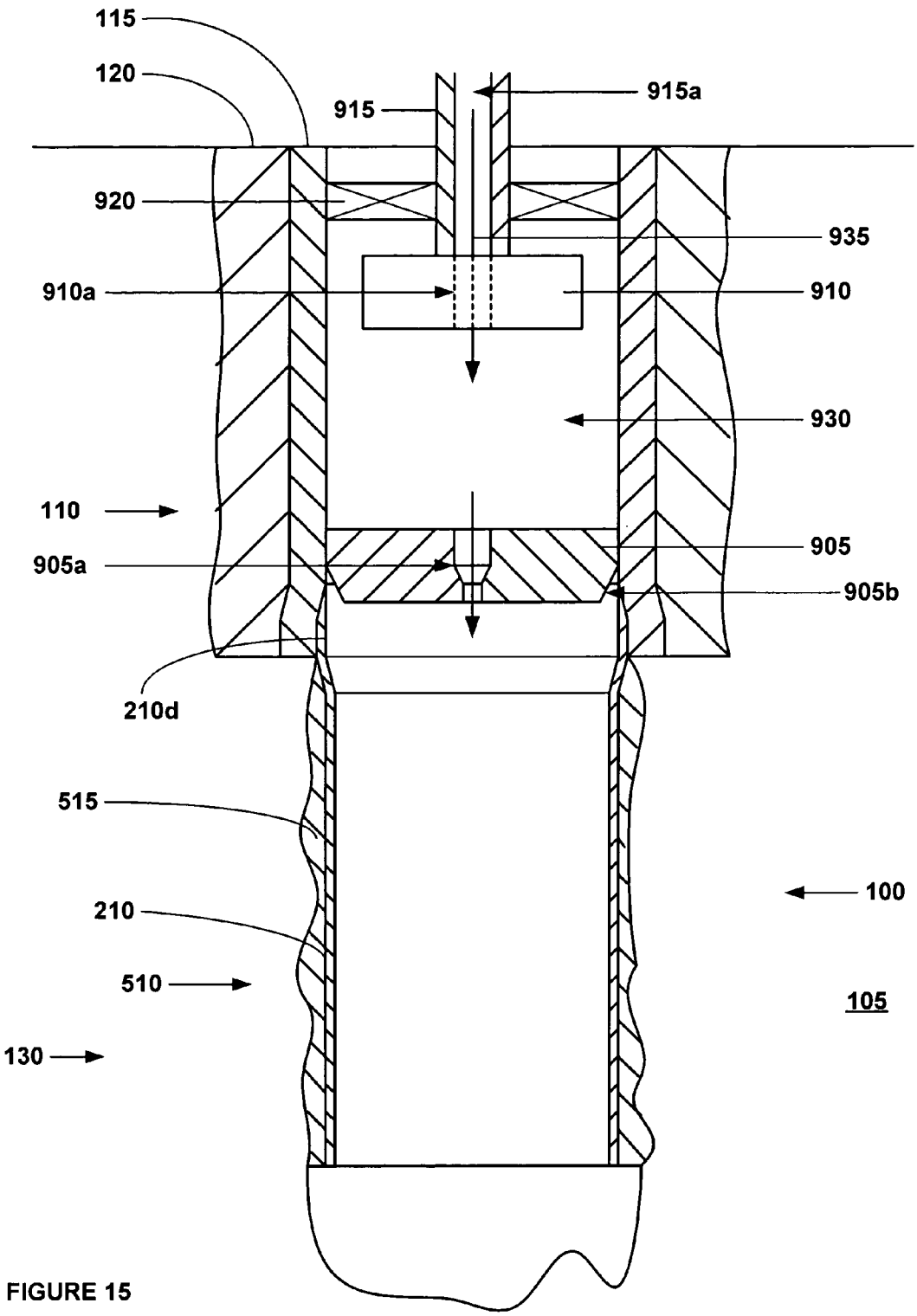
FIG. 15 is a fragmentary cross-sectional illustration of the well borehole of FIG. 14 during the injection of pressurized fluids into the well borehole.

In an exemplary embodiment, as illustrated in FIG. 15, the releasable coupling 910 is then released from engagement with the expansion cone 905 and the support member 915 is moved away from the expansion cone. A fluidic material 935 may then be injected into the region 930 through the fluid passages 910*a* and 915*a*. The fluidic material 935 may then flow into the region of the wellbore 100 below the expansion cone 905 through the valveable passage 905*b*. Continued injection of the fluidic material 935 may thereby pressurize and fracture regions of the formation 105 below the expandable tubular member 210. In this manner, the recovery of oil and/or gas from the formation 105 may be enhanced.

Figure 16:
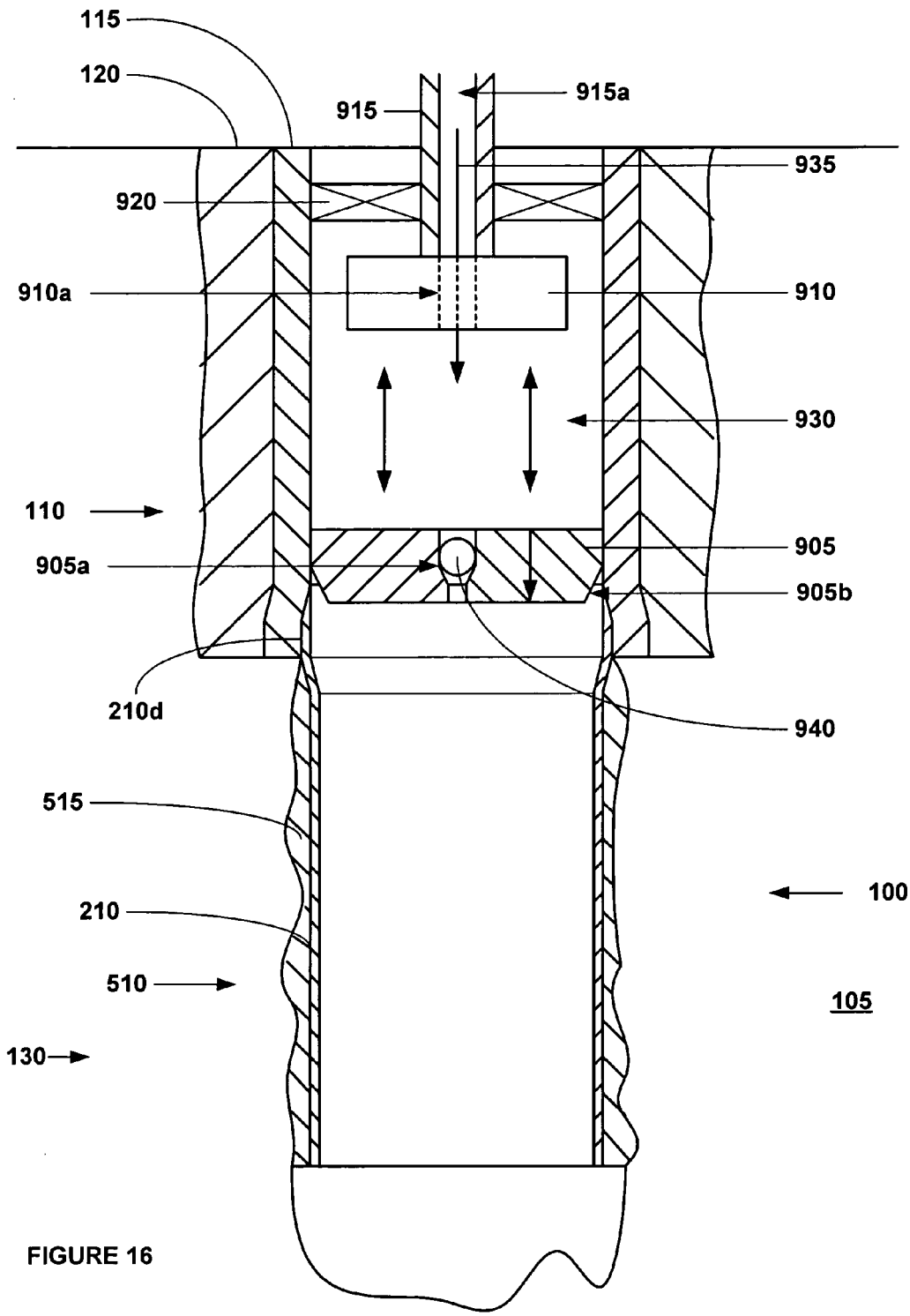
FIG. 16 is a fragmentary cross-sectional illustration of the well borehole of FIG. 15 during the formation of the mono-diameter wellbore casing.

In an exemplary embodiment, as illustrated in FIG. 16, a plug, ball, or other similar valve device 940 may then be positioned in the valveable passage 905*a* by introducing the valve device into the fluidic material 935. In this manner, the region 930 may be fluidicly isolated from the region below the expansion cone 905. Continued injection of the fluidic material 935 may then pressurize the region 930 thereby causing the expansion cone 905 to be displaced in the longitudinal direction.

Figure 17:
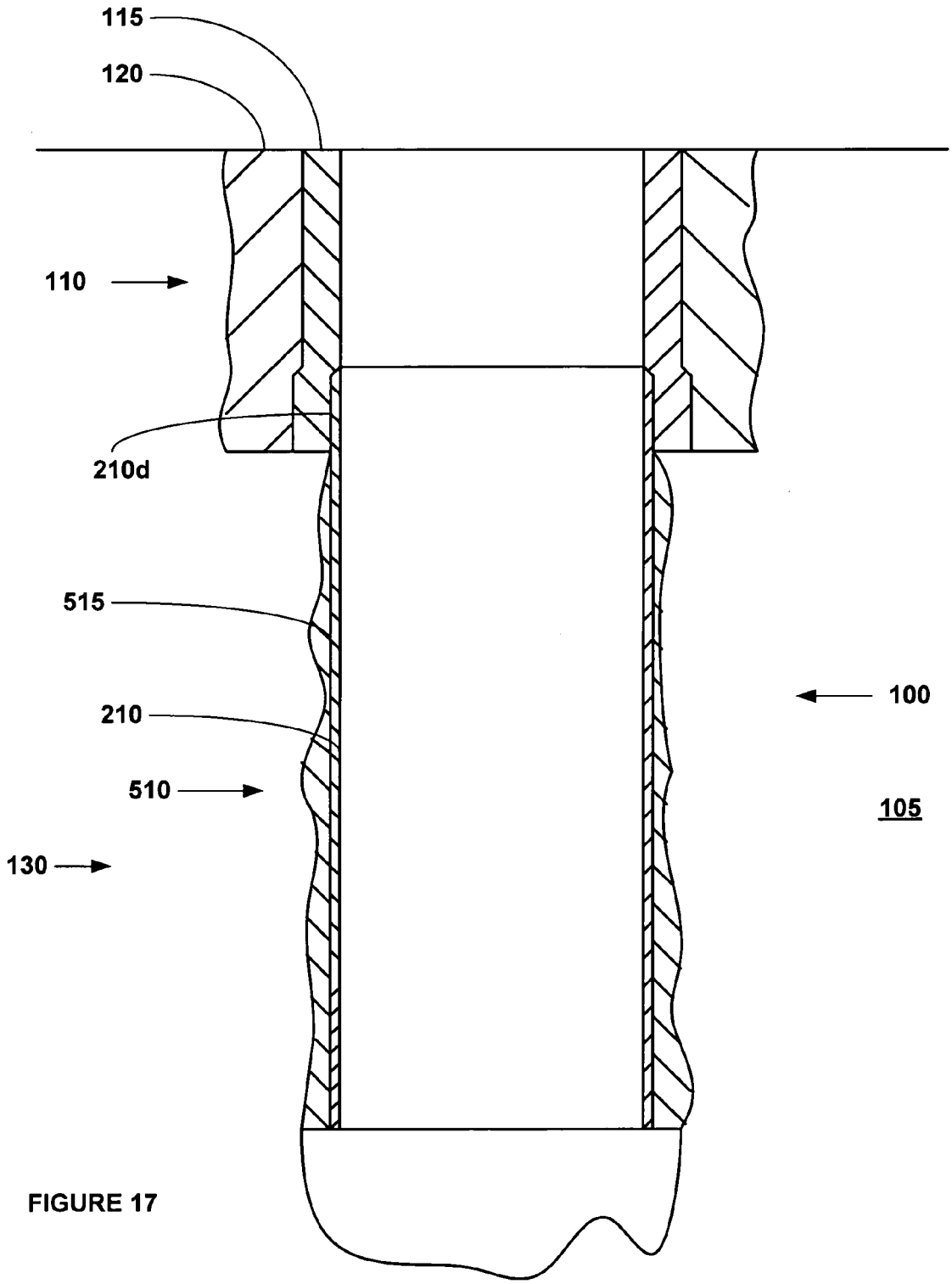
FIG. 17 is a fragmentary cross-sectional illustration of the well borehole of FIG. 16 following the formation of the mono-diameter wellbore casing.

In an exemplary embodiment, as illustrated in FIG. 17, the longitudinal displacement of the expansion cone 905 plastically deforms and radially expands the portion of the expandable tubular 210 that does not overlap with the pre-existing wellbore casing 115. In this manner, a mono-diameter wellbore casing is formed that includes the pre-existing wellbore casing 115 and the expandable tubular member 210. Upon completing the radial expansion process, the support member 915 may be moved toward the expansion cone 905 and the expansion cone may be re-coupled to the releasable coupling device 910. The packer 920 may then be decoupled from the wellbore casing 115, and the expansion cone 905 and the remainder of the apparatus 900 may then be removed from the wellbore 100. In an exemplary embodiment, the downward longitudinal displacement of the expansion cone 905 also at least partially plastically deforms and radially expands the portions of the pre-existing wellbore casing 115 and the upper portion 210*d* of the expandable tubular member 210 that overlap with one another.

In several alternative embodiments, the radial expansion and plastic deformation of the expandable tubular members 210, described above with reference to FIGS. 1–17, is provided using a conventional rotary expansion tool such as, for example, the commercially available rotary expansion tools available from Weatherford International and/or the conventional expansion tool such as, for example, the commercially available expansion tools available from Baker Hughes.

In an exemplary embodiment, the displacement of the expansion cone 905 also pressurizes the region within the expandable tubular member 210 below the expansion cone. In this manner, the subterranean formation surrounding the expandable tubular member 210 may be elastically or plastically compressed thereby enhancing the structural properties of the formation.

A method of creating a mono-diameter wellbore casing in a borehole located in a subterranean formation including a preexisting wellbore casing has also been described that includes installing a tubular liner and a first expansion cone in the borehole, injecting a fluidic material into the borehole, pressurizing a portion of an interior region of the tubular liner below the first expansion cone, radially expanding at least a portion of the tubular liner in the borehole by extruding at least a portion of the tubular liner off of the first expansion cone, radially expanding an overlap between the preexisting wellbore casing and the tubular liner, and radially expanding the portion of the tubular liner that does not overlap with the preexisting wellbore casing using a second expansion cone. In an exemplary embodiment, radially expanding the overlap between the preexisting wellbore casing and the tubular liner includes impulsively applying outwardly directed radial forces to the interior of the overlap between the preexisting wellbore casing and the tubular liner. In an exemplary embodiment, impulsively applying outwardly directed radial forces to the interior of the overlap between the preexisting wellbore casing and the tubular liner includes detonating a shaped charge within the overlap between the preexisting wellbore casing and the tubular liner. In an exemplary embodiment, radially expanding the overlap between the preexisting wellbore casing and the tubular liner further includes displacing the second expansion cone in a longitudinal direction, and permitting fluidic materials displaced by the second expansion cone to be removed. In an exemplary embodiment, displacing the second expansion cone in a longitudinal direction includes applying fluid pressure to the second expansion cone. In an exemplary embodiment, radially expanding the overlap between the tubular liner and the preexisting wellbore casing using the second expansion cone further includes displacing the second expansion cone in a longitudinal direction, and compressing at least a portion of the subterranean formation using fluid pressure. In an exemplary embodiment, displacing the second expansion cone in a longitudinal direction includes applying fluid pressure to the second expansion cone. In an exemplary embodiment, radially expanding the portion of the tubular liner that does not overlap with the preexisting wellbore casing using the second expansion cone includes displacing the second expansion cone in a longitudinal direction, and permitting fluidic materials displaced by the second expansion cone to be removed. In an exemplary embodiment, displacing the second expansion cone in the longitudinal direction includes applying fluid pressure to the second expansion cone. In an exemplary embodiment, radially expanding the portion of the tubular liner that does not overlap with the preexisting wellbore casing using the second expansion cone includes displacing the second expansion cone in a longitudinal direction, and compressing at least a portion of the subterranean formation using fluid pressure. In an exemplary embodiment, displacing the second expansion cone in the longitudinal direction includes applying fluid pressure to the second expansion cone. In an exemplary embodiment, the method further includes injecting a hardenable fluidic sealing material into an annulus between the tubular liner and the borehole.

A system for creating a mono-diameter wellbore casing in a borehole located in a subterranean formation including a preexisting wellbore casing has also been described that includes means for installing a tubular liner and a first expansion cone in the borehole, means for injecting a fluidic material into the borehole, means for pressurizing a portion of an interior region of the tubular liner below the first expansion cone, means for radially expanding at least a portion of the tubular liner in the borehole by extruding at least a portion of the tubular liner off of the first expansion cone, means for radially expanding an overlap between the preexisting wellbore casing and the tubular liner, and means for radially expanding the portion of the tubular liner that does not overlap with the preexisting wellbore casing using a second expansion cone. In an exemplary embodiment, the means for radially expanding the overlap between the preexisting wellbore casing and the tubular liner includes means for impulsively applying outwardly directed radial forces to the interior of the overlap between the preexisting wellbore casing and the tubular liner. In an exemplary embodiment, the means for impulsively applying outwardly directed radial forces to the interior of the overlap between the preexisting wellbore casing and the tubular liner includes means for detonating a shaped charge within the overlap between the preexisting wellbore casing and the tubular liner. In an exemplary embodiment, the means for radially expanding the overlap between the preexisting wellbore casing and the tubular liner further includes displacing the second expansion cone in a longitudinal direction, and permitting fluidic materials displaced by the second expansion cone to be removed. In an exemplary embodiment, the means for displacing the second expansion cone in a longitudinal direction includes means for applying fluid pressure to the second expansion cone. In an exemplary embodiment, the means for radially expanding the overlap between the tubular liner and the preexisting wellbore casing using the second expansion cone further includes means for displacing the second expansion cone in a longitudinal direction, and means for compressing at least a portion of the subterranean formation using fluid pressure. In an exemplary embodiment, the means for displacing the second expansion cone in a longitudinal direction includes means for applying fluid pressure to the second expansion cone. In an exemplary embodiment, the means for radially expanding the portion of the tubular liner that does not overlap with the preexisting wellbore casing using the second expansion cone includes means for displacing the second expansion cone in a longitudinal direction, and means for permitting fluidic materials displaced by the second expansion cone to be removed. In an exemplary embodiment, the means for displacing the second expansion cone in the longitudinal direction includes means for applying fluid pressure to the second expansion cone. In an exemplary embodiment, the means for radially expanding the portion of the tubular liner that does not overlap with the preexisting wellbore casing using the second expansion cone includes means for displacing the second expansion cone in a longitudinal direction, and means for compressing at least a portion of the subterranean formation using fluid pressure. In an exemplary embodiment, the means for displacing the second expansion cone in the longitudinal direction includes means for applying fluid pressure to the second expansion cone. In an exemplary embodiment, the system further includes means for injecting a hardenable fluidic sealing material into an annulus between the tubular liner and the borehole.

A method of creating a tubular structure having a substantially constant inside diameter has also been described that includes installing a first tubular member and a first expansion cone within a second tubular member, injecting a fluidic material into the second tubular member, pressurizing a portion of an interior region of the first tubular member below the first expansion cone, radially expanding at least a portion of the first tubular member in the second tubular member by extruding at least a portion of the first tubular member off of the first expansion cone, radially expanding an overlap between the first and second tubular members, and radially expanding the portion of the first tubular member that does not overlap with the second tubular member using a second expansion cone. In an exemplary embodiment, radially expanding the overlap between the first and second tubular members includes impulsively applying outwardly directed radial forces to the interior of the overlap between the first and second tubular members. In an exemplary embodiment, impulsively applying outwardly directed radial forces to the interior of the overlap between the first and second tubular members includes detonating a shaped charge within the overlap between the first and second tubular members. In an exemplary embodiment, radially expanding the overlap between the first and second tubular members further includes displacing the second expansion cone in a longitudinal direction, and permitting fluidic materials displaced by the second expansion cone to be removed. In an exemplary embodiment, displacing the second expansion cone in a longitudinal direction includes applying fluid pressure to the second expansion cone. In an exemplary embodiment, radially expanding the overlap between the first and second tubular members using the second expansion cone further includes displacing the second expansion cone in a longitudinal direction, and compressing at least a portion of the subterranean formation using fluid pressure. In an exemplary embodiment, displacing the second expansion cone in a longitudinal direction includes applying fluid pressure to the second expansion cone. In an exemplary embodiment, radially expanding the portion of the first tubular member that does not overlap with the second tubular member using the second expansion cone includes displacing the second expansion cone in a longitudinal direction, and permitting fluidic materials displaced by the second expansion cone to be removed. In an exemplary embodiment, displacing the second expansion cone in the longitudinal direction includes applying fluid pressure to the second expansion cone.

A system for creating a tubular structure having a substantially constant inside diameter has also been described that includes means for installing a first tubular member and a first expansion cone within a second tubular member, means for injecting a fluidic material into the second tubular member, means for pressurizing a portion of an interior region of the first tubular member below the first expansion cone, means for radially expanding at least a portion of the first tubular member in the second tubular member by extruding at least a portion of the first tubular member off of the first expansion cone, means for radially expanding an overlap between the first and second tubular members, and means for radially expanding the portion of the first tubular member that does not overlap with the second tubular member using a second expansion cone. In an exemplary embodiment, the means for radially expanding the overlap between the first and second tubular members includes means for impulsively applying outwardly directed radial forces to the interior of the overlap between the first and second tubular members. In an exemplary embodiment, the means for impulsively applying outwardly directed radial forces to the interior of the overlap between the first and second tubular members includes means for detonating a shaped charge within the overlap between the first and second tubular members. In an exemplary embodiment, the means for radially expanding the overlap between the first and second tubular members further includes means for displacing the second expansion cone in a longitudinal direction, and means for permitting fluidic materials displaced by the second expansion cone to be removed. In an exemplary embodiment, the means for displacing the second expansion cone in a longitudinal direction includes means for applying fluid pressure to the second expansion cone. In an exemplary embodiment, the means for radially expanding the overlap between the first and second tubular members using the second expansion cone further includes means for displacing the second expansion cone in a longitudinal direction, and means for compressing at least a portion of the subterranean formation using fluid pressure. In an exemplary embodiment, the means for displacing the second expansion cone in a longitudinal direction includes means for applying fluid pressure to the second expansion cone. In an exemplary embodiment, the means for radially expanding the portion of the first tubular member that does not overlap with the second tubular member using the second expansion cone includes means for displacing the second expansion cone in a longitudinal direction, and means for permitting fluidic materials displaced by the second expansion cone to be removed. In an exemplary embodiment, the means for displacing the second expansion cone in the longitudinal direction includes means for applying fluid pressure to the second expansion cone.

An apparatus has also been described that includes a subterranean formation including a borehole, a wellbore casing coupled to the borehole, and a tubular liner overlappingly coupled to the wellbore casing, wherein the inside diameter of the portion of the wellbore casing that does not overlap with the tubular liner is substantially equal to the inside diameter of the tubular liner, and wherein the tubular liner is coupled to the wellbore casing by a method including installing the tubular liner and a first expansion cone in the borehole, injecting a fluidic material into the borehole, pressurizing a portion of an interior region of the tubular liner below the first expansion cone, radially expanding at least a portion of the tubular liner in the borehole by extruding at least a portion of the tubular liner off of the first expansion cone, radially expanding an overlap between the wellbore casing and the tubular liner, and radially expanding the portion of the tubular liner that does not overlap with the wellbore casing using a second expansion cone. In an exemplary embodiment, radially expanding the overlap between the preexisting wellbore casing and the tubular liner includes impulsively applying outwardly directed radial forces to the interior of the overlap between the wellbore casing and the tubular liner. In an exemplary embodiment, impulsively applying outwardly directed radial forces to the interior of the overlap between the wellbore casing and the tubular liner includes detonating a shaped charge within the overlap between the wellbore casing and the tubular liner. In an exemplary embodiment, radially expanding the overlap between the wellbore casing and the tubular liner further includes displacing the second expansion cone in a longitudinal direction, and permitting fluidic materials displaced by the second expansion cone to be removed. In an exemplary embodiment, displacing the second expansion cone in a longitudinal direction includes applying fluid pressure to the second expansion cone. In an exemplary embodiment, radially expanding the overlap between the tubular liner and the wellbore casing using the second expansion cone further includes displacing the second expansion cone in a longitudinal direction, and compressing at least a portion of the subterranean formation using fluid pressure. In an exemplary embodiment, displacing the second expansion cone in a longitudinal direction includes applying fluid pressure to the second expansion cone. In an exemplary embodiment, radially expanding the portion of the tubular liner that does not overlap with the wellbore casing using the second expansion cone includes displacing the second expansion cone in a longitudinal direction, and permitting fluidic materials displaced by the second expansion cone to be removed. In an exemplary embodiment, displacing the second expansion cone in the longitudinal direction includes applying fluid pressure to the second expansion cone. In an exemplary embodiment, radially expanding the portion of the tubular liner that does not overlap with the wellbore casing using the second expansion cone includes displacing the second expansion cone in a longitudinal direction, and compressing at least a portion of the subterranean formation using fluid pressure. In an exemplary embodiment, displacing the second expansion cone in the longitudinal direction includes applying fluid pressure to the second expansion cone. In an exemplary embodiment, the apparatus further includes injecting a hardenable fluidic sealing material into an annulus between the tubular liner and the borehole.

An apparatus has also been described that includes a first tubular member, and a second tubular member overlappingly coupled to the first tubular member, wherein the inside diameter of the portion of the first tubular member that does not overlap with the second tubular member is substantially equal to the inside diameter of the second tubular member, and wherein the second tubular member is coupled to the first tubular member by a method that includes installing the second tubular member and a first expansion cone in the first tubular member, injecting a fluidic material into the first tubular member, pressurizing a portion of an interior region of the second tubular member below the first expansion cone, radially expanding at least a portion of the second tubular member in the first tubular member by extruding at least a portion of the tubular liner off of the first expansion cone, radially expanding an overlap between the first and second tubular members, and radially expanding the portion of the second tubular member that does not overlap with the first tubular member using a second expansion cone. In an exemplary embodiment, radially expanding the overlap between the first and second tubular members includes impulsively applying outwardly directed radial forces to the interior of the overlap between the first and second tubular members. In an exemplary embodiment, impulsively applying outwardly directed radial forces to the interior of the overlap between the first and second tubular members includes detonating a shaped charge within the overlap between the first and second tubular members. In an exemplary embodiment, radially expanding the overlap between the first and second tubular members further includes displacing the second expansion cone in a longitudinal direction, and permitting fluidic materials displaced by the second expansion cone to be removed. In an exemplary embodiment, displacing the second expansion cone in a longitudinal direction includes applying fluid pressure to the second expansion cone. In an exemplary embodiment, radially expanding the overlap between the first and second tubular members further includes displacing the second expansion cone in a longitudinal direction, and compressing at least a portion of the subterranean formation using fluid pressure. In an exemplary embodiment, displacing the second expansion cone in a longitudinal direction includes applying fluid pressure to the second expansion cone. In an exemplary embodiment, radially expanding the portion of the second tubular member that does not overlap with the first tubular members using the second expansion cone includes displacing the second expansion cone in a longitudinal direction, and permitting fluidic materials displaced by the second expansion cone to be removed. In an exemplary embodiment, displacing the second expansion cone in the longitudinal direction includes applying fluid pressure to the second expansion cone.

Although illustrative embodiments of the invention have been shown and described, a wide range of modification, changes and substitution is contemplated in the foregoing disclosure. In some instances, some features of the present invention may be employed without a corresponding use of the other features. Accordingly, it is appropriate that the appended claims be construed broadly and in a manner consistent with the scope of the invention.

The invention claimed is:

1. A method of creating a mono-diameter wellbore casing in a borehole located in a subterranean formation including a preexisting wellbore casing, comprising:

installing a tubular liner and a first expansion cone in the borehole;

injecting a fluidic material into the borehole;

pressurizing a portion of an interior region of the tubular liner below the first expansion cone;

radially expanding at least a portion of the tubular liner in the borehole by extruding at least a portion of the tubular liner off of the first expansion cone;

radially expanding an overlap between the preexisting wellbore casing and the tubular liner; and radially expanding the portion of the tubular liner that does not overlap with the preexisting wellbore casing using a second expansion cone.

2. The method of claim 1, wherein radially expanding the overlap between the preexisting wellbore casing and the tubular liner comprises:

impulsively applying outwardly directed radial forces to the interior of the overlap between the preexisting wellbore casing and the tubular liner.

3. The method of claim 2, wherein impulsively applying outwardly directed radial forces to the interior of the overlap between the preexisting wellbore casing and the tubular liner, comprises:

detonating a shaped charge within the overlap between the preexisting wellbore casing and the tubular liner.

4. The method of claim 2, wherein radially expanding the overlap between the preexisting wellbore casing and the tubular liner further comprises:

displacing the second expansion cone in a longitudinal direction; and permitting fluidic materials displaced by the second expansion cone to be removed.

5. The method of claim 4, wherein displacing the second expansion cone in a longitudinal direction comprises:

applying fluid pressure to the second expansion cone.

6. The method of claim 2, wherein radially expanding the overlap between the tubular liner and the preexisting wellbore casing using the second expansion cone further comprises:

displacing the second expansion cone in a longitudinal direction; and compressing at least a portion of the subterranean formation using fluid pressure.

7. The method of claim 6, wherein displacing the second expansion cone in a longitudinal direction comprises:

applying fluid pressure to the second expansion cone.

8. The method of claim 1, wherein radially expanding the portion of the tubular liner that does not overlap with the preexisting wellbore casing using the second expansion cone comprises:

displacing the second expansion cone in a longitudinal direction; and permitting fluidic materials displaced by the second expansion cone to be removed.

9. The method of claim 8, wherein displacing the second expansion cone in the longitudinal direction comprises:

applying fluid pressure to the second expansion cone.

10. The method of claim 1, wherein radially expanding the portion of the tubular liner that does not overlap with the preexisting wellbore casing using the second expansion cone comprises:

displacing the second expansion cone in a longitudinal direction; and compressing at least a portion of the subterranean formation using fluid pressure.

11. The method of claim 10, wherein displacing the second expansion cone in the longitudinal direction comprises:

applying fluid pressure to the second expansion cone.

12. The method of claim 1, further comprising:

injecting a hardenable fluidic sealing material into an annulus between the tubular liner and the borehole.

13. A system for creating a mono-diameter wellbore casing in a borehole located in a subterranean formation including a preexisting wellbore casing, comprising:

means for installing a tubular liner and a first expansion cone in the borehole;

means for injecting a fluidic material into the borehole;

means for pressurizing a portion of an interior region of the tubular liner below the first expansion cone;

means for radially expanding at least a portion of the tubular liner in the borehole by extruding at least a portion of the tubular liner off of the first expansion cone;

means for applying outwardly directed radial forces to an overlap between the preexisting wellbore casing and the tubular liner; and means for radially expanding the portion of the tubular liner that does not overlap with the preexisting wellbore casing using a second expansion cone.

14. The system of claim 13, wherein the means for applying outwardly directed radial forces to the overlap between the preexisting wellbore casing and the tubular liner comprises:

means for impulsively applying outwardly directed radial forces to the interior of the overlap between the preexisting wellbore casing and the tubular liner.

15. The system of claim 14, wherein the means for impulsively applying outwardly directed radial forces to the interior of the overlap between the preexisting wellbore casing and the tubular liner, comprises:

means for detonating a shaped charge within the overlap between the preexisting wellbore casing and the tubular liner.

16. The system of claim 14, wherein the means for applying outwardly directed radial forces to the overlap between the preexisting wellbore casing and the tubular liner further comprises:

displacing the second expansion cone in a longitudinal direction; and permitting fluidic materials displaced by the second expansion cone to be removed.

17. The system of claim 16, wherein the means for displacing the second expansion cone in a longitudinal direction comprises:

means for applying fluid pressure to the second expansion cone.

18. The system of claim 14, wherein the means for radially expanding the overlap between the tubular liner and the preexisting wellbore casing using the second expansion cone further comprises:

means for displacing the second expansion cone in a longitudinal direction; and means for compressing at least a portion of the subterranean formation using fluid pressure.

19. The system of claim 18, wherein the means for displacing the second expansion cone in a longitudinal direction comprises:

means for applying fluid pressure to the second expansion cone.

20. The system of claim 13, wherein the means for radially expanding the portion of the tubular liner that does not overlap with the preexisting wellbore casing using the second expansion cone comprises:

means for displacing the second expansion cone in a longitudinal direction; and means for permitting fluidic materials displaced by the second expansion cone to be removed.

21. The system of claim 20, wherein the means for displacing the second expansion cone in the longitudinal direction comprises:

means for applying fluid pressure to the second expansion cone.

22. The system of claim 13, wherein the means for radially expanding the portion of the tubular liner that does not overlap with the preexisting wellbore casing using the second expansion cone comprises:

means for displacing the second expansion cone in a longitudinal direction; and means for compressing at least a portion of the subterranean formation using fluid pressure.

23. The system of claim 22, wherein the means for displacing the second expansion cone in the longitudinal direction comprises:

means for applying fluid pressure to the second expansion cone.

24. The system of claim 13, further comprising:

means for injecting a hardenable fluidic sealing material into an annulus between the tubular liner and the borehole.

25. A method of creating a tubular structure having a substantially constant inside diameter, comprising:

installing a first tubular member and a first expansion cone within a second tubular member;

injecting a fluidic material into the second tubular member;

pressurizing a portion of an interior region of the first tubular member below the first expansion cone;

radially expanding at least a portion of the first tubular member in the second tubular member by extruding at least a portion of the first tubular member off of the first expansion cone;

radially expanding an overlap between the first and second tubular members; and radially expanding the portion of the first tubular member that does not overlap with the second tubular member using a second expansion cone.

26. The method of claim 25, wherein radially expanding the overlap between the first and second tubular members comprises:

impulsively applying outwardly directed radial forces to the interior of the overlap between the first and second tubular members.

27. The method of claim 26, wherein impulsively applying outwardly directed radial forces to the interior of the overlap between the first and second tubular members, comprises:

detonating a shaped charge within the overlap between the first and second tubular members.

28. The method of claim 26, wherein radially expanding the overlap between the first and second tubular members further comprises:

displacing the second expansion cone in a longitudinal direction; and permitting fluidic materials displaced by the second expansion cone to be removed.

29. The method of claim 28, wherein displacing the second expansion cone in a longitudinal direction comprises:

applying fluid pressure to the second expansion cone.

30. The method of claim 26, wherein radially expanding the overlap between the first and second tubular members using the second expansion cone further comprises:

displacing the second expansion cone in a longitudinal direction; and compressing at least a portion of the subterranean formation using fluid pressure.

31. The method of claim 30, wherein displacing the second expansion cone in a longitudinal direction comprises:

applying fluid pressure to the second expansion cone.

32. The method of claim 25, wherein radially expanding the portion of the first tubular member that does not overlap with the second tubular member using the second expansion cone comprises:

displacing the second expansion cone in a longitudinal direction; and permitting fluidic materials displaced by the second expansion cone to be removed.

33. The method of claim 32, wherein displacing the second expansion cone in the longitudinal direction comprises:

applying fluid pressure to the second expansion cone.

34. A system for creating a tubular structure having a substantially constant inside diameter, comprising:

means for installing a first tubular member and a first expansion cone within a second tubular member;

means for injecting a fluidic material into the second tubular member;

means for pressurizing a portion of an interior region of the first tubular member below the first expansion cone;

means for radially expanding at least a portion of the first tubular member in the second tubular member by extruding at least a portion of the first tubular member off of the first expansion cone;

means for applying outwardly directed radial forces to an overlap between the first and second tubular members; and means for radially expanding the portion of the first tubular member that does not overlap with the second tubular member using a second expansion cone.

35. The system of claim 34, wherein the means for applying outwardly directed radial forces to the overlap between the first and second tubular members comprises:

means for impulsively applying outwardly directed radial forces to the interior of the overlap between the first and second tubular members.

36. The system of claim 35, wherein the means for impulsively applying outwardly directed radial forces to the interior of the overlap between the first and second tubular members, comprises:

means for detonating a shaped charge within the overlap between the first and second tubular members.

37. The system of claim 35, wherein the means for applying outwardly directed radial forces to the overlap between the first and second tubular members further comprises:

means for displacing the second expansion cone in a longitudinal direction; and means for permitting fluidic materials displaced by the second expansion cone to be removed.

38. The system of claim 37, wherein the means for displacing the second expansion cone in a longitudinal direction comprises:

means for applying fluid pressure to the second expansion cone.

39. The system of claim 35, wherein the means for applying outwardly directed radial forces to the overlap between the first and second tubular members using the second expansion cone further comprises:

means for displacing the second expansion cone in a longitudinal direction; and means for compressing at least a portion of the subterranean formation using fluid pressure.

40. The system of claim 39, wherein the means for displacing the second expansion cone in a longitudinal direction comprises;

means for applying fluid pressure to the second expansion cone.

41. The system of claim 34, wherein the means for radially expanding the portion of the first tubular member that does not overlap with the second tubular member using the second expansion cone comprises:

means for displacing the second expansion cone in a longitudinal direction; and means for permitting fluidic materials displaced by the second expansion cone to be removed.

42. system of claim 41, wherein the means for displacing the second expansion cone in the longitudinal direction comprises:

means for applying fluid pressure to the second expansion cone.

43. An apparatus, comprising:

a subterranean formation including a borehole;

a wellbore casing coupled to the borehole;

a tubular liner positioned in the borehole in a partially overlapping relationship with the wellbore casing;

a first expansion cone positioned in the borehole;

an apparatus for radially expanding the partial overlap between the wellbore casing and the tubular liner; and a second expansion cone for radially expanding the portion of the tubular liner that does not overlap with the wellbore casing.

44. The apparatus of claim 43, wherein the apparatus for radially expanding the overlap between the preexisting wellbore casing and the tubular liner comprises an apparatus operable for:

impulsively applying outwardly directed radial forces to the interior of the overlap between the wellbore casing and the tubular liner.

45. The apparatus of claim 44, wherein the apparatus operable for impulsively applying outwardly directed radial forces to the interior of the overlap between the wellbore casing and the tubular liner, comprises:

a shaped charge within the overlap between the wellbore casing and the tubular liner.

46. The apparatus of claim 44, wherein the apparatus for radially expanding the overlap between the wellbore casing and the tubular liner is further operable to:

displace the second expansion cone in a longitudinal direction; and permit fluidic materials displaced by the second expansion cone to be removed.

47. The apparatus of claim 46, wherein displacing the second expansion cone in a longitudinal direction comprises:

applying fluid pressure to the second expansion cone.

48. The apparatus of claim 43, further comprising:

a hardenable fluidic sealing material positioned in an annulus between the tubular liner and the borehole.

49. An apparatus, comprising:

a first tubular member;

a second tubular member positioned in a partially overlapping relationship within the first tubular member;

a first expansion cone positioned in the first tubular member;

an apparatus for radially expanding the partial overlap between the first and second tubular members; and a second expansion cone for radially expanding the portion of the second tubular member that does not overlap with the first tubular member.

50. The apparatus of claim 49, wherein the apparatus for radially expanding the overlap between the first and second tubular members comprises an apparatus operable for:

impulsively applying outwardly directed radial forces to the interior of the overlap between the first and second tubular members.

51. The apparatus of claim 50, wherein the apparatus operable for impulsively applying outwardly directed radial forces to the interior of the overlap between the first and second tubular members, comprises:

a shaped charge within the overlap between the first and second tubular members.

52. The apparatus of claim 50, wherein the apparatus for radially expanding the overlap between the first and second tubular members is further operable to:

displace the second expansion cone in a longitudinal direction; and permit fluidic materials displaced by the second expansion cone to be removed.

53. The apparatus of claim 52, wherein displacing the second expansion cone in a longitudinal direction comprises:

applying fluid pressure to the second expansion cone.

54. The apparatus of claim 50, wherein the apparatus for radially expanding the overlap between the first and second tubular members is further operable to:

displace the second expansion cone in a longitudinal direction; and compress at least a portion of the subterranean formation using fluid pressure.

55. A method of creating a mono-diameter wellbore casing in a borehole located in a subterranean formation including a preexisting wellbore casing, comprising:

installing a tubular liner and a first expansion device in the borehole;

radially expanding at least a portion of the tubular liner in the borehole using the first expansion device;

radially expanding an overlap between the preexisting wellbore casing and the tubular liner by detonating a shaped charge within the overlap between the preexisting wellbore casing and the tubular liner; and radially expanding the portion of the tubular liner that does not overlap with the preexisting wellbore casing using a second expansion device.

56. A system for creating a mono-diameter wellbore casing in a borehole located in a subterranean formation including a preexisting wellbore casing, comprising:

means for installing a tubular liner and a first expansion device in the borehole;

means for radially expanding at least a portion of the tubular liner in the borehole using the first expansion device;

means for radially expanding an overlap between the preexisting wellbore casing and the tubular liner by impulsively applying outwardly directed radial forces to the interior of the overlap between the preexisting wellbore casing and the tubular liner; and means for radially expanding the portion of the tubular liner that does not overlap with the preexisting wellbore casing using a second expansion device.

57. The system of claim 56, wherein means for impulsively applying outwardly directed radial forces to the interior of the overlap between the preexisting wellbore casing and the tubular liner, comprises:

means for detonating a shaped charge within the overlap between the preexisting wellbore casing and the tubular liner.

58. A method of creating a tubular structure having a substantially constant inside diameter, comprising:

installing a first tubular member and a first expansion device within a second tubular member;

radially expanding at least a portion of the first tubular member in the second tubular member using the first expansion device;

radially expanding an overlap between the first and second tubular members by detonating a shaped charge within the overlap between the first and second tubular members; and radially expanding the portion of the first tubular member that does not overlap with the second tubular member using a second expansion device.

59. A system for creating a tubular structure having a substantially constant inside diameter, comprising:

means for installing a first tubular member and a first expansion device within a second tubular member;

means for radially expanding at least a portion of the first tubular member in the second tubular member using the first expansion device;

means for radially expanding an overlap between the first and second tubular members by impulsively applying outwardly directed radial forces to the interior of the overlap between the first tubular member and the second tubular member; and means for radially expanding the portion of the first tubular member that does not overlap with the second tubular member using a second expansion device.

60. The system of claim 59, wherein means for impulsively applying outwardly directed radial forces to the interior of the overlap between the first tubular member and the second tubular member comprises means for detonating a shaped charge within the overlap between the first tubular member and the second tubular member.

61. A system for creating a mono-diameter wellbore casing in a borehole located in a subterranean formation including a preexisting wellbore casing, and comprising:

means for installing a tubular liner and a first expansion device in the borehole;

means for radially expanding at least a portion of the tubular liner in the borehole using the first expansion device;

means for radially expanding an overlap between the preexisting wellbore casing and the tubular liner; and means for radially expanding the portion of the tubular liner that does not overlap with the preexisting wellbore casing using a second expansion device, wherein the means for radially expanding the overlap between the preexisting wellbore casing and the tubular liner comprises:

means for displacing the second expansion cone in a longitudinal direction; and means for permitting fluidic materials displaced by the second expansion cone to be removed.

62. The system of claim 61, wherein means for displacing the second expansion cone in a longitudinal direction comprises means for applying fluid pressure to the second expansion cone.

63. A system for creating a tubular structure having a substantially constant inside diameter comprising:

means for installing a first tubular member and a first expansion device within a second tubular member;

means for radially expanding at least a portion of the first tubular member in the second tubular member using the first expansion device;

means for radially expanding an overlap between the first and second tubular members; and means for radially expanding the portion of the first tubular member that does not overlap with the second tubular member using a second expansion device;

wherein the means for radially expanding the overlap between the preexisting wellbore casing and the tubular liner comprises:

means for displacing the second expansion cone in a longitudinal direction; and means for permitting fluidic materials displaced by the second expansion cone to be removed.

64. The system of claim 63, wherein means for displacing the second expansion cone in a longitudinal direction comprises means for applying fluid pressure to the second expansion cone.

65. A method of creating a mono-diameter wellbore casing in a borehole located in a subterranean formation including a preexisting wellbore casing, comprising:

installing a tubular liner and a first expansion device in the borehole;

radially expanding at least a portion of the tubular liner in the borehole using the first expansion device;

radially expanding an overlap between the preexisting wellbore casing and the tubular liner by displacing the second expansion cone in a longitudinal direction, and permitting fluidic materials displaced by the second expansion cone to be removed; and radially expanding the portion of the tubular liner that does not overlap with the preexisting wellbore casing using a second expansion device.

66. The method of claim 65, wherein displacing the second expansion cone in a longitudinal direction comprises applying fluid pressure to the second expansion cone.

67. A method of creating a mono-diameter wellbore casing in a borehole located in a subterranean formation including a preexisting wellbore casing, comprising:

installing a tubular liner and a first expansion device in the borehole;

radially expanding at least a portion of the tubular liner in the borehole using the first expansion device;

radially expanding an overlap between the preexisting wellbore casing and the tubular liner by displacing the second expansion cone in a longitudinal direction; and compressing at least a portion of the subterranean formation using fluid pressure; and radially expanding the portion of the tubular liner that does not overlap with the preexisting wellbore casing using a second expansion device.

68. The method of claim 67, wherein displacing the second expansion cone in a longitudinal direction comprises applying fluid pressure to the second expansion cone.

69. A method of creating a tubular structure having a substantially constant inside diameter, comprising:

installing a first tubular member and a first expansion device within a second tubular member;

radially expanding at least a portion of the first tubular member in the second tubular member using the first expansion device;

radially expanding an overlap between the first and second tubular members by displacing the second expansion cone in a longitudinal direction, and permitting fluidic materials displaced by the second expansion cone to be removed; and radially expanding the portion of the first tubular member that does not overlap with the second tubular member using a second expansion device.

70. The method of claim 69, wherein displacing the second expansion cone in a longitudinal direction comprises applying fluid pressure to the second expansion cone.

71. A method of creating a tubular structure having a substantially constant inside diameter, comprising:

installing a first tubular member and a first expansion device within a second tubular member;

radially expanding at least a portion of the first tubular member in the second tubular member using the first expansion device;

radially expanding an overlap between the first and second tubular members by displacing the second expansion cone in a longitudinal direction; and compressing at least a portion of the subterranean formation using fluid pressure; and radially expanding the portion of the first tubular member that does not overlap with the second tubular member using a second expansion device.

72. The method of claim 71, wherein displacing the second expansion cone in a longitudinal direction comprises applying fluid pressure to the second expansion cone.

* * * * *